US005104781A

United States Patent [19]

Seto et al.

[11] Patent Number: 5,104,781

[45] Date of Patent: Apr. 14, 1992

[54] SILVER HALIDE COLOR PHOTOGRAPHIC LIGHT-SENSITIVE MATERIAL CONTAINING PYRAZOLOAZOLE COUPLER

[75] Inventors: Nobuo Seto; Masakazu Morigaki, both of Ashigari, Japan

[73] Assignee: Fuji Photo Film Co., Ltd., Kanagawa, Japan

[21] Appl. No.: 475,345

[22] Filed: Feb. 5, 1990

[30] Foreign Application Priority Data

Feb. 8, 1989 [JP] Japan ..... 1-029041

[51] Int. Cl.[5] ..... G03C 1/38; G03C 1/34; G03C 7/38

[52] U.S. Cl. ..... 430/546; 430/551; 430/558

[58] Field of Search ..... 430/551, 558, 546

[56] References Cited

U.S. PATENT DOCUMENTS

| | | | |
|---|---|---|---|
| H,851 | 11/1960 | Naruse . | |
| 4,639,413 | 1/1987 | Kawagishi et al. | 430/546 |
| 4,748,100 | 3/1988 | Umemoto et al. | 430/505 |
| 4,795,696 | 1/1989 | Sasaki et al. | 430/512 |

FOREIGN PATENT DOCUMENTS

| | | | |
|---|---|---|---|
| 0319985 | 6/1989 | European Pat. Off. . | |
| 2246052 | 10/1987 | Japan | 430/551 |
| 2246053 | 10/1987 | Japan | 430/551 |

*Primary Examiner*—Charles L. Bowers, Jr.
*Assistant Examiner*—Lee C. Wright
*Attorney, Agent, or Firm*—Birch, Stewart, Kolasch & Birch

[57] ABSTRACT

The present invention relates to a silver halide color photographic light sensitive material having at least one silver halide color photographic light-sensitive emulsion layer on a support which comprises (i) at least one coupler represented by Formula (I), (ii) at least one compound represented by Formula (II), (iii) at least one compound represented by Formula (III), and (iv) at least one high boiling organic solvent represented by Formula (IV), wherein each of the couplers and the compounds represented by Formulas (I) to (IV) are incorporated in the same light sensitive layer, and wherein Formulas (I) to (IV) are shown below.

Formula (I)

Formula (II)

Formula (III)

Formula (IV)

The substituents are defined hereinbelow.

15 Claims, No Drawings

SILVER HALIDE COLOR PHOTOGRAPHIC LIGHT-SENSITIVE MATERIAL CONTAINING PYRAZOLOAZOLE COUPLER

FIELD OF THE INVENTION

The present invention relates to a silver halide color photographic light-sensitive material, and more particularly to a silver halide color photographic material in which a dye image formed by pyrazoloazole couplers can be prevented from being faded and a non-image area can be prevented from being discolored.

BACKGROUND OF THE INVENTION

It is well known that aromatic primary amine color developing agents oxidized by exposed silver halide as an oxidizing agent react with couplers to form dyes such as indophenol, indoaniline, indamine, azomethine, phenoxazine, phenazine and the like, whereby a dye image can be formed.

Couplers useful for forming a magenta dye image include 5-pyrazolone, cyanoacetophenone, indazolone, pyrazolobenzimidazole.

Most of the couplers which have been conventionally used as magenta dye image forming couplers and which have been extensively studied include the 5-pyrazolone compounds. However, it is known that in dyes formed from 5-pyrazolone couplers, there exists an unnecessary absorption having a yellow component in the vicinity of 430 nm and color turbidity is caused thereby.

A pyrazolobenzimidazole skeleton described in U.K. Patent 1,047,612, an indazolone skeleton described in U.S. Patent 3,770,447 and a pyrazolo[5,1-c]-1,2,4-triazole skeleton described in U.S. Pat. No. 3,725,067 have been proposed as magenta dye image forming skeletons which reduce the yellow component.

The present inventors have previously developed pyrazoloazole magenta couplers such as imidazo[1,2-b]pyrazoles, pyrazolo[1,5-b][1,2,4]triazoles, pyrazolo-[1,5-d]tetrazoles, pyrazolo[1,5-d]benzimidazoles and pyrazolopyrazoles as magenta couplers which have good color formability and exhibit less unnecessary absorption of yellow color. However, it has been found that azomethine dyes formed from such pyrazoloazole couplers have relatively poor fastness to light, or heat-moisture and are not sufficiently prevented from being faded when conventional dye image stabilizers (e.g., alkyl-substituted hydroquinones) are used.

Attempts to solve the problems referred to hereinabove have been made by adding various compounds. For example, there are known methods wherein hindered amine derivatives are added, described in JP-A-62-178241 (the term "JP-A" as used herein means an "unexamined published Japanese patent application"), JP-A-62-278551, JP-A-63-231340, JP-A-61-4045, JP-A-62-92945 and European Patents 242211 and 218266 and methods wherein hindered piperidine derivatives having phenolic hydroxyl group in the molecular structure are added, described in JP-B-57-20617 (the term "JP-B" as used herein means an examined Japanese patent publication"), JP-A-58-114036, JP-A-59-53846, JP-A-59-78344, JP-A-59-109052, JP-A-59-113441, JP-A-59-116747, JP-A-59-119351 and JP-A-59-133543. However, these compounds do not have a satisfactory effect of preventing azomethine dyes formed from the pyrazoloazole couplers from being faded, and some compounds have an adverse effect on photographic characteristics.

Methods wherein alkoxybenzene derivatives are added are described in JP-A-60-262159, JP-A-59-125732, JP-A-61-282245, JP-A-62-244045, JP-A-62-244046, JP-A-62-273531, JP-A-61-158330, JP-A-63-95439, JP-A-63-95448, JP-A-63-95450 and JP-A-63-284548. These compounds have an effect of improving fastness to light in the high density region of dyes formed by the couplers, but do not have a sufficient effect in the low density region of dyes when the amount of exposure is small.

Further, methods wherein four or more different compounds are used in combination have been proposed to give a synergistic effect, thus improving the problem with respect to fading by light. For example, methods wherein hindered amine derivatives are used in combination with different compounds (e.g., hydroquinone derivatives, alkoxybenzene derivatives, etc.) are disclosed in JP-A-62-183459, JP-A-62-180367, JP-A-62-246053, JP-A-62-96944, JP-A-62-253168, European Patents 218266 and 242211. However, these methods have neither a remarkable synergistic effect nor a sufficient effect of improving fastness to light in the region of low density.

Generally, couplers and fading inhibitors are dissolved in high-boiling organic solvents in order to use them. The color formability of the couplers, the hue of the formed colors and the fastness to light, heat and moisture are greatly affected by the high-boiling organic solvents. Hence, the development of novel high-boiling organic solvents and methods for using them have been examined. For example, JP-A-62-180367, JP-A-62-246053 and European Patent 242211 disclose the use of phthalic ester type high-boiling organic solvents, and European Patent 218266 discloses the use of phosphoric ester type high-boiling organic solvents. In the phthalic ester type high-boiling organic solvents, however, foot cutting on the long wave side of the absorption wave of formed dyes is not good, and color reproducibility is not sufficiently improved.

Accordingly, it would be useful to develop a technique which does not have an adverse effect on photographic characteristics, gives good color-reproducibility, can inhibit fading by light, particularly requires a lower amount of exposure and hence can inhibit fading by light in the region of low color density.

SUMMARY OF THE INVENTION

Accordingly, an object of the present invention is to provide a color photographic light-sensitive material which contains a pyrazoloazole coupler excellent in hue and color formability, which is excellent in color reproducibility and produces a dye image excellent in fastness to light.

Another object of the present invention is to provide a color photographic light-sensitive material which does not substantially cause changes in photographic characteristics with the passage of time after photographing.

The present inventors have conducted studies and they have found that the above objects can be achieved by the present invention described below.

Namely, the present invention provides a silver halide color photographic light-sensitive material having at least one silver halide color photographic light-sensitive emulsion layer on a support, which comprises at least one coupler represented by the following general formula (I), at least one compound represented by the following general formula (II), at least one compound represented by the following formula (III), and at least one high-boiling organic solvent represented by the following general formula (IV), which are incorporated in the same emulsion layer.

Formula (I) is represented by the following structure:

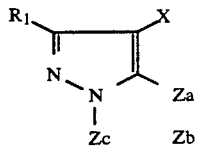

(I)

wherein $R_1$ represents a hydrogen atom or a substituent group; X represents a hydrogen atom or a group which is eliminated by the coupling reaction with the oxidcation product of an aromatic primary amine developing agent; Za, Zb and Zc each represent a methine group, a substituted methine group, =N— or —NH—, and one of the Za-Zb bond and the Zb-Zc bond is a double bond and the other is a single bond. When the Zb-Zc bond is a carbon-carbon double bond, the bond may constitute a part of an aromatic ring. When a dimer or a higher polymer is formed at $R_1$ or X, such a dimer or higher polymer is included within the scope of the invention. When Za, Zb or Zc is a substituted methine group, a dimer or a higher polymer formed at the substituted methine group is also included within the scope of the invention.

Formula (II) is represented by the following structure:

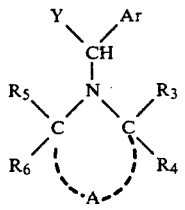

(II)

wherein Ar represents an aryl group or a heterocyclic ring; Y represents a hydrogen atom or a substituent group; $R_3$, $R_4$, $R_5$ and $R_6$ may be the same or different groups and each is an alkyl group; A represents a non-metallic atomic group required for the formation of a 6-membered ring; $R_3$ and $R_4$, $R_5$ and $R_6$, Y and Ar, Ar and $R_3$, Y and $R_3$, $R_3$ and A, or $R_3$ and Y may be combined together to form a 5-membered or a 6-membered ring; the compounds of formula (II) have no phenolic hydroxyl group in the molecular structure; and said compounds may be in the form of a dimer or a higher polymer formed at any position on the compounds capable of chemically bonding.

Formula (III) is represented by the following structure:

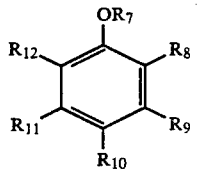

(III)

wherein $R_7$ represents an alkyl group, an alkenyl group, an aryl group, a heterocyclic group or a group of

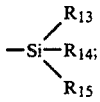

$R_{13}$, $R_{14}$ and $R_{15}$ may be the same or different groups and each is an alkyl group, an alkenyl group, an aryl group, an alkoxy group, an alkenoxy group or an aryloxy group; $R_8$, $R_9$, $R_{10}$, $R_{11}$ and $R_{12}$ may be the same or different groups and each is a hydrogen atom, an alkyl group, an alkenyl group, an aryl group, an acylamino group, an alkylamino group, an alkylthio group, an arylthio group, a halogen atom, a nitrogen atom-containing heterocyclic ring bonding to the benzen ring through the nitrogen atom, or a group of —O—$R_7'$; $R_7'$ has the same meaning as $R_7$; $R_7$ and $R_8$ may be combined together to form a 5-membered or 6-membered ring or a spiro ring; and $R_8$ and $R_9$ or $R_9$ and $R_{10}$ may be combined together to form a 5-membered or 6-membered ring or a spiro ring; said compounds of formula (III) may be in the form of a dimer or a higher polymer formed at any position on the compounds capable of chemically bonding.

Formula (IV) is represented by the following structure:

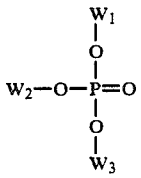

(IV)

wherein $W_1$, $W_2$ and $W_3$ each represents a substituted or an unsubstituted alkyl, cycloalkyl, alkenyl, aryl or heterocyclic group and the sum total of the carbon atoms of $W_1$, $W_2$ and $W_3$ is not less than 8.

DETAILED DESCRIPTION OF THE INVENTION

The couplers of formula (I) will be illustrated in more detail below.

Formula (I):

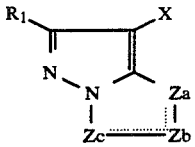

In formula (I), $R_1$ is a hydrogen atom or a substituent group; X is a hydrogen atom or a group which is eliminated by the coupling reaction with the oxidation product of an aromatic primary amine developing agent; Za, Zb and Zc are each a methine group, a substituted methine group, =N— or —NH—; one of the Za-Zb bond and the Zb-Zc bond is a double bond and the other is a single bond; and when the Zb-Zc bond is a carbon-to-carbon double bond, the bond may be a part of an aromatic ring. A dimer or a higher polymer may be formed by $R_1$ or X or by a substituted methine group when Za, Zb or Zc is a substituted methine group.

In the compounds of formulae (I), (II) and (III), a dimer or higher polymer means that the compound has two or more of the coupler moiety of the formulae per molecule. Bis-compounds and polymer couplers are included within the scope of the dimer or higher polymer. The polymer couplers may be homopolymers composed of monomers having a moiety of the formulae (preferably monomers having a vinyl group, hereinafter referred to as a vinyl monomer) or copolymers of the monomers with non-color forming ethylenic monomers which are not coupled with the oxidation products of aromatic primary amine developing agents.

Among the pyraazole type magenta couplers of formula (I), compounds represented by the following general formulas (I-1), (I-2), (I-3), (I-4), (I-5), (I-6) and (I-7) are preferred.

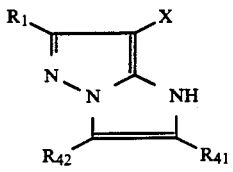

(I-1)

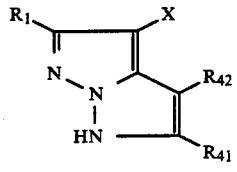

(I-2)

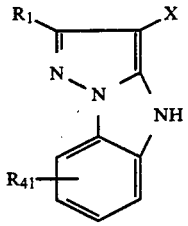

(I-3)

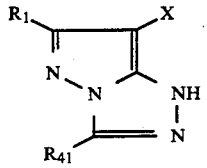

(I-4)

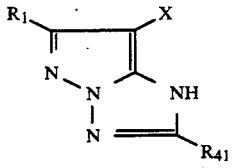

(I-5)

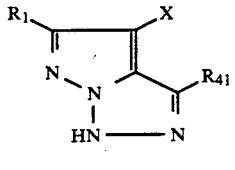

(I-6)

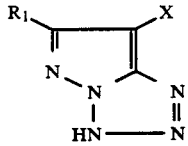

(I-7)

Among the couplers of formulae (I-1) to (I-7), the compounds of formulae (I-1), (I-4) and (I-5) are preferred for the purpose of the present invention. The compounds of formulas (I-4) and (I-5) are more preferred.

In formulas (I) and (I-1) to (I-7), $R_1$, $R_{41}$ and $R_{42}$ may be the same or different groups and each is a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group; X is hydrogen atom, a halogen atom, a carboxyl group, or a group which is attached to the carbon atom at the coupling position through an oxygen atom, a nitrogen atom or a sulfur atom and is eliminated by a coupling reaction; or $R_1$, $R_{41}$, $R_{42}$ or X may be a bivalent group to form a bis-compound.

The couplers may be in the form of polymer couplers where each of the residues of the couplers represented by formulae (I) and (I-1) to (I-7) exists in the main chain of a polymer or on the side chain thereof. A polymer derived from a vinyl monomer having a moiety represented by said formulae (I) and (I-1) to (I-7) wherein $R_1$, $R_{41}$, $R_{42}$ or X is a vinyl group or a bonding group, is particularly preferred.

More specifically, $R_1$, $R_{41}$ and $R_{42}$ are each a hydrogen atom, a halogen atom (e.g., chlorine, bromine), an alkyl group (e.g., methyl, propyl, isopropyl, t-butyl, trifluoromethyl, tridecyl, 2-[α-{3-(2-octyloxy-5-tert-octylbenzenesulfonamido)-phenoxy}tetradecaneamido]-ethyl, 3-(2,4-di-t-amylphenoxy)propyl, allyl, 2-dodecyloxyethyl, 1-(2-ocytyloxy-5-tert-octylbenzenesulfonamido)-2-propyl, 1-{4-(2-butoxy-5-tert-octyl-benzenesulfonamido)phenyl}propyl, 3-phenoxypropyl, 2-hexylsulfonylethyl, cyclopentyl, benzyl), an aryl group (e.g., phenyl, 4-t-butylphenyl, 2,4-di-t-amylphenyl, 4-tetradecaneamidophenyl), a heterocyclic group (e.g., 2-furyl, 2-thienyl, 2-pyrimidinyl, 2-benzthiazolyl), a cyano group, an alkoxy group (e.g., methoxy, ethoxy, 2-methoxyethoxy, 2-dodecyloxyethoxy, 2-methanesulfonylethoxy), an aryloxy group (e.g., phenoxy, 2-methylphenoxy, 4-t-butylphenoxy), a heterocyclic oxy group (e.g., 2-benzimidazolyloxy group), an acyloxy group (e.g., acetoxy, hexadecanoyloxy), a carbamoyloxy group (e.g., N-phenylcarbamoyloxy, N-ethylcarbamoyloxy), a silyloxy group (e.g., trimethylsilyloxy), a sulfonyloxy group (e.g., dodecylsulfonyloxy), an acylamino group (e.g., acetamido, benzamido, tetradecaneamido, α-(2,4-di-t-amylphenoxy)-butylamido, γ-(3-t-butyl-4-hydroxyphenoxy)-butyramido, α-{4-(4-hydroxyphenylsulfonyl)phenoxy}decaneamido), an anilino group (e.g., phenylamino, 2-chloroanilino, 2-chloro-5-tetradecaneamidoanilino, 2-chloro-5-dodecyloxycarbonylanilino, N-acetylanilino, 2-chloro-5-{α-(3-t-butyl-4-hydroxyphenoxy)dodecaneamido}anilino), a ureido group (e.g., phenylureido, methylureido, N,N-dibutylureido), an imido group (e.g., N-succinimido, 3-benzylhydantoinyl, 4-(2-ethylhexanoylamino)phthalimido), a sulfamoylamino group (e.g., N,N-di-propylsulfamoylamino, N-methyldecylsulfamoylamino), a carbamoylamino group (e.g., N,N-diethylcarbamoylamino, N-methyldecylcarbamoylamino), an alkylthio group (e.g., methylthio, octylthio, tetradecylthio, 2-phenoxyethylthio, 3-phenoxypropylthio, 3-(4-t-butylphenoxy)propylthio), an arylthio group (e.g., phenylthio, 2-butoxy-5-t-octylphenylthio, 3-pentadecylphenylthio, 2-carboxyphenylthio, 4-tetradecaneamidophenylthio), a heterocyclic thio group (e.g., 2-benzthiazolylthio), an alkoxycarbonylamino group (e.g., methoxycarbonylamino, tetradecyloxycarbonylamino), an aryloxycarbonylamino (e.g., phenoxycarbonylamino, 2,4-di-tert-butylphenoxycarbonylamino), a sulfonamido group (e.g., methanesulfonamido, hexadecanesulfonamido, benzenesulfonamido, p-toluenesulfonamido, octadecanesulfonamido, 2-methyloxy-5-t-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-tert-amylphenoxy)-propyl}-carbamoyl), an acyl group (e.g., acetyl, (2,4-di-tertamylphenoxy)acetyl, benzoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-di-ethylsulfamoyl), a sulfonyl group (e.g., methanesulfonyl, octanesulfonyl, benzenesulfonyl, toluenesulfonyl), a sulfinyl group (e.g., octanesulfinyl, dodecylsulfinyl, phenylsulfinyl) or an alkoxycarbonyl group (e.g., methoxycarbonyl, butyloxycarbonyl, dodecylcarbonyl, octadecylcarbonyl), an aryloxycarbonyl group (e.g., phenyloxycarbonyl, 3-pentadecylphenyloxycarbonyl); X is a hydrogen atom, a halogen atom (e.g., chlorine, bromine, iodine), a carboxyl group, or a group which is attached through an oxygen atom (e.g., acetoxy, propanoyloxy, benzoyloxy, 2,4-dichlorobenzoyloxy, ethoxyoxaloyloxy, pyruvinyloxy, cinamoyloxy, phenoxy, 4-cyanophenoxy, 4-methanesulfonamidophenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, 2-benzthiazolyloxo), a group which is attached through a nitrogen atom (e.g., benzenesulfonamido, N-ethyltoluenesulfonamido, heptafluorobutaneamido, 2,3,4,5,6-pentafluorobenzamido, octanesulfonamido, p-cyanophenylureido, N,N-diethylsulfamoylamino, 1-piperidyl, 5,5-dimethyl-2,4-dioxo-3-oxazolidinyl, 1-benzylethoxy-3-hydantoinyl, 2N-1,1-dioxo-3(2H)-oxo-1,2-benzisothiazolyl, 2-oxo-1,2-dihydro-1-pyridinyl, imidazolyl, pyrazolyl, 3,5-diethyl-1,2,4-triazole-1-yl, 5- or 6-bromobenztriazole-1-yl, 5-methyl-1,2,3,4-triazole-1-yl, benzimidazolyl, 3-benzyl-1-hydantoinyl, 1-benzyl-5-hexadecyloxy-3-hydantoinyl, 5-methyl-1-tetrazolyl), an arylazo group (e.g., 4-methoxyphenylazo, 4-pivaloylaminophenylazo, 2-naphthylazo, 3-methyl-4-hydroxyphenylazo) or a group which is attached through a sulfur atom (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexanesulfonylethyl)-5-tert-octylphenylthio, benzylthio, 2-cyanoethylthio, 1-ethoxycarbonyltridecylthio, 5-phenyl-2,3,4,5-tetrazolylthio, 2-benzthiazolylthio, 2-dodecylthio-5-thiophenylthio, 2-phenyl-3-dodecyl-1,2,4-triazole-5-thio).

In the couplers of the formulas (I-1) and (I-2), $R_{41}$ and $R_{42}$ may be combined together to form a 5-membered to a 7-membered hydrocarbon or heterocyclic ring.

When $R_1$, $R_{41}$, $R_{42}$ or X is a bivalent group to form a bis-compound, $R_1$, $R_{41}$ or $R_{42}$ is preferably a substituted or an unsubstituted bivalent group having saturated bonding carbon atoms (e.g., a substituted or unsubstituted alkylene group, such as, methylene, ethylene, and 1,10-decylene, and $—CH_2CH_2—O—CH_2CH_2—$), a substituted or as unsubstituted phenylene group (e.g., 1,4-phenylene, 1,3-phenylene,

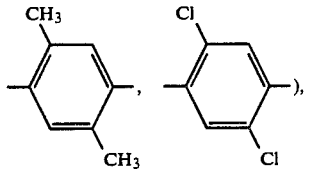

a group of —NHCO—$R_{43}$—CONH—, wherein $R_{43}$ is a substituted or an unsubstituted alkylene or phenylene group (e.g., $$—NHCOCH_2CH_2CONH—,$$

$$—NHCOCH_2\overset{\overset{CH_3}{|}}{\underset{\underset{CH_3}{|}}{C}}—CH_2CONH—,$$

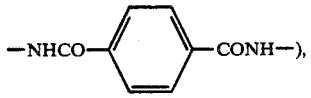

a group of —S—$R_{44}$—S, wherein $R_{44}$ is a substituted or unsubstituted bivalent group having satulated bonding carbon atoms (e.g., $—S—CH_2—CH_2—S—$, $$—S—CH_2\overset{\overset{CH_3}{|}}{\underset{\underset{CH_3}{|}}{C}}—CH_2—S—),$$

and X is a bivalent group derived from a member of the above-described monovalent groups.

When the vinyl monomer has a moiety represented by the formulae (I-1), (I-2), (I-3), (I-4, (I-5), (I-6) or (I-7), a bonding group represented by $R_1$, $R_{41}$, $R_{42}$ or X is a bivalent group having satulated bonding carbon atoms (e.g., a substituted or an unsubstituted alkylene group such as methylene, ethylene and 1,10-decylene: and $—CH_2CH_2OCH_2CH_2—$) a phenylene group (e.g., a substituted or an unsubstituted phenylene group such as 1,4-phenylene, 1,3-phenylene,

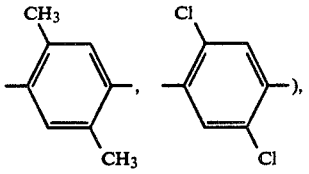

—NHCO—, —CONH—, —O—, —OCO, or an aralkylene group (e.g., $—CH_2$— 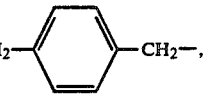 —$CH_2$—, $—CH_2CH_2$— 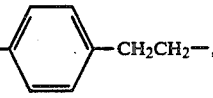 —$CH_2CH_2$—, -continued

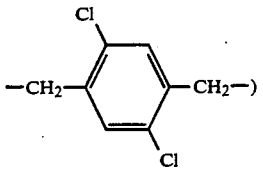

or a combination of two or more of these groups.

Preferred examples of the bonding group include

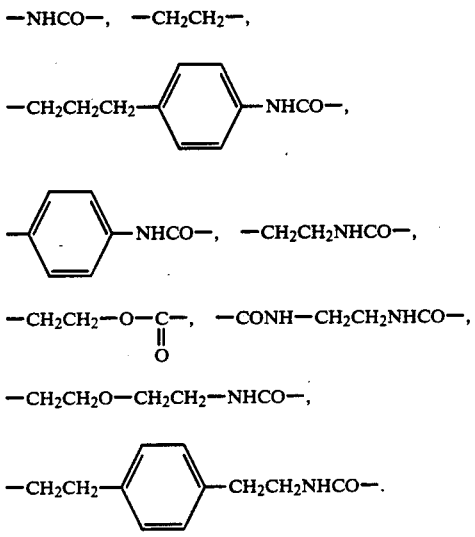

In addition to the coupler moieties of the compounds represented by formulas (I-1), (I-2), (I-3), (I-4), (I-5), (I-6) and (I-7), the vinyl group may have another substituent group or groups. Preferred examples of such substituent groups include a chlorine atom or a lower alkyl group having from 1 to 4 carbon atoms (e.g., methyl, ethyl).

Monomers having a coupler moiety of the compound of the formulae (I-1), (I-2), (I-3), (I-4), (I-5), (I-6) or (I-7) may be copolymerized with non-color forming ethylenic monomers which are not coupled with the oxidation products of aromatic primary amine developing agents to prepare copolymers.

Examples of non-color forming ethylenic monomers which are not coupled with the oxidation products of aromatic primary amine developing agents include acrylic acid, α-chloroacrylic acid, α-alkylacrylic acids (e.g., methacrylic acid) and esters and amides derived from these acrylic acids (e.g., acrylamide, n-butylacrylamide, t-butylacrylamide, diacetone acrylamide, methacrylamide, methyl methacrylate, ethyl acrylate, n-propyl acrylate, n-butyl acrylate, t-butyl acrylate, iso-butyl acrylate, 2-ethylhexyl acrylate, n-octylacrylate, lauryl acrylate, methyl methacrylate, ethyl methacrylate, n-butyl methacrylate and β-hydroxymethacrylate), methylene bisacrylamide, vinyl esters (e.g., vinyl acetate, vinyl propionate and vinyl laurate), acrylonitrile, methacrylonitrile, aromatic vinyl compounds (e.g., styrene and derivatives thereof, vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic acid, maleic anhydride, maleic esters, N-vinyl-2-pyrrolidone, N-vinylpyridine and 2- and 4-vinylpyridine. These non-color forming ethylenically unsaturated monomers may be used either alone or as a mixture of two or morem. For example, a combination of n-butyl acrylate and methyl acrylate, a combination of styrene and methacrylic acid, a combination of methacrylic acid and acrylamide and a combination of methyl acrylate and diacetone acrylamide can be used.

The non-color forming ethylenically unsaturated monomers to be copolymerized with the solid water-insoluble monomer couplers can be chosen so that the physical properties and/or chemical properties of the resulting copolymers are favorably affected, for example, favorable solubility, compatibility with a binder such as gelatin in photographic colloid compositions, flexibility, thermal stability, etc. can be obtained as known in the field of polymer color couplers.

Polymer coupler latexes are particularly preferred as the polymer couplers to be used in the present invention.

In the definitions of substituents in the present invention, bivalent and trivalent groups are those which are bonded with an aliphatic group or an aromatic group. The acyloxy group, the acylamino group and the acyl group may have an aliphatic group or an aromatic group. In the present invention an aliphatic group includes an alkyl group, an alkenyl group, an alkinyl group, an aralkyl group, a cycloalkyl group, and a cycloalkenyl group, and an aromatic group includes an aryl group. Additionally, a heterocyclic group includes 5- to 7-membered heterocyclic group containing at least one of N, S and O atoms as hetero atoms. These groups may be substituted.

Concrete Specific examples of pyrazoloazole magenta couplers of the formula (I) which are used in the present invention and methods for preparing the same are described in JP-A-59-162548, JP-A-60-43659, JP-A-59-171956, JP-A-60-33552, JP-A-60-172982 and U.S. Pat. No. 3,061,432.

Typical examples of magenta couplers which are used in the present invention include, but are not limited to, the following compounds. (In the present invention an alkyl group having not any indication of (n), (t) or (iso) means a normal alkyl group.)

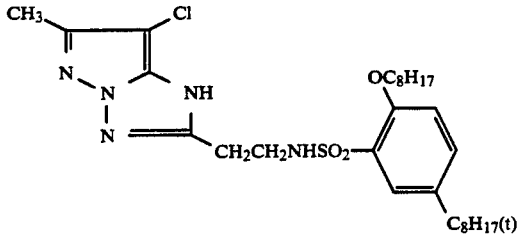

M-1

-continued
M-2
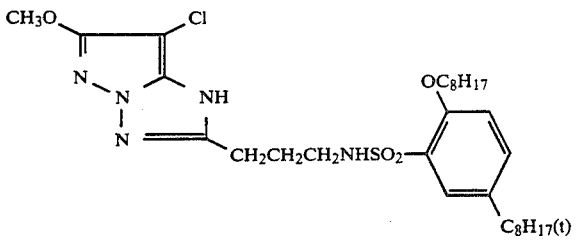
M-3
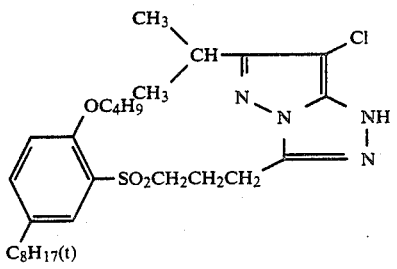
M-4
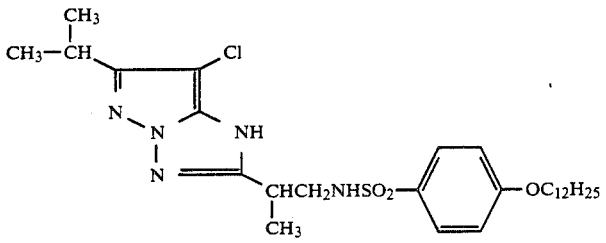
M-5
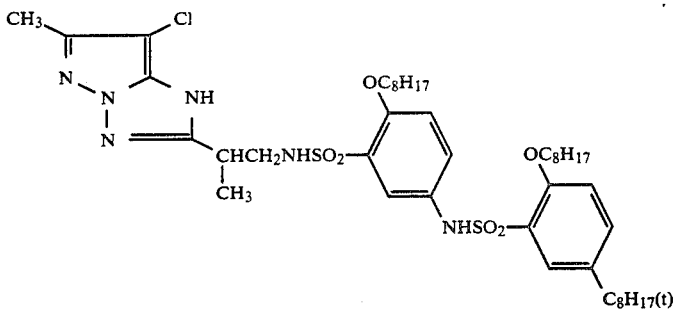
M-6
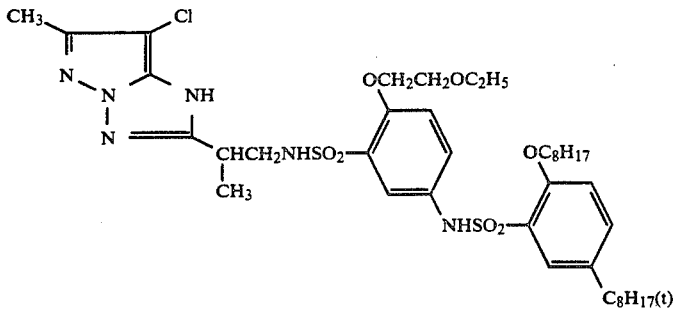

-continued
M-7
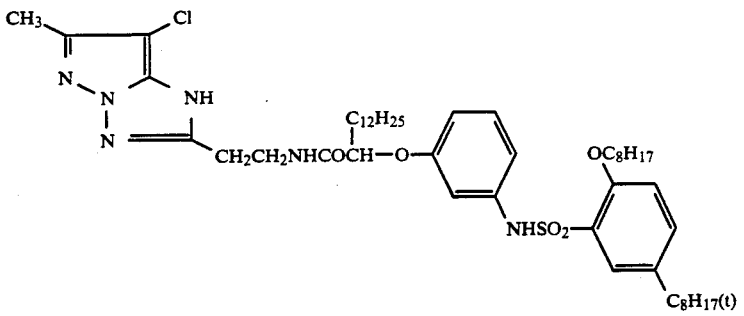
M-8
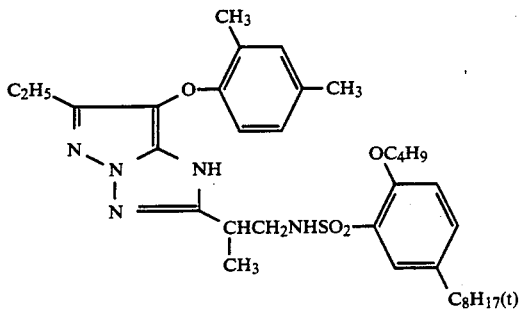
M-9
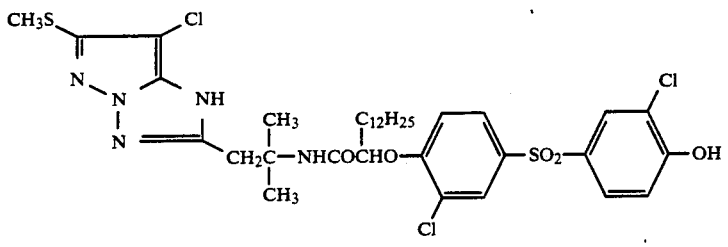
M-10
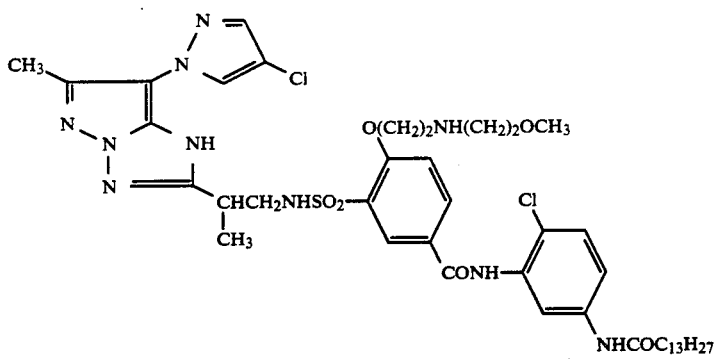
M-11
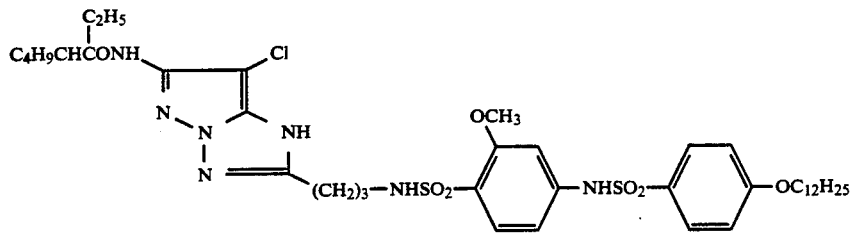

-continued
M-12
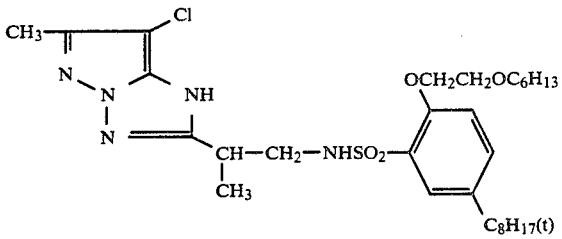
M-13
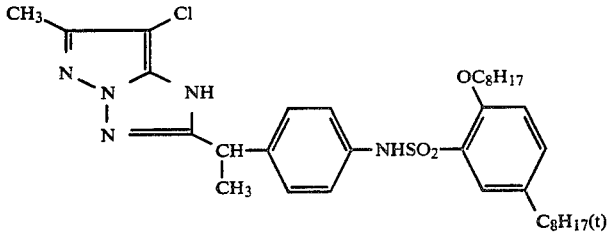
M-14
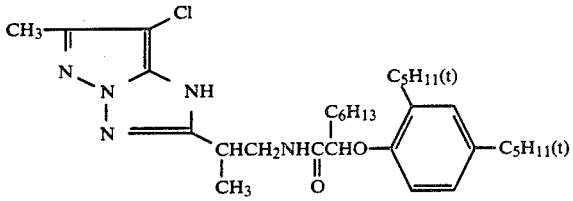
M-15
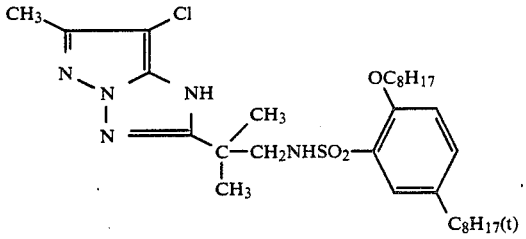
M-16
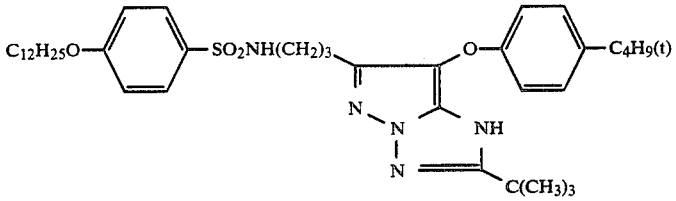
M-17
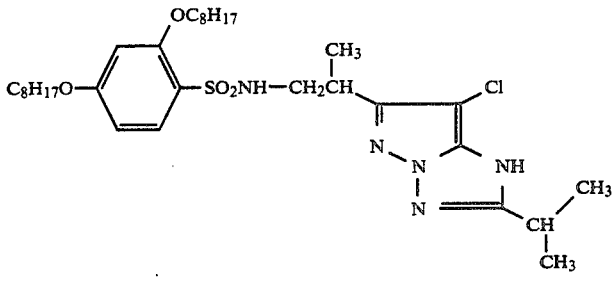
M-18
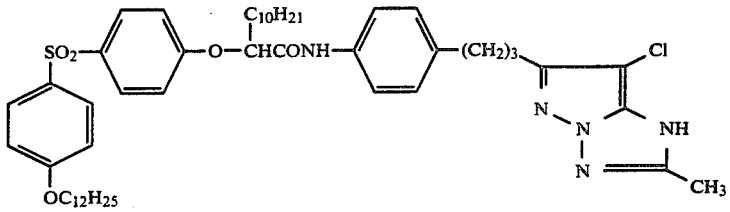

-continued
M-19
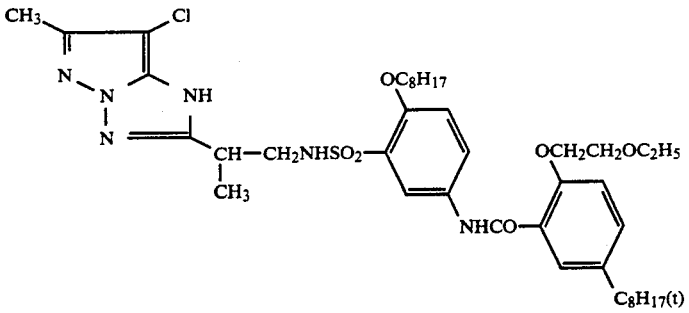
M-20
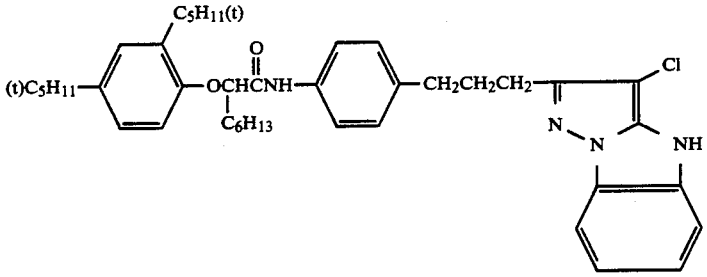
M-21
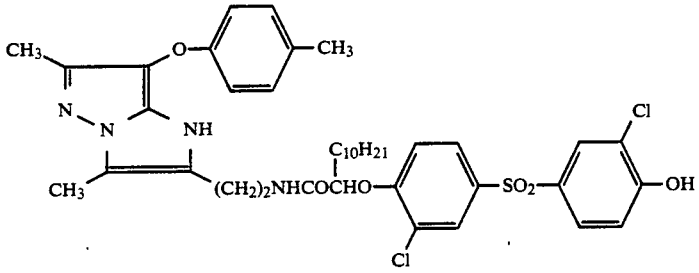
M-22
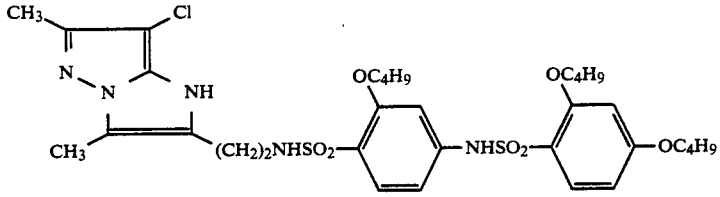
M-23
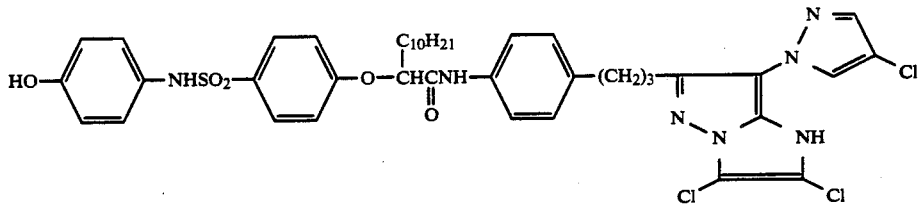
M-24
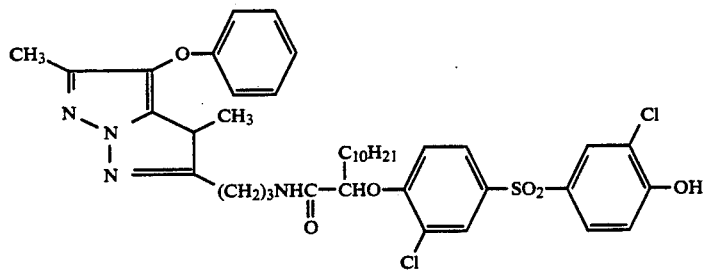

-continued
M-25
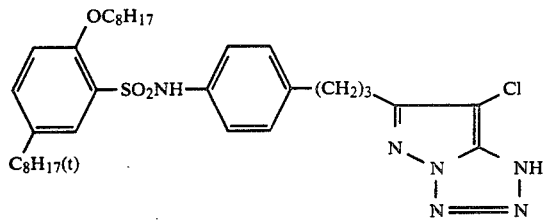
M-26
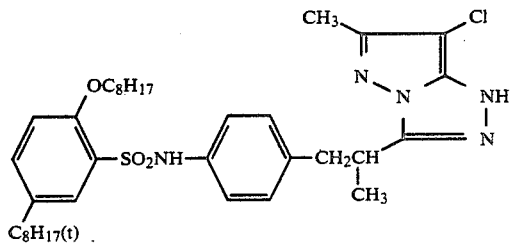
M-27
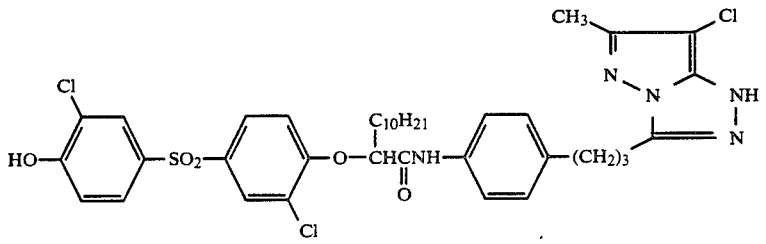
M-28
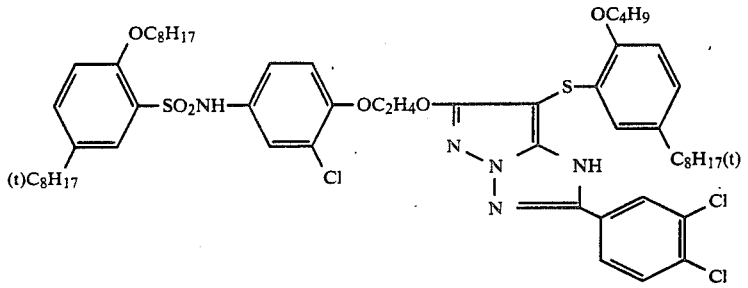
M-29
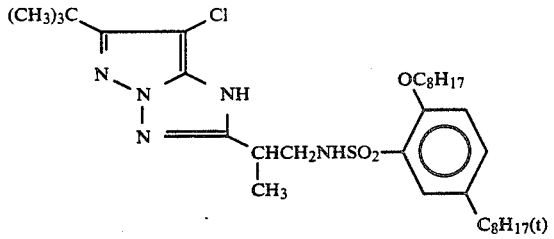
M-30
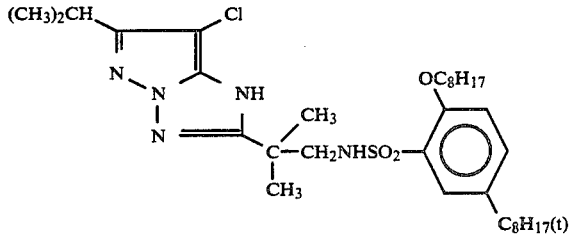

-continued
M-31
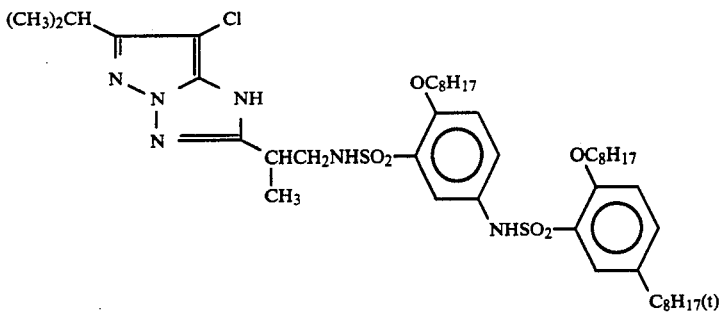
M-32
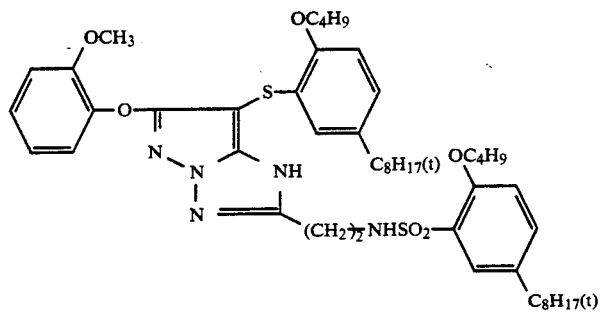
M-33
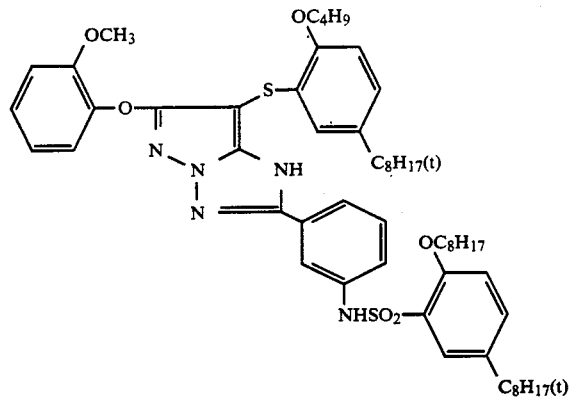
M-34
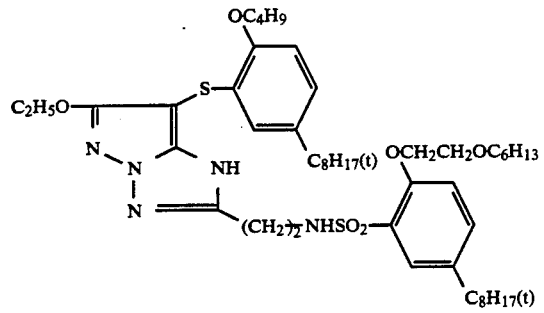

-continued
M-35
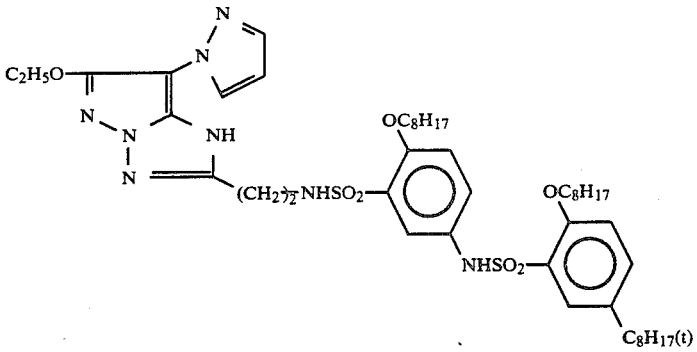
M-36
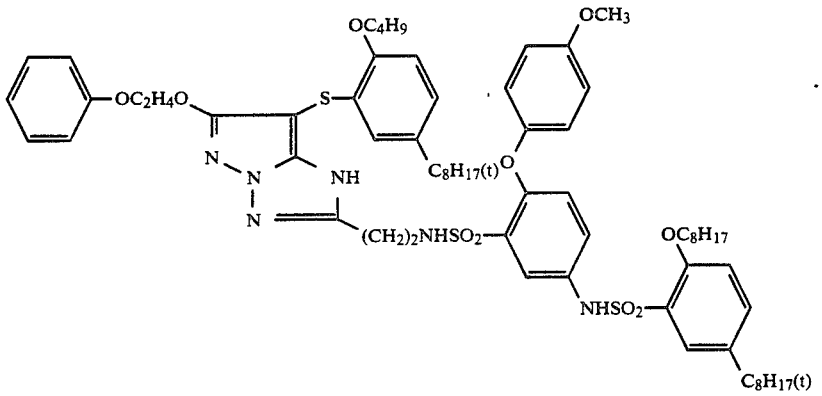
M-37
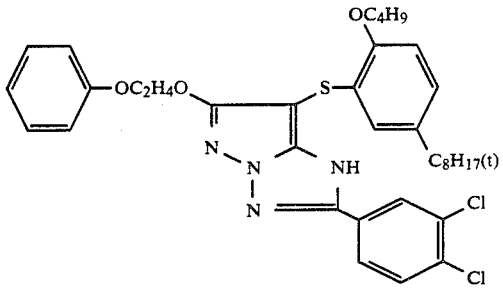
M-38
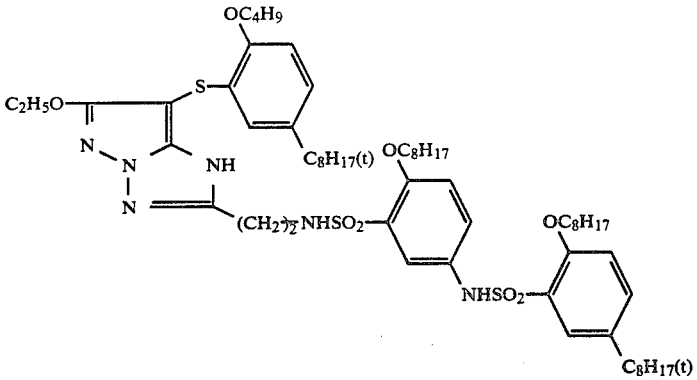
M-39
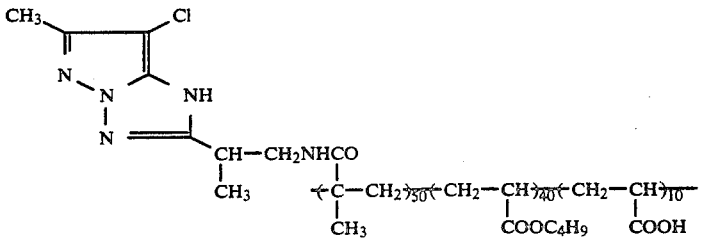

-continued

M-40

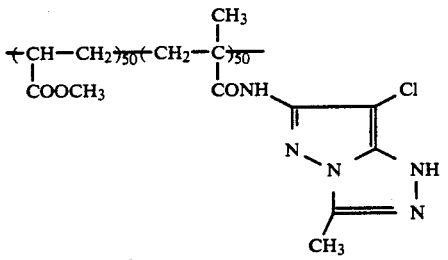

(Suffixes of parentheses show a mole percent)

M-41

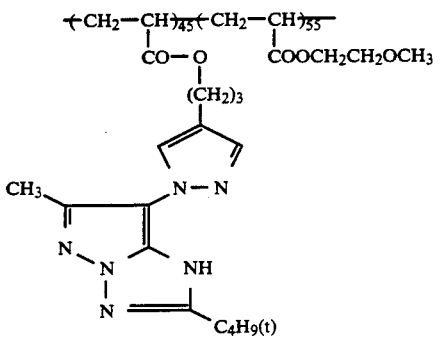

The couplers of formula (I) according to the present invention are used in an amount of $1\times10^{-3}$ to 1 mol, preferably $5\times10^{-2}$ to $5\times10^{-1}$ mol per mol of silver halide in the same emulsion layer. If desired, two or more couplers of the present invention may be added to the same emulsion layer.

The compounds represented by formula (II) will be illustrated in more detail below.

In formula (II), Ar is an aryl group (e.g., phenyl, naphthyl, 4-methoxyphenyl, 4-dodecyloxyphenyl, 4-chlorophenyl) or a heterocyclic group (e.g., 4-pyridyl, 2-pyridyl); Y is a hydrogen atom or a substituent group. Examples of the substituent group include a halogen atom, an alkyl group, an aryl group, a heterocyclic group, a cyano group, an alkoxy group, an aryloxy group, a heterocyclic oxy group, an acyloxy group, a carbamoyloxy group, a hydroxyl group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group and a phospholyl group. $R_3$, $R_4$, $R_5$ and $R_6$ may be the same or different groups and each is an alkyl group (e.g., methyl, ethyl, propyl, octyl). A has at least two carobn atoms and is a non-metallic atomic group required for the formation of a 6-membered ring, and examples of A include

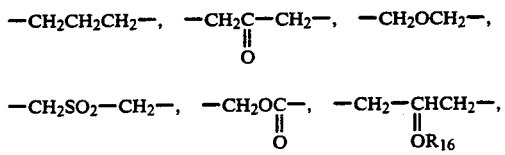

-continued

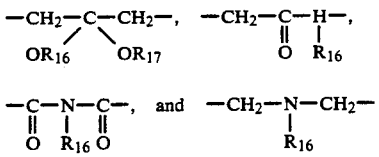

wherein $R_{16}$ and $R_{17}$ may be the same or different groups and each is a hydrogen atom, an alkyl group, an acyl group, a sulfonyl group, a sulfinyl group, a carbamoyl group, a heterocyclic group, an acylamino group, and sulfonamido group, or an alkoxycarbonyl group. $R_{16}$ and $R_{17}$ may be combined to form a 5- or 6-membered ring. $R_3$ and $R_4$, $R_5$ and $R_6$, Y and Ar, Ar and $R_3$, Y and $R_3$, $R_3$ and A, or $R_3$ and Y, may be combined together to form a 5-membered or a 6-membered ring (e.g., cyclopentyl, cyclohexyl, cyclohexenyl, pyranyl, piperazine, piperidine, morpholine).

The compounds represented by formula (II) may form a dimer or a higher polymer at any position on the compounds capable of chemically bonding.

The compounds where A is an aryl group are preferred from the viewpoint of the desired effect. Preferred compounds include those where Y is a hydrogen atom, an alkyl group, an aryl group, a cyano group, an alkoxy group, an aryloxy group, an alkoxycarbonyl group, an aryloxycarbonyl group, a carbamoyl group, an acyl group or an acyloxy group. Compounds where Y is a hydrogen atom, an alkyl group or an acyl group are more preferred. Compounds where Y is hydrogen atom or an alkyl group are particularly preferred. The compounds where $R_3$, $R_4$, $R_5$ and $R_6$ are each methyl are also particularly preferred. Among the atomic groups represented by A, a non-metallic atomic group required for the formation of a piperidine ring is particularly preferred.

The molecular weights of the compounds represented by formula (II) are preferably at least 300 for obtaining the effects of the present invention.

When the compounds have a phenolic hydroxyl group and are used in combination with the compounds of the formulae (III) and (IV), the effects obtained by the present invention are inferior.

Examples of the compounds of formula (II) include, but are not limited to, the following compounds:

II-1

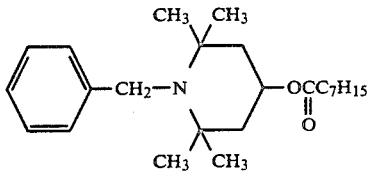

II-2

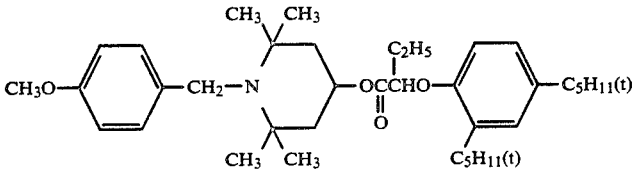

II-3

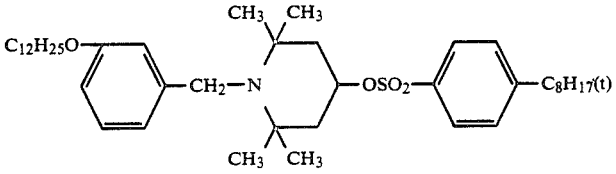

II-4

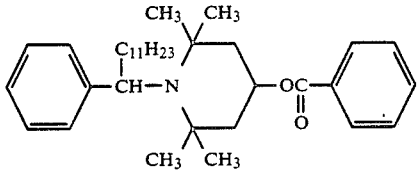

II-5

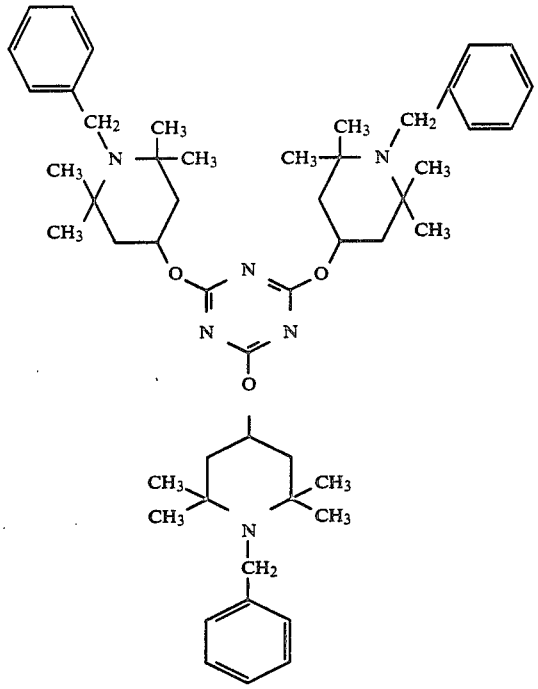

-continued
II-6
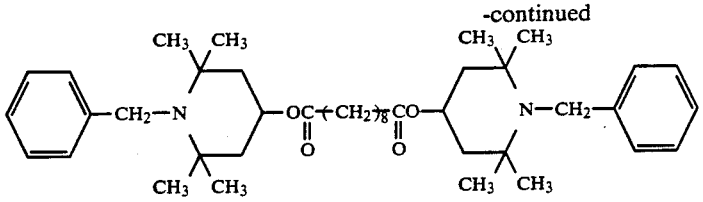
II-7
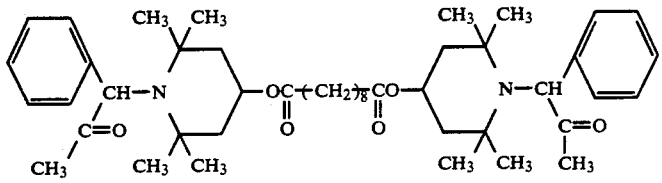
II-8
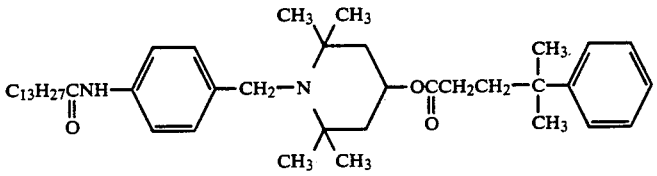
II-9
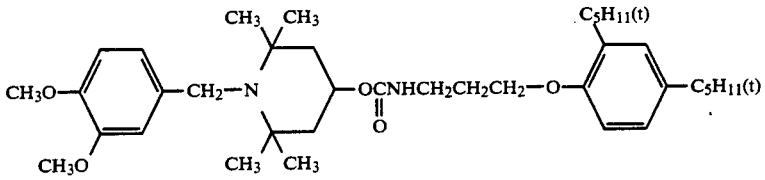
II-10
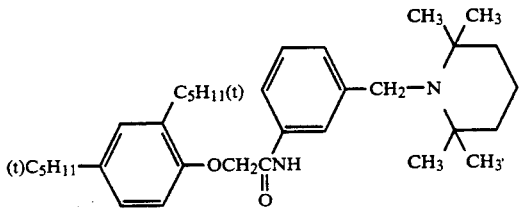
II-11
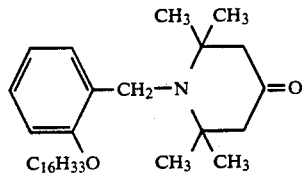
II-12
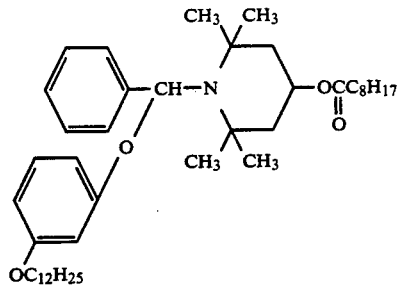
II-13
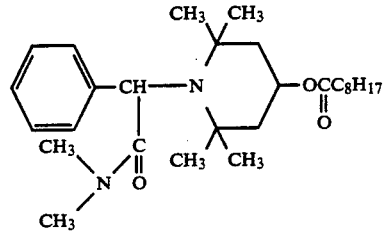

-continued
II-14
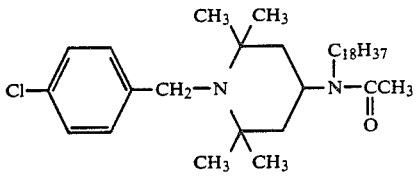
II-15
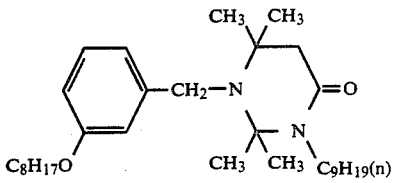
II-16
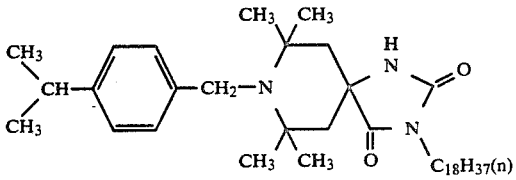
II-17
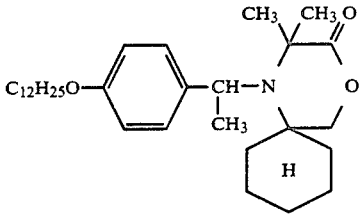
II-18
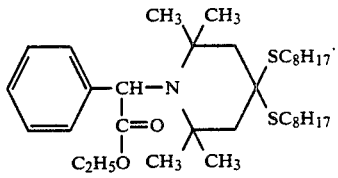
II-19
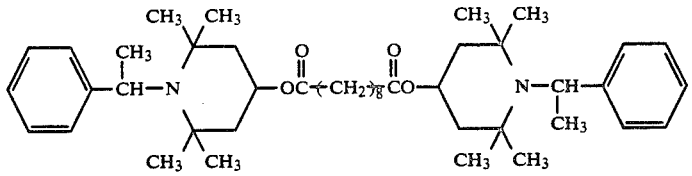
II-20
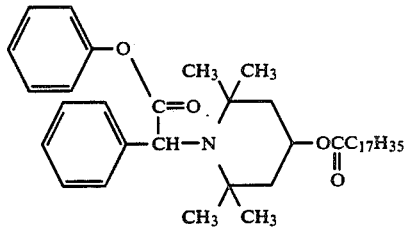
II-21
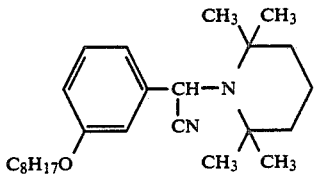

-continued
II-22
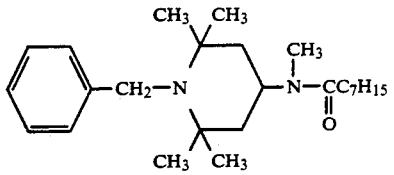
II-23
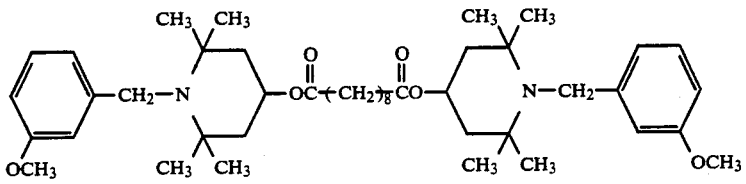
II-24
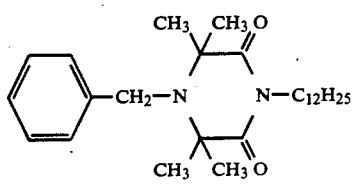
II-25
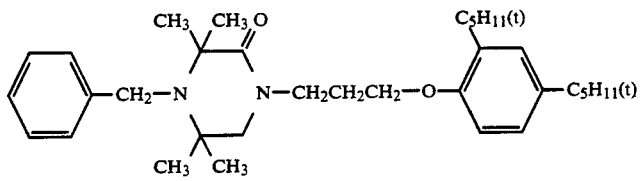
II-26
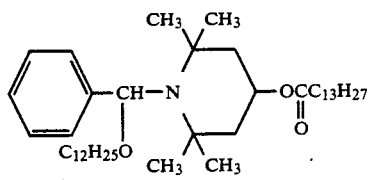
II-27
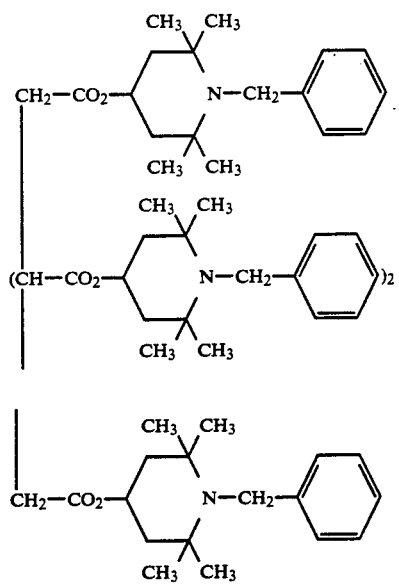
II-28
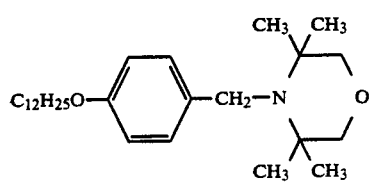

-continued
II-29
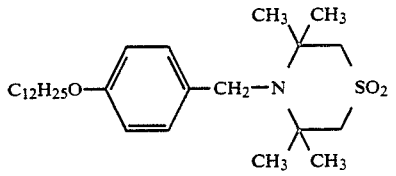
II-30
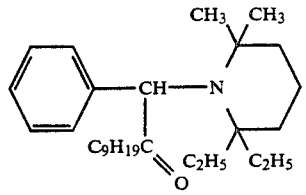
II-31
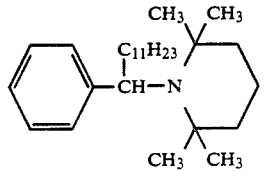
II-32
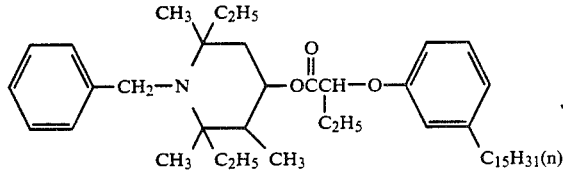
II-33
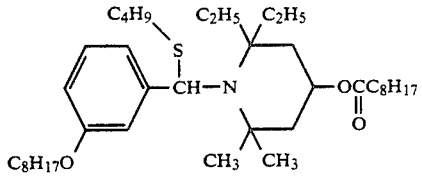
II-34
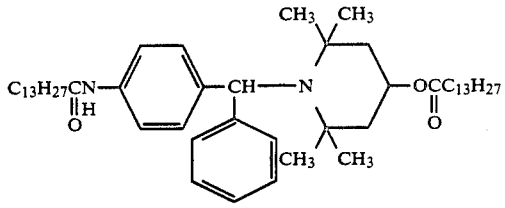
II-35
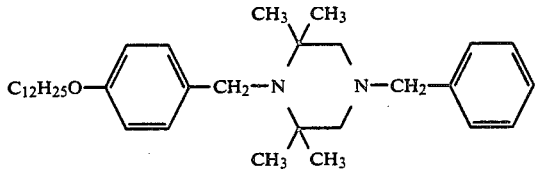
II-36
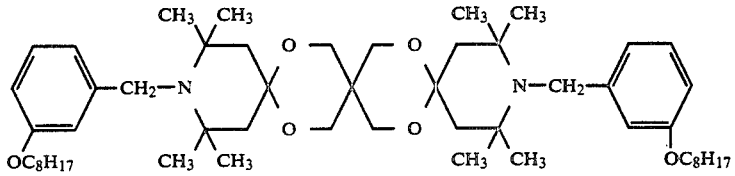

-continued

II-37

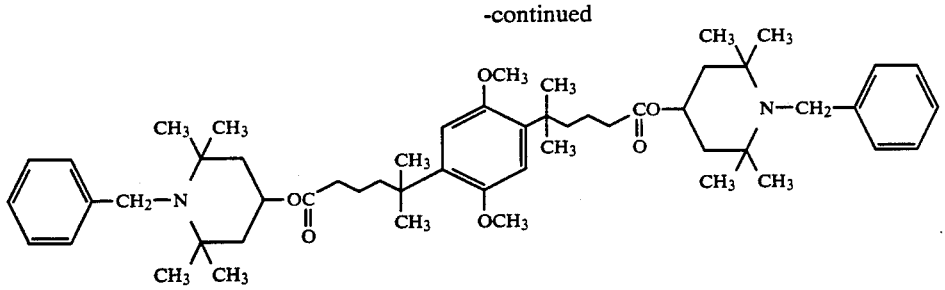

II-38

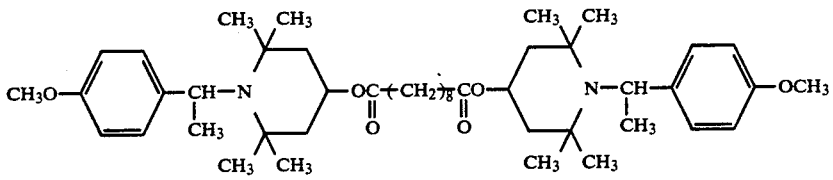

II-39

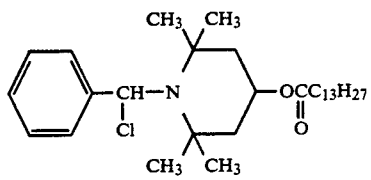

II-40

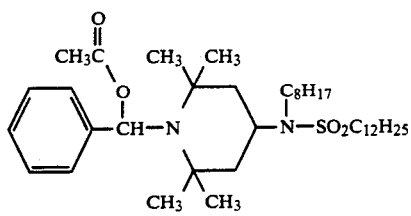

II-41

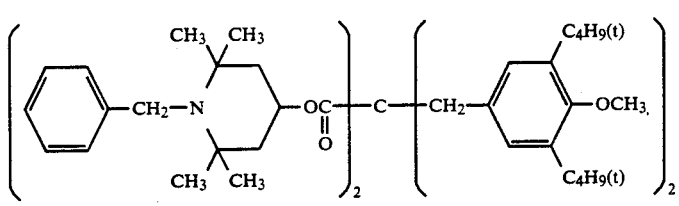

II-42

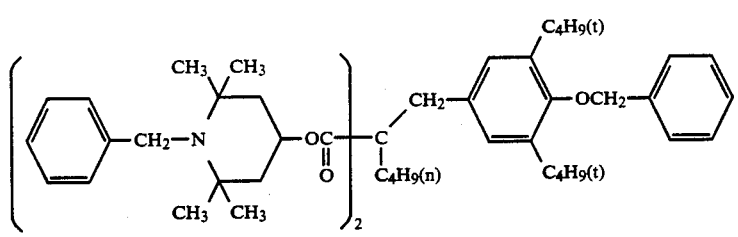

II-43

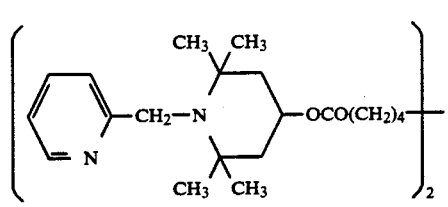

These compounds can be synthesized according to the methods described in *Synthesis* (1984, page 894; 1984, page 122; 1981, page 40), *J. Chem. Soc., Sec. (C)*, page 1653 (1971), JP-A-49-53574, JP-A-49-7180, JP-A-49-53575, JP-A-49-53571 and U.K. Patent 1,410,846 and like methods.

The amounts of the compounds of formula (II) to be used vary depending on the couplers, but are generally 1 to 300 mol %, preferably 3 to 100 mol % and more preferably 4 to 50 mol % based on the amount of the coupler.

The compounds of formula (III) will be illustrated in more detail below.

In formula (III), $R_7$ is an alkyl group (e.g., methyl, n-butyl, n-octyl, n-hexadecyl, ethoxyethyl, 3-phenoxypropyl, benzyl), an alkenyl group (e.g., vinyl, allyl), an aryl group (e.g., phenyl, naphthyl), a heterocyclic group (e.g., pyridyl, tetrahydropyranyl) or a group of

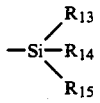

wherein $R_{13}$, $R_{14}$ and $R_{15}$ may be the same or different groups and each is an alkyl group, an alkenyl group, an aryl group, an alkoxy group, an alkenoxy group or an aryloxy group (e.g., trimethylsilyl, t-butyldimethylsilyl); and $R_8$, $R_9$, $R_{10}$, $R_{11}$ and $R_{12}$ may be the same or different groups and each is a hydrogen atom, an alkyl group (e.g., methyl, n-butyl, n-octyl, sec-dodecyl, t-butyl, t-amyl, t-hexyl, t-octyl, t-octadecyl, $\alpha,\alpha$-di-methylbenzyl, 1,1-dimethyl-4-hexyloxycarbonylbutyl), an alkenyl group (e.g., vinyl, allyl), an aryl group (e.g., phenyl, naphthyl, p-methoxyphenyl, 2,4-t-butylphenyl), an acylamino group (e.g., acetylamino, propionylamino, benzamino), an alkylamino group (e.g., N-methylamino, N,N-dimethylamino, N,N-dihexylamino, piperidino, N-cyclohexylamino, N-(t-butyl)amino), an alkylthio group (e.g., methylthio, n-butylthio, sec-butylthio, t-butylthio, dodecylthio), an arylthio group (e.g., phenylthio, naphthylthio), a halogen atom (e.g., chlorine, bromine), a nitrogen atom—containing heterocyclic ring bonding through the N-atom (e.g., N-morpholino, piperidino), or a group of —O— $R_7'$ (wherein $R_7'$ has the same meaning as R). $R_7$ and $R_8$ may be combined together to form a 5-membered or a 6-membered ring or a spiro ring. $R_8$ and $R_9$, or $R_9$ and $R_{10}$, may be combined together to form a 5-membered or a 6-membered ring or a spiro ring. Examples of rings include a chroman ring, a coumaran ring, a spiro-chroman ring and a spiro-indane ring.

Among the compounds of formula (III), the compounds where $R_8$ to $R_{12}$ are attached to the benzene ring through a hetero-atom (e.g., oxygen atom, sulfur atom, nitrogen atom) are preferred from the viewpoint of the desired effect of the present invention.

The compounds represented by formula (III) may form a dimer or a higher polymer at any position on the compounds capable of chemically bonding.

Among the compounds of formula (III), the compounds represented by the following general formulas [III-1] to [III-7] are preferred from the viewpoint of the desired effect of the present invention.

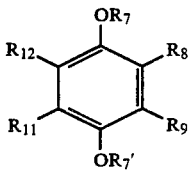

(III-1)

-continued

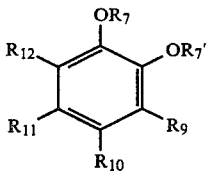

(III-2)

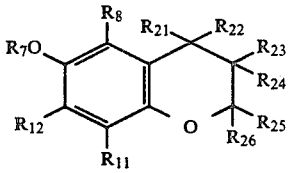

(III-3)

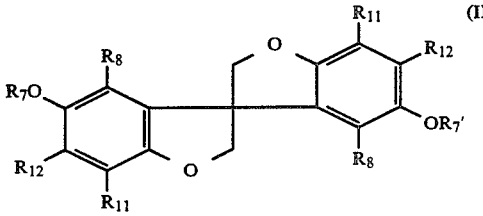

(III-4)

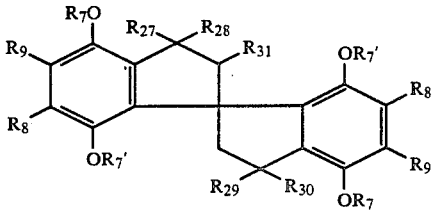

(III-5)

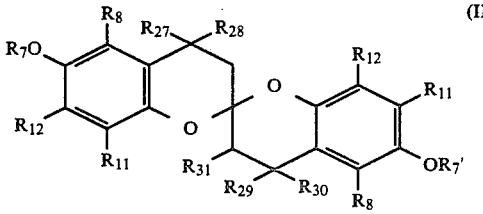

(III-6)

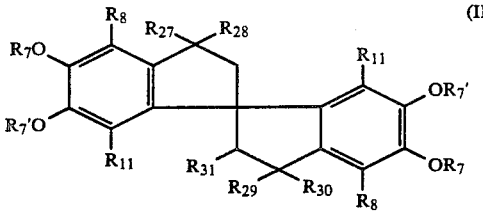

(III-7)

In formulae (III-1) to (III-7), $R_7$, $R_7'$, $R_8$, $R_9$, $R_{10}$, $R_{11}$ and $R_{12}$ are the same as those set forth in formula (III); and $R_{21}$ to $R_{31}$ may be the same or different groups and each is a hydrogen atom, an alkyl group (e.g., methyl, ethyl, isopropyl, dodecyl) or an aryl group (e.g., phenyl, p-methoxyphenyl). $R_{24}$ and $R_{25}$, or $R_{25}$ and $R_{26}$ may be combined to form a 5- or 6-membered hydrocarbon ring.

Among the compounds represented by formulae (III-1) to (III-7), the compounds where $R_7$ and $R_7'$ are each an alkyl group or an aryl group are preferred, and the compounds where $R_7$ and $R_7'$ are each an alkyl group are most preferred. Further, the compounds where $R_8$ to $R_{12}$ are each a hydrogen atom, an alkyl group or an aryl group are also preferred.

Among the compounds represented by formulae (III-1) to (III-7), the compounds represented by formulae (III-1), (III-5), (III-6) and (III-7) are more preferred, and the compounds of formula (III-7) are most preferred.

The molecular weights of the compounds represented by formula (III) are preferably at least 200, more preferably at least 300 for obtaining effects of the present invention.

Examples of the compounds of formula (III) include, but are not limited to, the following compounds:

A-1

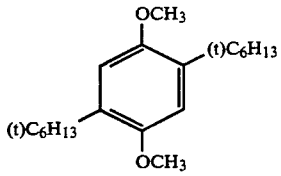

A-2

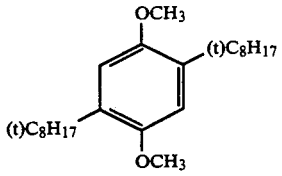

A-3

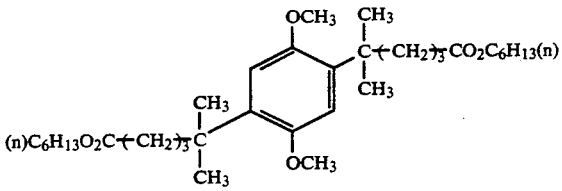

A-4

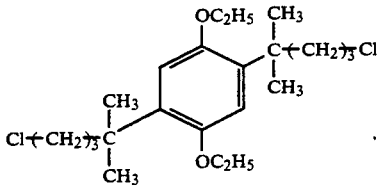

A-5

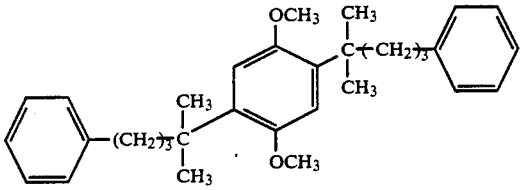

A-6

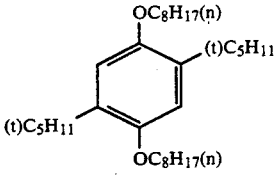

A-7

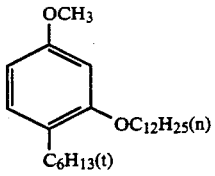

A-8

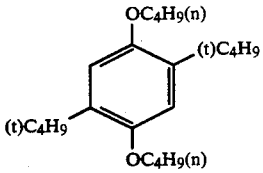

A-9

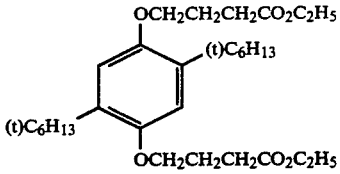

A-10

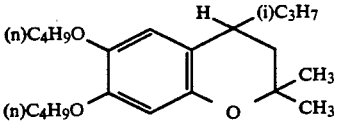

A-11

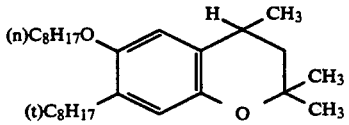

A-12

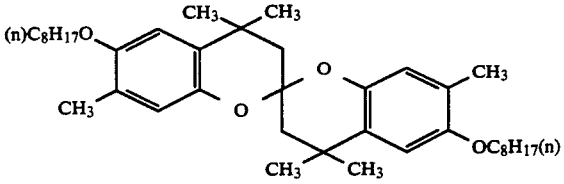

-continued
A-13
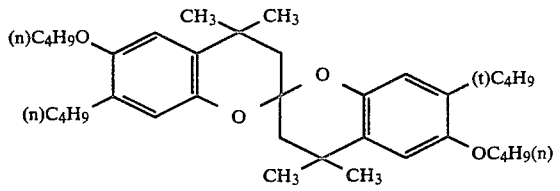
A-14
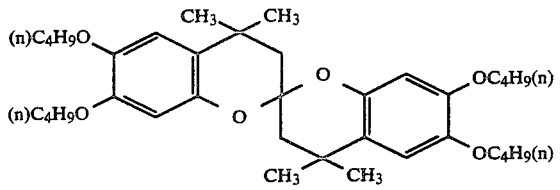
A-15
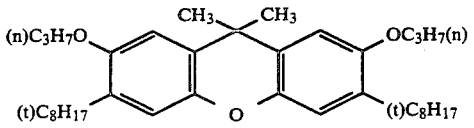
A-16
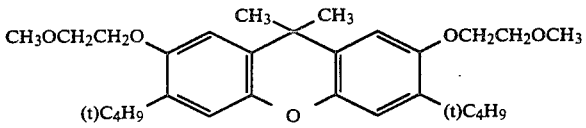
A-17
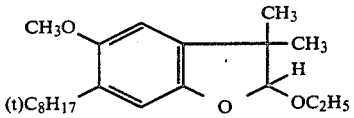
A-18
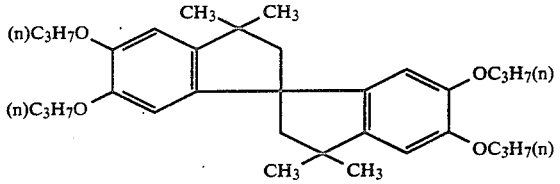
A-19
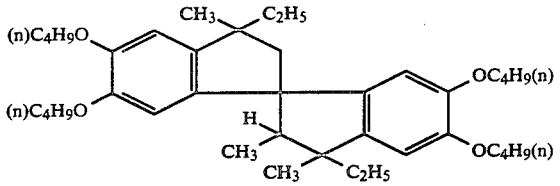
A-20
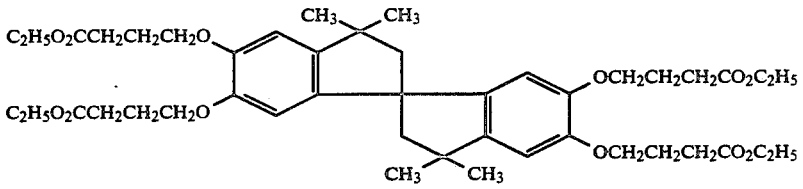
A-21
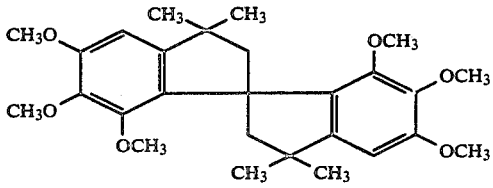

-continued
A-22
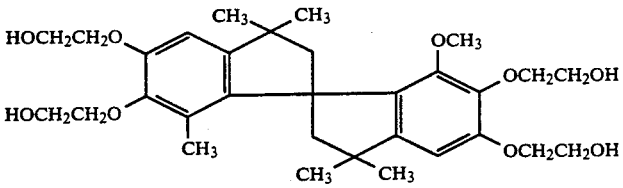
A-23
A-24
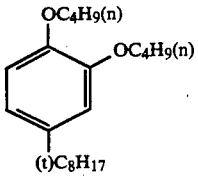
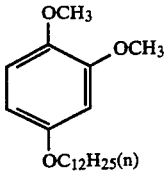
A-25
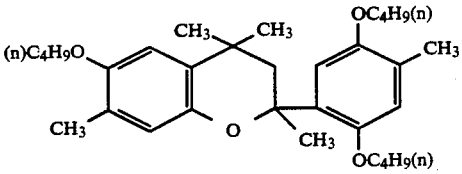
A-26
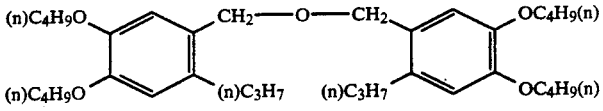
A-27
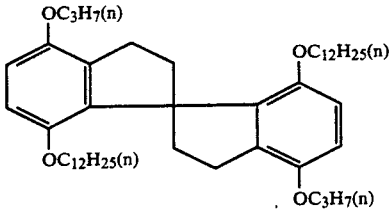
A-28
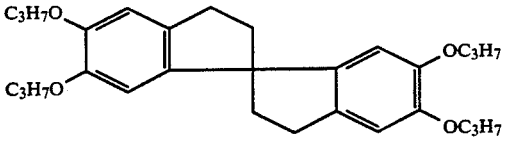
A-29
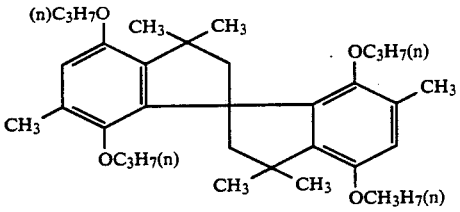
A-30
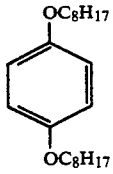
A-31
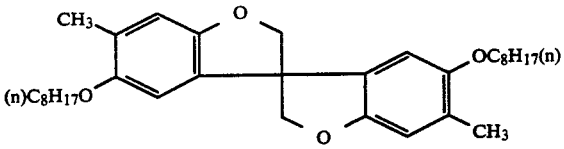
A-32
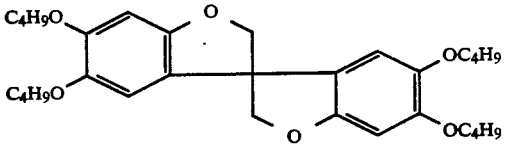
A-33
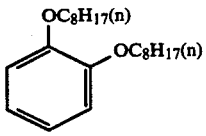
A-34
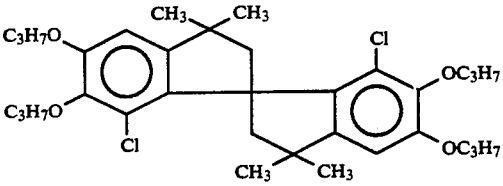

-continued

A-35

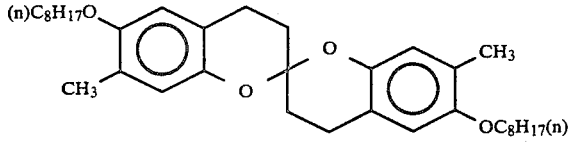

A-36

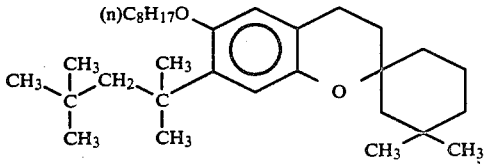

A-37

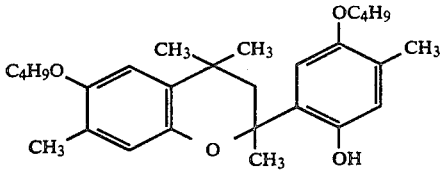

A-38

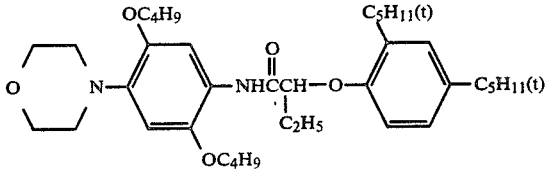

A-39

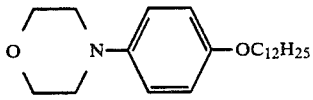

A-40

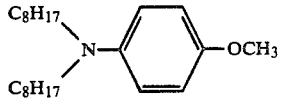

A-41

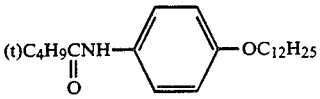

A-42

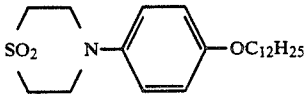

A-44

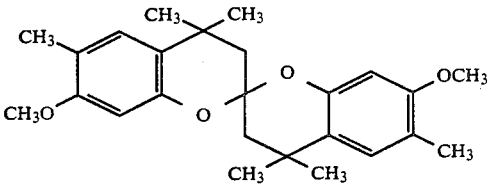

A-45

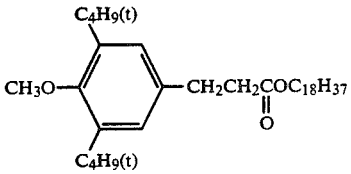

These compounds can be synthesized according to the methods described in JP-B-45-14034, JP-B-56-24257, JP-B-59-52421, JP-A-55-89835, JP-A-56-159644, JP-A-62-244045, JP-A-62-244046, JP-A-62-273531, JP-A-63-220142, JP-A-63-95439, JP-A-63-95448, JP-A-63-95450 and European Patent 0,239,972 and like methods.

Compounds of formula (III) are used in an amount of 10 to 400 mol %, preferably 10 to 150 mol % based on the amount of the coupler.

The compounds of formula (IV) will be illustrated in more detail below.

In formula (IV), $W_1$, $W_2$ and $W_3$ are each a substituted or an unsubstituted alkyl group (e.g., methyl, ethyl, propyl, butyl, hexyl, octyl, nonyl, decyl, dodecyl, tetradecyl, 2-ethylhexyl), a substituted or an nsubstituted cycloalkyl group (e.g.,

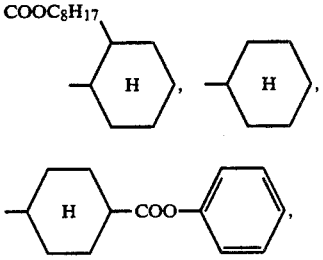

-continued

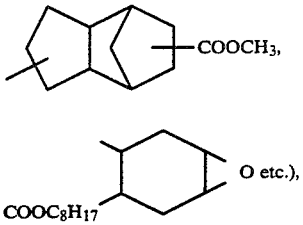

a substituted or an unsubstituted alkenyl group (e.g., $-C_4H_7$, $-C_5H_9$, $-C_6H_{11}$, $-C_7H_{13}$, $-C_8H_{15}$, $-C_{10}H_{19}$, $-C_{12}H_{23}$), a substituted or an unsubstituted aryl group (e.g., phenyl, naphthyl, p-methylphenyl, p-chlorophenyl, o-methylphenyl) or a substituted or an unsubstituted heterocyclic group (e.g., pyridyl, pyranyl). The sum total of carbon atoms of $W_1$, $W_2$ and $W_3$ is not less than 8, preferably 12 to 60 from the standpoint of the solubility of the fading inhibitors and the couplers, etc. and from the standpoint of the desired effect of present invention. The compounds where $W_1$, $W_2$ and $W_3$ are each an alkyl group or an aryl group are also preferred. The term "high-boiling organic solvent" as used herein refers to organic solvents having a boiling point of not lower than 175° C. under atmospheric pressure.

Examples of the high-boiling organic solvents of formula (IV) include, but are not limited to, the following compounds:

$O{=}P(OC_4H_9)_3$ (P-1)

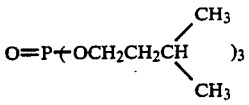
(P-2)

$O{=}P(OC_6H_{13})_3$ (P-3)

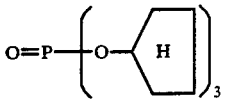
(P-4)

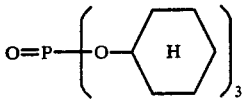
(P-5)

$O{=}P(OC_8H_{17})_3$ (P-6)

$O{=}P(OCH_2CH(C_2H_5)C_4H_9)_3$ (P-7)

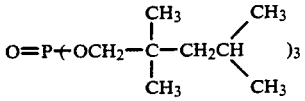
(P-8)

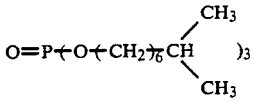
(P-9)

$O{=}P(OC_9H_{19})_3$ (P-10)

$O{=}P(OCH(CH_3)(CH_2)_6CH_3)_3$ (P-11)

$O{=}P(OC_{10}H_{21})_3$ (P-12)

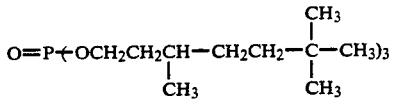
(P-13)

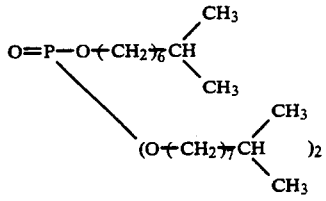
(P-14)

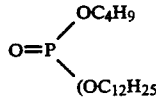
(P-15)

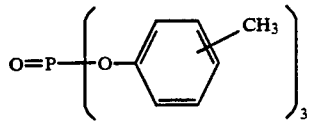
(P-16)

-continued

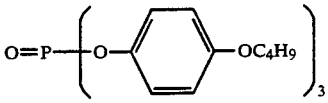
(P-17)

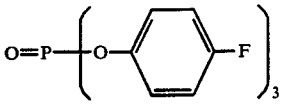
(P-18)

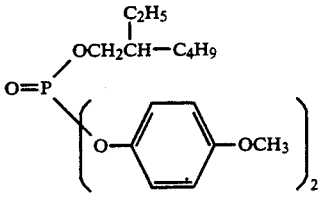
(P-19)

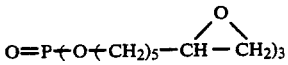
(P-20)

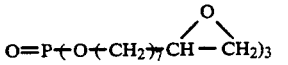
(P-21)

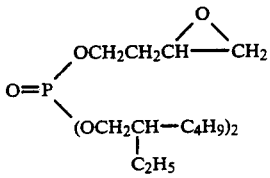
(P-22)

$O{=}P(OCH(C_4H_9)C_6H_{13})_3$ (P-23)

$O{=}P(O{-}CH{=}CH{-}C_{16}H_{33})_3$ (P-24)

The amounts of the high-boiling organic solvents of formula (IV) to be used vary depending upon the types and amounts of the magenta couplers of formula (I), but they are used in an amount such that the weight ratio of the high-boiling organic solvent of formula (IV)/the coupler of formula (I) is 0.05 to 20. The high-boiling organic solvents of formula (IV) may be used either alone or in combination of two or more. The high-boiling organic solvents of formula (IV) may be used together with other high-boiling organic solvents in amounts within which the objects of the present invention can be achieved, generally in an amount up to 50 weight % based on the total weight of the solvents.

It has been found that when the high-boiling organic solvents of formula (IV) are used, the foot cutting on the side of the long wave is good, a good color reproducibility can be obtained and at the same time, the fastness of the formed dye to light can be improved.

The color photographic material formed by allowing the coupler of formula (I) and the compounds of formulae (II) and (III) to coexist with the high-boiling organic solvent of formula (IV) according to the present invention, is excellent in color reproducibility and has an unexpectedly improved effect with respect to fastness to light, and the objects of the present invention could be achieved.

The compounds of formulae (I), (II) and (III) may be separately dissolved in the high-boiling organic solvent of formula (IV). Alternatively, either two or all of them may be dissolved together in the solvent. The resulting solutions are emulsified and dispersed in a hydrophilic colloid and the resulting emulsion is coated. It is preferred from the viewpoint of the present invention that the compounds of formulae (I), (II) and (III) are dissolved together in the high-boiling organic solvent of formula (IV) so as to allow them to exist in the same oil droplet.

Dye image stabilizers which are preferably used together with the compounds of the present invention are compounds represented by the following general formulae (V) and (VI):

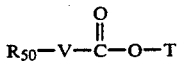

(V)

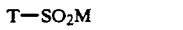

(VI)

In formulae (V) and (VI), $R_{50}$ is an alkyl group, an alkenyl group, an aryl group or a heterocyclic group; V is —O— or a single bond; T is an aryl group or a heterocyclic group; and M is a hydrogen atom, an alkali metal atom (e.g., Li, Na, K), $NH_4$, an alkaline earth metal atom (e.g., Ca. Mg) or an organic residue (e.g., alkyl ammonium, such as, tetraethyl ammonium).

The compounds of formulae (V) and (VI) will be illustrated in more detail below.

In formulae (V) and (VI), $R_{50}$ is an alkyl group (e.g., methyl, ethyl, 2-ethylhexyl, hexadecyl, 2,4-di-t-phenoxyethyl), an alkenyl group (e.g., vinyl, allyl), an aryl group (e.g., phenyl, p-methoxyphenyl) or a heterocyclic group (e.g., 3-pyridyl, 4-pyridyl) with an alkyl group being preferred. T is an aryl group (e.g., phenyl, 2,6-dichlorophenyl, 2,6-dichloro-4-ethoxycarbonylphenyl, 3,5-di-2-ethylhexylcarbamoylphenyl) or a heterocyclic group (e.g., 2-pyridyl, 3-(1-phenyl-2-pyrazolyl), 3-(1-phenyl-4-dimethyl-pyrazolyl) with an aryl group being preferred. M is a hydrogen atom or an atomic group required for the formation of an inorganic salt (e.g., lithium salt, sodium salt, potassium salt) or an organic salt (e.g., tetrethylamine salt, ammonium salt) with an inorganic salt being preferred.

Compounds represented by formulae (V) or (VI) are preferably incorporated into the same layer as the layer containing compounds represented by formulae (I) to (IV), although they can also be incorporated into other layers.

Typical examples of these compounds include, but are not limited to, the following compounds:

(V-1)

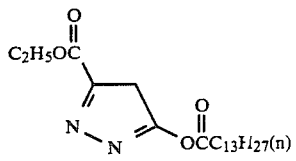

(V-2)

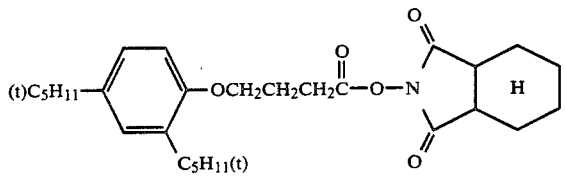

(V-3)

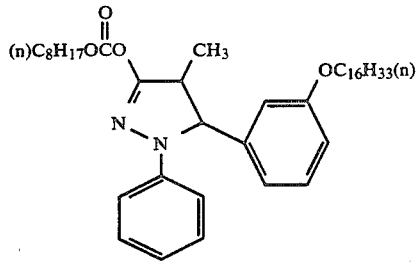

(V-4)

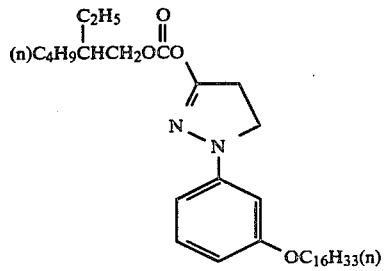

-continued
(V-5)
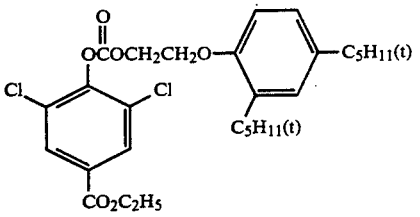
(V-6)
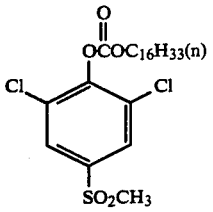
(V-7)
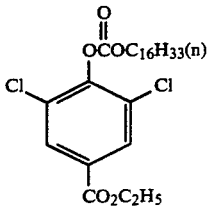
(V-8)
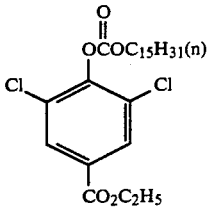
(V-9)
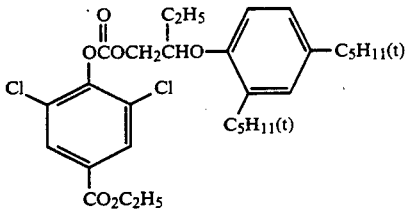
(V-10)
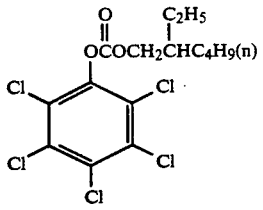
(V-11)
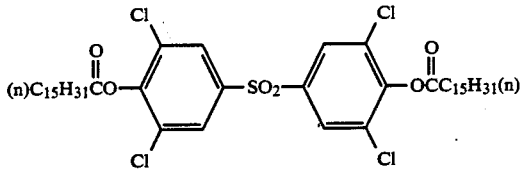
(V-12)
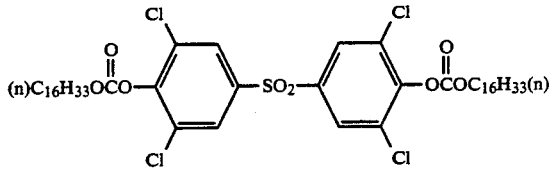

-continued
(V-13)
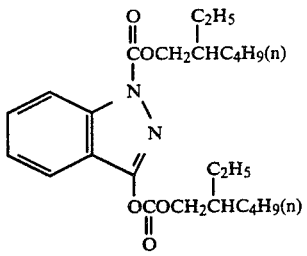
(VI-1)
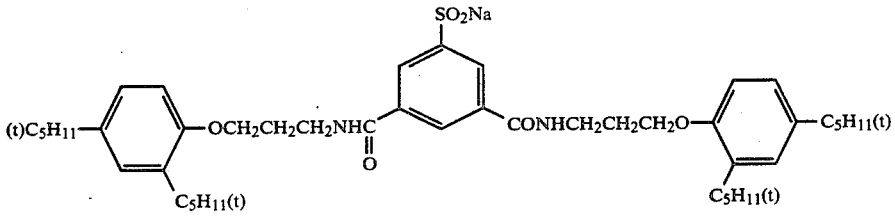
(VI-2)
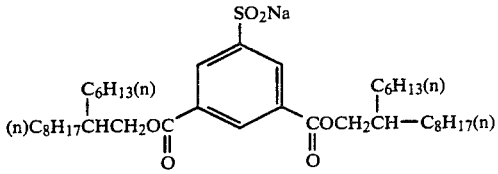
(VI-3)
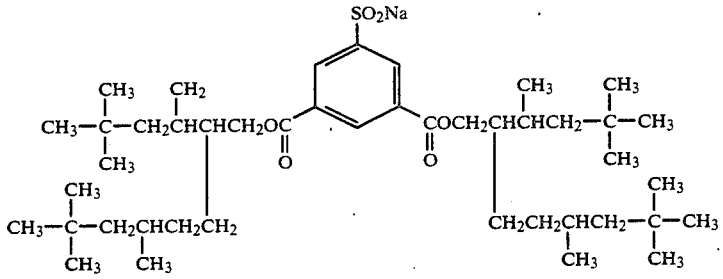
(VI-4)
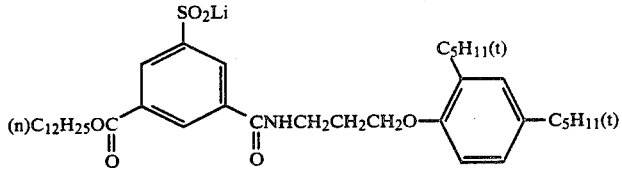
(VI-5)
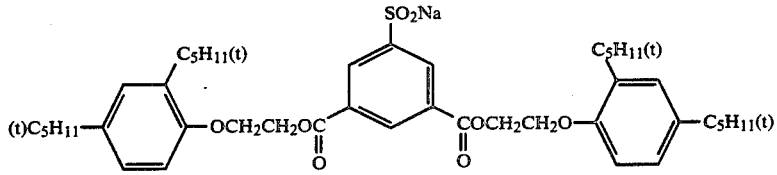
(VI-6)
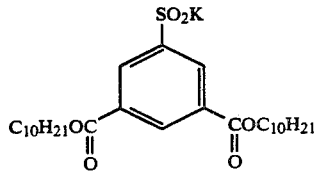

-continued
(VI-7)
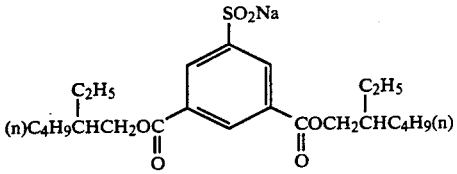
(VI-8)
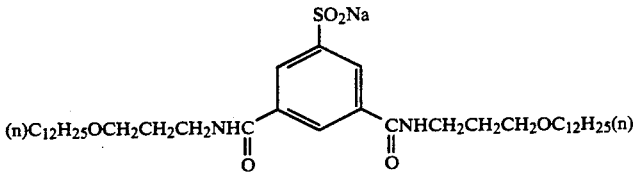
(VI-9)
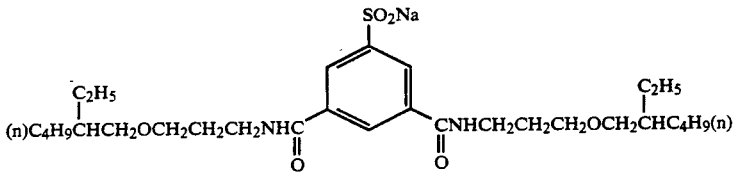
(VI-10)
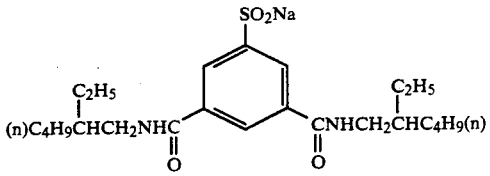
(VI-11)
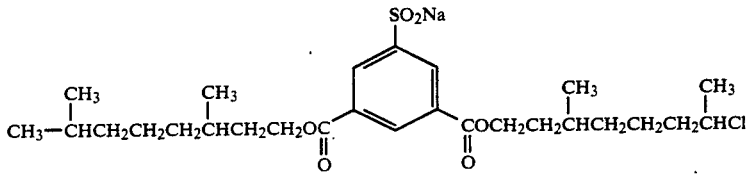
(VI-12)
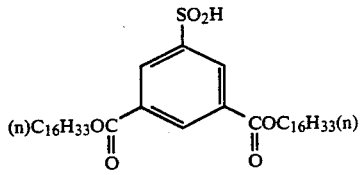
(VI-13)
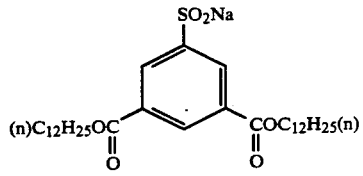
(VI-14)
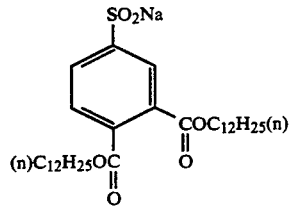

-continued

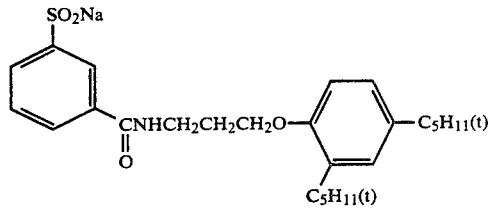

(VI-15)

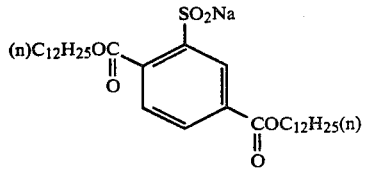

(VI-16)

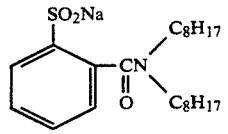

(VI-17)

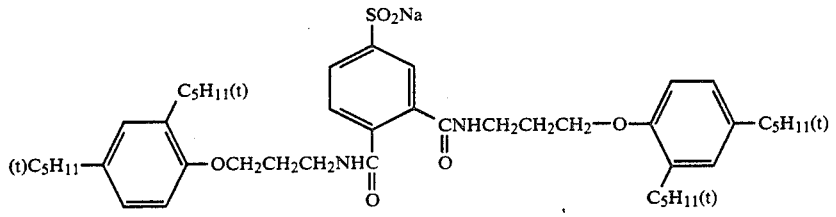

(V-18)

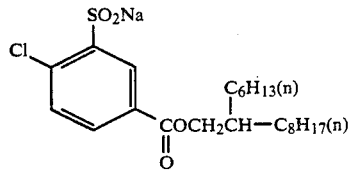

(VI-19)

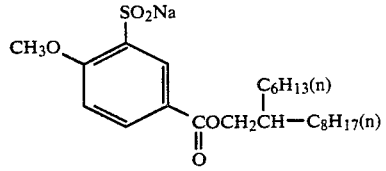

(VI-20)

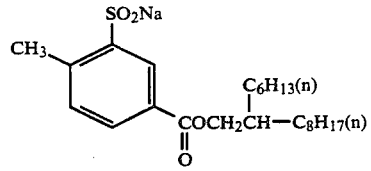

(VI-21)

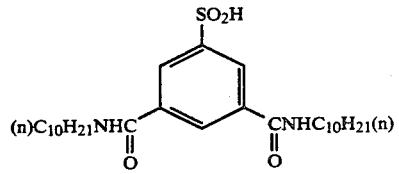

(VI-22)

The compounds of formula (V) and (VI) can be synthesized according to the methods described in JP-A-62-283338, JP-A-63-115866, JP-A-115855 and European Patent 255,722.

These compounds may be used alone. Alternatively, the compounds of formulae (V) and (VI) may be used in combination. These compounds are used in an amount of 1 to 200 mol %, preferably 5 to 50 mol % based on the amount of the coupler.

The color photographic material of the present invention comprises at least one blue-sensitive silver halide emulsion layer, at least one green-sensitive silver halide emulsion layer and at least one red-sensitive silver halide emulsion layer provided on a support. In color photographic paper, these layers are generally coated in the above-described order. If desired, these layers may be coated in a different order. A part of the whole of said sensitive layers may be replaced by an infrared sensitive layer. Color reproduction by subtractive color photography can be made by incorporating silver halide emulsions having sensitivity in the respective wave regions and color couplers which form dyes having the relationship of a complementary color to the light to which the emulsion is sensitive (that is, yellow coupler to blue light), magenta coupler to green light and cyan coupler to red light) in these sensitive emulsion layers. The hue of the formed color from the coupler and the light-sensitive layer may not have the above-described relationship.

Preferably, the silver halide emulsions of the present invention comprise silver chloride or silver chlorobromide containing substantially no silver iodide. The term "containing substantially no silver iodide" as used herein means that the content of silver iodide is no higher than 1 mol %, preferably no higher than 0.2 mol %. The grains in the emulsions may have the same or different halogen compositions. When an emulsion comprising grains having the same halogen composition is used, the properties of each grain can be easily made homogeneous. With regard to the distribution of the halogen composition in the interior of the grains of the silver halide emulsions, any grain having a uniform structure can be used where the halogen composition is equal throughout the silver halide grain, grains having a lamination type structure can be used where a core in the interior of the silver halide grain is different in the halogen composition from a shell (single layer or multilayer) which surrounds the core; and grains having a structure where the non-layer area having a different halogen composition exists in the interior of the grain or on the surface thereof can be used (when the area exists on the surface, the grain has such a structure that the area having a different composition is joined to the edge, corner or plane of the grain). These types of grains can be used by properly choosing them. To impart high sensitivity, the latter two types are preferable to the uniform type structure grain and they are also preferred from the viewpoint of pressure resistance. When silver halide grains have the above-described structures, the boundary between the areas having a different halogen composition may be a distinct one or an indistinct one where a mixed crystal is formed by a difference in composition, or the silver halide grains may have a structure where the composition is continuously changed.

With regard to the halogen compositions of these silver chlorobromide emulsions, grains having an arbitrary ratio of silver bromide/silver chloride can be used. The ratio can be widely varied according to the intended purpose, but grains having a silver chloride content of no lower than 2% are preferred.

Emulsions having a high silver chloride content such as the so-called high silver chloride emulsions can be preferably used for photographic materials for quick processing. These high silver chloride emulsions have a silver chloride content of preferably no lower than 90 mol %, more preferably no lower than 95 mol %.

The high silver chloride emulsions preferably have such a structure that they have silver bromide-localized phases in a layer or non-layer form in the interior of the silver halide grains and/or on the surfaces thereof. The silver bromide-localized phases have such a halogen composition that the silver bromide content thereof is preferably at least 10 mol %, more preferably higher than 20 mol %. These localized phases may exist in the interior of the grains or on the edges, corners or planes of the surfaces of the grains. In a preferred embodiment, the localized phases are those formed by epitaxial growth on the corners of the grains.

On the other hand, it is preferred that even when the high silver chloride emulsions having a silver chloride content of no lower than 90 mol % are used, the uniform structure type grains having a narrow halogen composition distribution are used for the purpose of inhibiting a lower sensitivity when pressure is applied to the photographic material.

It is preferred that the silver chloride content of the silver halide emulsion is further increased to reduce the replenishment rate of the developing solutions. In such a case, approximately pure silver chloride emulsions having a silver chloride content of 98 to 100 mol % are preferred. When sensitivity or fogging is taken into consideration, silver chlorobromide emulsions having a silver chloride content of 98 to 99.9 mol % are preferred.

The mean grain size (the diameter of a circle equal to the projected area of a grain is referred to as the grain size and the arithmetical mean value of the grain sizes is the mean grain size) of silver halide grains in the silver halide emulsions of the present invention is in the range of preferably 0.1 μm to 2 μm.

The grain size distribution thereof is preferably no more than 20%, more preferably no more than 15% in terms of the coefficient of variation (a value obtained by dividing the standard deviation by the mean grain size). Namely, a monodisperse system is preferred.

Preferably, in order to obtain a wide latitude, monodisperse emulsions are blended in the same layer or coated in the form of a multi-layer.

The silver halide grains contained in the photographic emulsions may have a regular crystalline form such as a cube, a tetradecahedron or an octahedron, an irregular crystalline form such as a sphere or a tabular or a composite form of these crystalline forms. A mixture of grains having various crystalline forms can be used, but it is preferred that the grains have such a crystal form distribution that at least 50%, preferably 70%, more preferably 90% thereof is composed of grains having the regular crystalline forms.

The silver halide emulsion of the present invention may be an emulsion wherein tabular grains having an aspect ratio (a ratio of the diameter in terms of a circle/thickness) of not lower than 5, preferably not lower than 8, account for at least 50% of the entire projected area of the grains.

Silver chlorobromide emulsions which are used in the present invention can be prepared by the methods described in P. Glafkides, *Chimie et Phisique Photographique* (Paul Montel, 1967), G. F. Duffin, *Photographic Emulsion Chemistry* (Focal Press, 1966) and V. L. Zelikmann et al., *Making and Coating Photographic Emulsion* (Focal Press, 1964). Namely, the silver halide emulsions can be prepared by any of an acid process, neutral process and an ammonia process. A soluble silver salt and a soluble halide salt can be reacted in accordance with a single jet process, a double jet process or a combination thereof. A reversing mixing method in which the grains are formed in the presence of an excess of silver ion can be used. Further, a controlled double jet process can be used in which a pAg value in a liquid phase, in which the silver halide is formed, is maintained constant. According to this process, silver halide emulsions can be obtained wherein the grains have a regular crystal form and the grain sizes are approximately uniform.

Various polyvalent metal ion impurities can be introduced into the silver halide emulsions of the present invention during the formation of the emulsions or during physical ripening. Examples of compounds include salts of cadmium, zinc, lead, copper and thallium, and salts and complex salts of Group VIII elements of the Periodic Table such as iron, ruthenium, rhodium, palladium, osmium, iridium and platinum. Group VIII elements are particularly preferred. The amounts of these compounds to be added vary widely according to the intended purpose, but the amounts are in the range of preferably $10^{-9}$ to $10^{-2}$ mol per mol of silver halide.

The silver halide emulsions of the present invention are generally subjected to chemical sensitization and spectral sensitization.

Chemical sensitization methods include a sulfur sensitization method using unstable sulfur compounds, noble metal sensitization such as typically gold sensitization and reduction sensitization. These methods may be used either alone or in combination. Preferred compounds used for chemical sensitization are described in JP-A-62-215272 (page 18, the lower right column to page 22, upper right column).

Spectral sensitization is carried out to impart spectral sensitivity in a desired wave region to the emulsion of each layer of the photographic material of the present invention.

It is preferred that spectral sensitization is carried out by adding dyes that absorb light in a wave region corresponding to the spectral sensitivity intended, namely spectral sensitizing dyes. Examples of spectral sensitizing dyes include those described in F. M. Harmer, *Heterocyclic Compounds—Cyanine Dyes and Related Compounds* (John Wiley & Sons, New York, London, 1964). Specific examples of such compounds are preferably those described in the afore-said JP-A-62-215272 (page 22 the upper right column to page 38).

The silver halide emulsions of the present invention may contain various compounds or precursors thereof for the purpose of preventing fog from being formed during the manufacturing or storage of the photographic material or during processing, or for the purpose of stabilizing the photographic performance. These compounds are generally called photographic stabilizers. Preferred examples of these compounds are described in the afore-said JP-A-62-215272 (pages 39 to 72).

The emulsions of the present invention may be any of the surface latent image type emulsions wherein the latent image is predominantly formed on the surfaces of the grains or the internal latent image type emulsions wherein the latent image is predominantly formed in the interior of the grains.

The color photographic materials generally contain yellow couplers for forming a yellow color, magenta couplers for forming a magenta color and cyan couplers for forming a cyan color. Each of the couplers form a color by a reaction with the oxidation products of the aromatic amine developing agents.

Among the yellow couplers which can be used in the present invention, acylacetamide derivatives such as benzoylacetanilide and pivaloylacetanilide are preferred. Among them, compounds having the following formulae [Y-1] and [Y-2] are preferred as the yellow couplers:

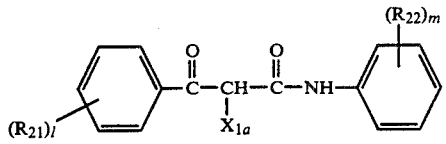

wherein $X_{1a}$ represents a hydrogen atom, or a coupling eliminable group; l and m each represents an integer of 1 to 5; $R_{21}$ and $R_{22}$ each represents a hydrogen atom or a substituent such as a halogen atom, a lower alkyl group, a lower alkoxy group or a nondiffusible group having a total of 8 to 32 carbon atoms; at least one of $R_{21}$ and $R_{22}$ represents a nondiffusible group having a total of 8 to 32 carbon atoms; when l and m is 2 or more and $R_{21}$ or $R_{22}$ is a substituent, the total of these substituents may form a nondiffusible group having a total of 8 to 32 carbon atoms.

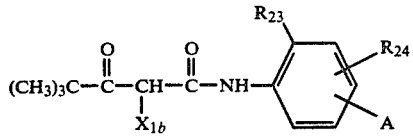

wherein $R_{23}$ represents a halogen atom, an alkyl group, an alkoxy group, a trifluoromethyl group, an aryl group, an aryloxy group, a dialkylamino group, an alkylthio group or an arylthio group; $R_{24}$ represents a hydrogen atom, a halogen atom, or an alkoxy group; A represents $—NHCOR_{25}$, $—NHSO_2R_{25}$, $—SO_2NHR_{25}$, $—COOR_{25}$, or

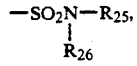

wherein $R_{25}$ and $R_{26}$ each represents an alkyl group, an aryl group or an acyl group; $X_{1b}$ represents an eliminable group; at least one of $R_{23}$, $R_{24}$ and A or total thereof is a nondiffusible group having a total of 8 to 32 carbon atoms. Preferably, $X_{1b}$ is an oxygen atom-eliminating or a nitrogen atom-eliminating type group, and a nitrogen atom-eliminating type group is especially preferred.

Pivaloylacetanilide type yellow couplers are described in more detail in U.S. Pat. Nos. 4,622,287 (column 3 line 15 to column 8 line 39) and 4,623,616 (column 14 line 50 to column 19 line 41).

Benzoylacetanilide type yellow couplers are described in U.S. Pat. Nos. 3,408,194, 3,933,501, 4,046,575, 4,133,958 and 4,401,752.

Examples of the pivaloylacetanilide type yellow couplers include compounds (Y-1) to (Y-39) described in U.S. Pat. No. 4,622,287 (column 37 to 54). Among them, (Y-1), (Y-4), (Y-6), (Y-7), (Y-15), (Y-21), (Y-22), (Y-23), (Y-26), (Y-35), (Y-36), (Y-37), (Y-38) and (Y 39) are preferred.

Other examples thereof include compounds (Y-1) to (Y-33) described in U.S. Pat. No. 4,623,616 (column 19 to 24). Among them, (Y-2), (Y-7), (Y-8) (Y-12), (Y-20), (Y-21), (Y-23), and (Y-29) are preferred.

Other preferred examples of the yellow couplers include compound (34) described in U.S. Pat. No. 3,408,194 (column 6), compounds (16) and (19) described in U.S. Pat. No. 3,933,501 (column 8), compound (9) described in U.S. Pat. No. 4,046,575 (column 7 to 8), compound (1) described in U.S. Pat. No. 4,133,958 (column 5 to 6), compound (1) described in U.S. Pat. No. 4,401,752 (column 5) and the following compounds (a) to (k):
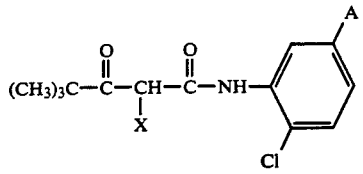
| Compound | A | $X_{16}$ |
|---|---|---|
| a | $-COOCH(CH_3)COOC_{12}H_{25}$ | 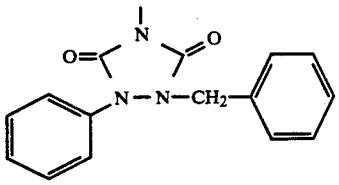 |
| b | $-COOCH(C_4H_9)COOC_{12}H_{25}$ | " |
| c | 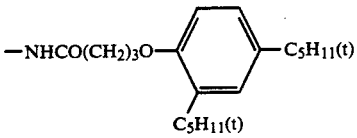 | 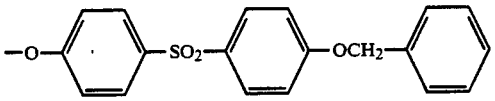 |
| d | " | 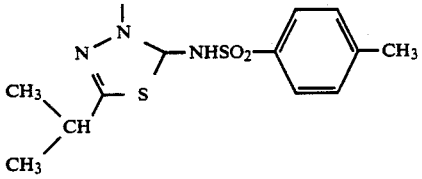 |
| e | 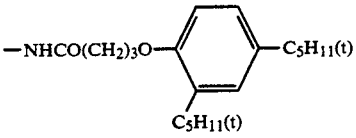 | 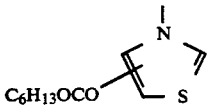 |
| f | $-NHSO_2C_{12}H_{25}$ | 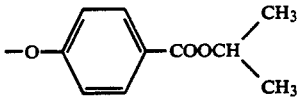 |
| g | $-NHSO_2C_{16}H_{33}$ | 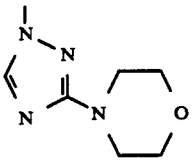 |
| h | 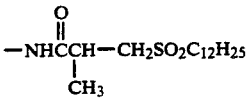 | 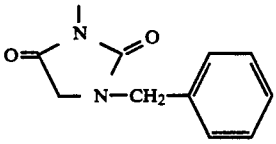 |

-continued

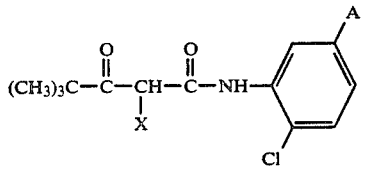

| Compound | A | $X_{16}$ |
|---|---|---|
| k | 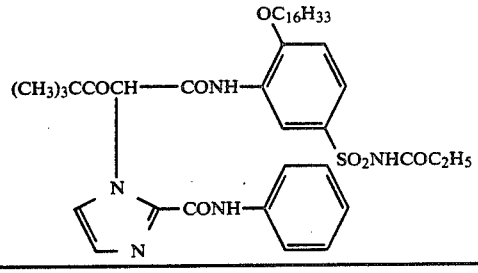 | |

Among the above couplers, the compounds where the elimination atom is a nitrogen atom are particularly preferred.

The most typical examples of cyan couplers include phenol cyan couplers and naphthol cyan couplers.

Examples of the cyan couplers include compounds having an acylamino group at the 2-position of the phenol nucleus and an alkyl group at the 5-position of the phenol nucleus (including polymer couplers) described in U.S. Pat. Nos. 2,369,929, 4,518,687, 4,511,647 and 3,772,002. Typical examples thereof include a coupler described in Example 2 of Canadian Patent 625,822, compound (1) described in U.S. Pat. No. 3,772,002, compounds (I-4) and (I-5) described in U.S. Pat. No. 4,564,590, compounds (1), (2), (3) and (24) described in JP-A-61-39045 and compound (C-2) described in JP-A-62-70846.

Other examples of the phenol cyan couplers include 2,3-diacylaminophenol couplers described in U.S. Pat. Nos. 2,772,162, 2,895,826, 4,334,011 and 4,500,653 and JP-A-59-164555. Typical examples thereof include compound (V) described in U.S. Pat. No. 2,895,826, compound (17) described in U.S. Pat. No. 4,557,999, compounds (2) and (12) described in U.S. Pat. No. 4,565,777, compound (4) described in U.S. Pat. No. 4,124,396 and compound (I-19) described in U.S. Pat. No. 4,613,564.

Other examples of the phenol cyan couplers include compounds where a nitrogen-containing heterocyclic ring is condensed with a phenol nucleus described in U.S. Pat. Nos. 4,372,173, 4,564,586 and 4,430,423, JP-A-61-390441 and JP-A-62-257158. Typical examples thereof include couplers (1) and (3) described in U.S. Pat. No. 4,327,173, compounds (3) and (16) described in U.S. Pat. No. 4,564,586, compounds (1) and (3) described in U.S. Pat. No. 4,430,423 and the following compounds:

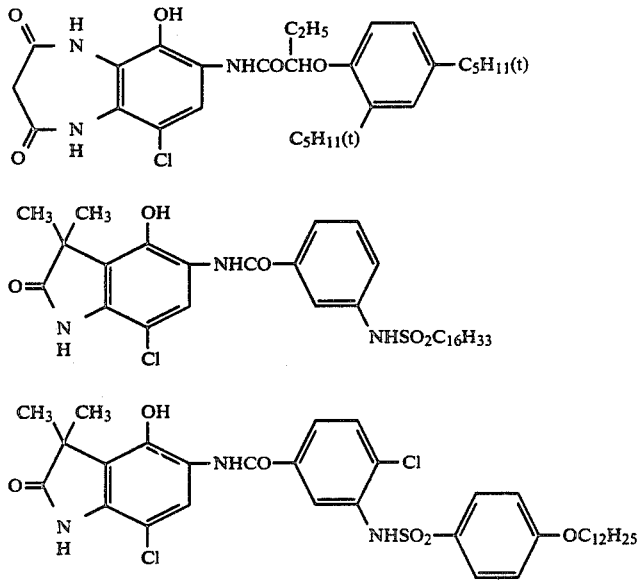

-continued
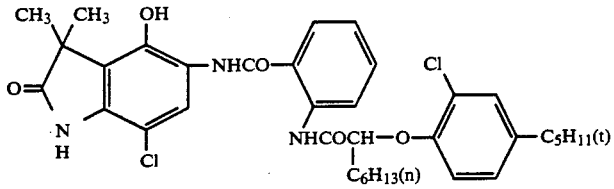
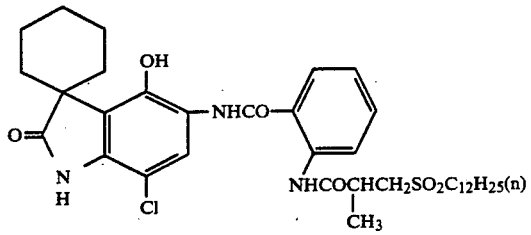
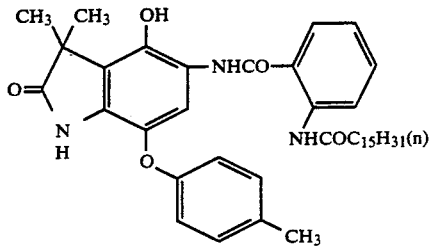
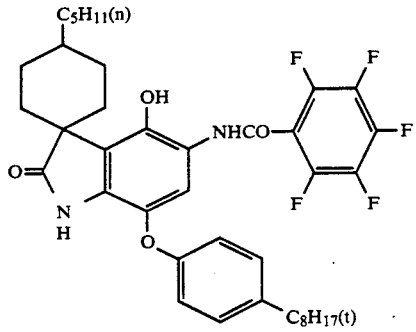
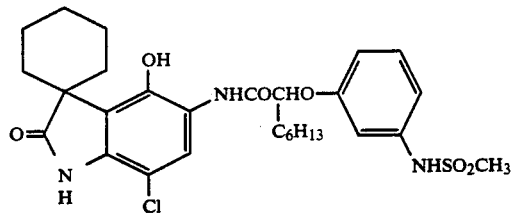
In addition to the above-described cyan couplers, the following diphenylimidazole couplers described in European Patent Laid-Open EPO,249,453A2 can be used:
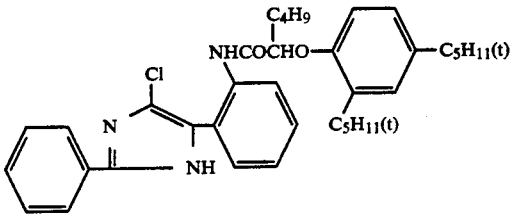

-continued

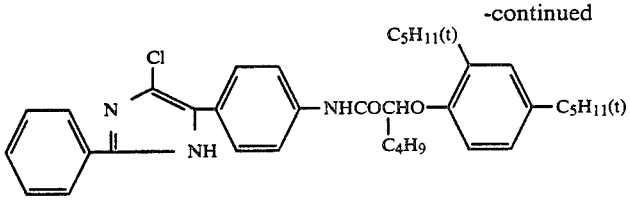

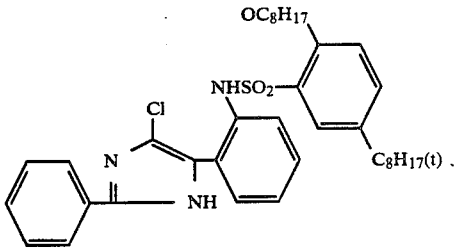

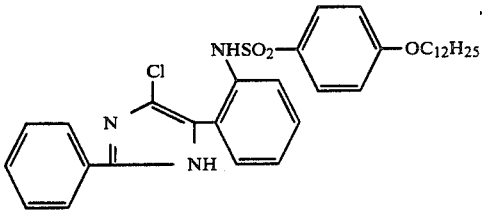

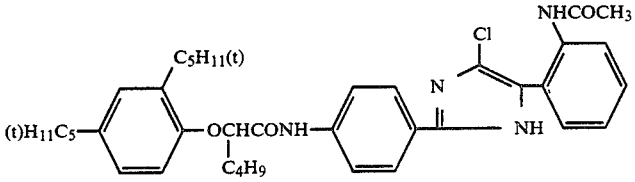

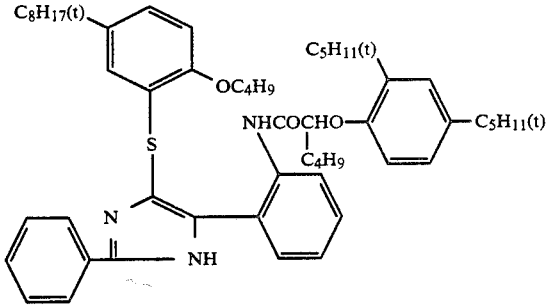

Other examples of the phenol cyan couplers include ureido couplers described in U.S. Pat. Nos. 4,333,999, 4,451,559, 4,444,872, 4,427,767 and 4,579,813 and European Patent (EP) 067,689B1. Typical examples thereof include coupler (7) described in U.S. Pat. No. 4,333,999, coupler (1) described in U.S. Pat. No. 4,451,559, coupler (14) described in U.S. Pat. No. 4,444,872, coupler (3) described in U.S. Pat. No. 4,427,767, couplers (6) and (24) described in U.S. Pat. No. 4,609,619, couplers (1) and (11) described in U.S. Pat. No. 4,579,813, couplers (45) and (50) described in European Patent (EP) 067,689B1 and coupler (3) described in JP-A-61-42658.

Examples of the naphthol cyan couplers include compounds having an N-alkyl-N-arylcarbamoyl group at the 2-position of the naphtholnucleus (e.g., described in U.S. Pat. No. 2,313,586), compounds having an alkylcarbamoyl group at the 2-position (e.g., described in U.S. Pat. Nos. 2,474,293 and 4,282,312), compounds having an arylcarbamoyl group at the 2-position (e.g., described in JP-B-50-14523), compounds having a carbonamido group or a sulfonamide group at the 5-position (e.g., described in JP-A-60-237448, JP-A-61-145557, JP-A-153640), compounds having an aryloxy elimination group (e.g., described in U.S. Pat. No. 3,476,563), compounds having a substituted alkoxy elimination group (e.g., described in U.S. Pat. No. 4,296,199) and compounds having a glycolic acid elimination group (e.g., described in JP-B-60-39217).

These couplers can be allowed to coexist with at least one high-boiling organic solvent and the couplers can be dispersed and incorporated in the emulsion layers. Preferably, high-boiling organic solvents represented by the following Formulae (A) to (D) or the above-described formula (IV) are used:

$$W_4-COO-W_5 \quad (A)$$

-continued

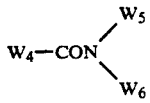

(B)

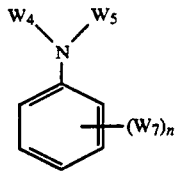

(C)

$W_4—COO—W_5$ (D)

In the above formulae, $W_4$, $W_5$ and $W_6$ are each a substituted or an unsubstituted alkyl, cycloalkyl, alkenyl, aryl or heterocyclic group; $W_7$ is $W_4$, $OW_4$ or $S—W_4$; n is an integer of from 1 to 5; and when n is 2 or greater, $W_7$ may be the same or a different group. In formula (D), $W_4$ and $W_5$ may be combined together to form a condensed ring.

The couplers are impregnated with latex polymer (e.g., described in U.S. Pat. No. 4,203,716) in the presence or absence of said high-boiling organic solvent, or dissolved in a water-insoluble, but organic solvent-soluble polymer and can be emulsified in an aqueous solution of hydrophilic colloid. Preferably, homopolymers or copolymers described in WO 88/00723 (pages 12 to 30) are used. Particularly, acrylamide polymers are preferred from the viewpoint of dye image stability.

The photographic materials prepared of the present invention may contain hydroquinone derivatives, aminophenol derivatives, gallic acid derivatives and ascorbic acid derivatives as color fogging inhibitors.

The photographic materials of the present invention may contain various anti-fading agents together with the compounds of the formulae [II] and [III].

Examples of the organic anti-fading agents for cyan, magenta and/or yellow dye images include hydroquinones, 6-hydroxychromans, 5-hydroxycoumarans, spirochromans, hindered phenols such as bisphenols and p-alkoxyphenols, gallic acid derivatives, methylenedioxybenzenes, aminophenols, hindered amines and ethers or ester derivatives obtained by silylating or alkylating a phenolic hydroxyl group of the above-described compounds. Further, metal complexes such as (bissalicyl-aldoximato)nickel complex and (bis-N,N-dialkyldithiocarbamato)nickel can also be used.

Examples of the organic anti-fading agents include hydroquinones described in U.S. Pat. Nos. 2,360,290, 2,418,613, 2,700,453, 2,701,197, 2,728,659, 2,732,300, 2,735,765, 3,982,944 and 4,430,425, U.K. Patent 1,363,921, U.S. Pat. Nos. 2,710,801 and 2,816,028; 6-hydroxychromans, 5-hydroxycoumarans and spirochromans described in U.S. Pat. Nos. 3,432,300, 3,573,050, 3,574,627, 3,698,909 and 3,764,337 and JP-A-52-152225; spiro-indanes described in U.S. Pat. No. 4,360,589; p-alkoxyphenols described in U.S. Pat. No. 2,735,765, U.K. Patent 2,066,975, JP-A-59-10539 and JP-B-57-19765; hindered phenols described in U.S. Pat. Nos. 3,700,455 and 4,228,235, JP-A-52-72224 and JP-B-52-6623; gallic acid derivatives, methylenedioxybenzenes and aminophenols each described in U.S. Pat. Nos. 3,457,079 and 4,332,886 and JP-B-56-21144; hindered amines described in U.S. Pat. Nos. 3,336,135 and 4,268,593, U.K. Patents 1,326,889, 1,354,313 and 1,410,846, JP-B-51-1420, JP-A-58-114036, JP-A-59-53846 and JP-A-59-78344; and metal complexes described in U.S. Pat. Nos. 4,245,018, 4,684,603, 4,050,938 and 4,241,155 and U.K. Patent 2,027,731 (A). These compounds are used in an amount of generally 5 to 100% by weight based on the amount of the corresponding coupler. These compounds are co-emulsified with the couplers and added to the emulsion layers. It is preferred that an ultraviolet light absorbing agent is introduced into both layers adjacent to the cyan color forming layer to prevent the cyan color image from being deteriorated by heat and particularly by light.

The hydrophilic colloid layers of the photographic materials of the present invention may contain ultraviolet light absorbing agents. Examples of the ultraviolet light absorbing agents include benztriazole compounds described in JP-B-62-13658 and JP-A-55-50245; 4-thiazolidone compounds described in U.S. Pat. Nos. 3,314,794 and 3,352,681; benzophenone compounds described in JP-A-46-2784; cinnamic ester compounds described in U.S. Pat. Nos. 3,705,805 and 3,707,375; butadiene compounds described in U.S. Pat. No. 4,045,229; and benzooxidol compounds described in U.S. Pat. No. 3,700,455. If desired, ultraviolet absorbing couplers (e.g., α-naphthol cyan color forming couplers) and ultraviolet light absorbing polymers may be used. These ultraviolet light absorbers may be mordanted in specific layers.

The hydrophilic colloid layers of the photographic materials may contain water-soluble dyes as filter dyes or for the purpose of preventing irradiation. Examples of the dyes include oxonol dyes, hemioxonol dyes, styryl dyes, merocyanine dyes, cyanine dyes and azo dyes. Among them, oxonol dyes, hemioxonol dyes and merocyanine dyes are preferred.

Gelatin is preferred as a binder or as a protective colloid for the emulsion layers of the photographic materials of the present invention. In addition thereto, a hydrophilic colloid other than gelatin alone or in combination with gelatin can be used.

Either lime-processed gelatin or acid-processed gelatin can be used in the present invention. The preparation of gelatin is described in more detail in Arthur, Weiss, *The Macromolecular Chemistry of Gelatin* (Academic Press 1964).

Any transparent film such as cellulose nitrate film and polyethylene terephthalate film and any reflection type support can be used as a support in the present invention. For the purpose of the present invention, the reflection type support is preferable.

The term "reflection type support" as used herein refers to supports which enhance the reflection properties to make a dye image formed on the silver halide emulsion layer clear. Examples of the reflection type support include supports coated with a hydrophobic resin containing a light reflecting material such as titanium oxide, zinc oxide, calcium carbonate or calcium sulfate dispersed therein, and supports composed of a hydrophobic resin containing a light reflecting material dispersed therein. Typical examples of suitable supports include baryta paper, polyethylene coated paper, polypropylene synthetic paper, transparent supports coated with a reflecting layer or containing a reflection material, glass sheet, polyester film, for example, polyethylene terephthalate film, cellulose triacetate film and cellulose nitrate film, polyamide films, polycarbonate films, polystyrene films and vinyl chloride resins. The appropriate type of support can be properly chosen according to the purpose or intended use.

Preferably as the reflecting material, a white pigment is thoroughly kneaded in the presence of a surfactant, or the surfaces of the pigment particles are treated with a dihydric to tetrahydric alcohol.

The occupied area ratio (%) of fine particles of white pigment per unit area can be determined by dividing the observed area into the adjoining unit areas (unit area: 6 $\mu m \times 6\ \mu m$) and measuring the occupied area ratio (%) (Ri) of the fine particles projected on the unit area. The coefficient of variation of the occupied area ratio (%) can be determined from a ratio (S/R) of the standard deviation S of Ri to the mean value (R) of Ri. The number (n) of divided unit areas is preferably no smaller than 6. Accordingly, the coefficient of variation S/R can be determined by the following formula:

$$\sqrt{\frac{\sum_{i=1}^{n}(Ri-R)^2}{n-1}} \Big/ \frac{\sum_{i=1}^{n} Ri}{n}$$

In the present invention, the coefficient of variation of the occupied area ratio (%) of the fine pigment particles is preferably no higher than 0.15, and particularly no higher than 0.12. When the value is no higher than 0.08, it is considered that the dispersion of the particles is substantially uniform.

Preferably, the color photographic materials of the present invention are subjected to color development, bleach-fixing and rinsing treatment (or stabilizing treatment). Bleach and fixing may be carried out with one bath or carried out separately.

When continuous processing is conducted, a lower rate of replenishment is preferred from the viewpoint of conserving resources and producing lower levels of pollution.

The replenishment rate of the color developing solution is preferably no more than 200 ml, more preferably no more than 120 ml, and still more preferably no more than 100 ml per $m^2$ of the photographic material. The term "replenishment rate" as used herein means an amount of the color developing solution to be replenished, exclusive of the amounts of other additives for the replenishing the amounts lost by condensation or lost by deterioration with time. The additives include water for the dilution of condensate, a preservative which is liable to be deteriorated with time, and an alkaline agent for raising the pH, etc.

The color developing solutions which can be used in the present invention are preferably aqueous alkaline solutions composed mainly of aromatic primary amine color developing agents. Aminophenol compounds are useful as the color developing agents and p-phenylenediamine compounds are preferred as the color developing agents. Typical examples thereof include 3-methyl-4-amino-N,N-diethylaniline, 3-methyl-4-amino-N-ethyl-N-$\beta$-hydroxyethylaniline, 3-methyl-4-amino-N-ethyl-N-$\beta$-methanesulfonamidoethylaniline, 3-methyl-4-amino-N-ethyl-N-$\beta$-methoxyethylaniline and salts thereof such as sulfate, hydrochloride and p-toluenesulfonate.

These compounds may be used either alone or in combination of two or more of them.

Generally, the color developing solutions contain pH buffering agents such as alkali metal carbonates, borates and phosphates, development restrainers such as bromides, iodides, benzimidazoles, benzothiazoles and mercapto compounds, and anti-fogging agents. If desired, the color developing solutions may optionally contain preservatives such as hydroxylamine, diethylhydroxylamine, hydrazine sulfites, phenylsemicarbazides, triethanolamine, catecholsulfonic acids and triethylenediamine (1,4-diazabicyclo[2,2,2]octane); organic solvents such as ethylene glycol and diethylene glycol; development accelerators such as benzyl alcohol, polyethylene glycol, quaternary ammonium salts and amines; color forming couplers, competitive couplers and sodium boron hydride; auxiliary developing agents such as 1-phenyl-3-pyrazolidone; tackifiers; and chelating agents such as aminopolycarboxylic acids, aminopolyphosphonic acids, alkylphosphonic acids and phosphonocarboxylic acids, for example, ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid and ethylenediamine-di(o-hydroxyphenylacetic acid) and salts thereof.

Generally, when reversal processing is to be conducted, black-and-white development is first carried out and color development is then carried out. Black-and-white developing solutions may contain conventional developing agents such as dihydroxybenzenes (e.g., hydroquinone), 3-pyrazolidones (e.g., 1-phenyl-3-pyrazolidone) and aminophenols (e.g., N-methyl-p-aminophenol). These developing agents may be used either alone or in combination of two or more.

The pH of the color developing solutions and the black-and-white developing solutions is generally in the range of 9 to 12. The replenishment rate of these developing solutions varies depending upon the type of color photographic material which being processed, but the replenishment rate is usually not more than 3 l per $m^2$ of the photographic material. The replenishment rate can be reduced to 500 ml or less when the concentration of the bromide ion in the replenisher is reduced. When the replenishment rate is reduced, it is desirable that the contact area of the treating bath with air is reduced in order to prevent the solution from being evaporated or oxidized by the air. The replenishment rate can be reduced by using a means for inhibiting the accumulation of the bromide ion in the developing solution.

After color development, the photographic emulsion layer is generally bleached. Bleaching may be carried out simultaneously with fixing (bleach-fix treatment), or bleaching and fixing may be separately carried out. After bleaching, a bleach-fix treatment may be conducted to expedite processing. Bleaching and fixing may be conducted with a bleach-fix bath composed of two consecutive baths. Fixing may be conducted before the bleach-fix treatment. After the bleach-fix treatment, bleaching may be conducted according to intended purpose. Examples of bleaching agents include compounds of polyvalent metals such as iron(III), cobalt(III), chromium(VI) and copper(II), peracids, quinones and nitro compounds. Typical examples of the bleaching agents include ferricyanates; dichromates; organic complex salts of iron(III) and cobalt(III) such as complex salts of aminopolycarboxylic acids (e.g., ethylenediaminetetraacetic acid, diethylenetriaminepentaacetic acid, cyclohexanediaminetetraacetic acid, methyliminodiacetic acid, 1,3-diaminopropanetetraacetic acid, glycol ether diaminetetraacetic acid, etc.) citric acid, tartaric acid, malic acid, etc.; persulfates; bromates; permanganates; and nitrobenzenes. Among them, iron(III) complex salts of aminopolycarboxylic acids such as (ethylenediaminetetraacetonato)iron(III) complex and persulfates are preferred from the viewpoints of rapid processing and prevention of environmental pollution. Further, iron(III) complex salts of aminopolyacarboxylic acids are useful for bleaching solutions and bleach-fix solutions. The pH of the bleaching solutions containing the iron(III) complex salts of aminopolycarboxylic acids and the bleach-fix solutions containing said iron(III) complex salts is generally in the range of 5.5 to 8. Lower pH may be used to expedite processing.

If desired, the bleaching solution, the bleach-fix solution and the previous bath thereof may contain bleaching accelerators. Examples of bleaching accelerators include compounds having mercapto group or a disulfide group as described in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426 and *Research Disclosure* No. 17129 (July 1978); thiazolidine derivatives described in JP-A-50-140129; thiourea derivatives described in JP-B-45-8506, JP-A-52-20832, JP-A-53-32735 and U.S. Pat. No. 3,706,561; iodides described in West German Patent 1,127,715 and JP-A-58-16235; polyoxyethylene compounds described in West German Patents 996,410 and 2,748,430; polyamine compounds described in JP-B-45-8836; compounds described in JP-A-49-42434, JP-A-49-59644, JP-A-53-94927, JP-A-54-35727, JP-A-55-26506 and JP-A-58-163940; and bromide ions. Among them, the compounds having a mercapto group or a disulfide group are preferred from the viewpoint of a high accelerating effect. Particularly, the compounds described in U.S. Pat. No. 3,893,858, West German Patent 1,290,812 and JP-A-53-95630 are also preferred. Further, the compounds described in U.S. Pat. No. 4,552,834 are also preferred. These bleaching accelerators may be incorporated in the photographic materials. Moreover, these bleaching accelerators are particularly effective in conducting the bleach-fix treatment of processing of color photographic materials for photography.

Examples of fixing agents include thiosulfates, thiocyanates, thioether compounds, thioureas and a large amount of iodides. The thiosulfates are widely used as the fixing agents. Particularly, ammonium thiosulfate is the most widely used. Sulfites, bisulfites and carbonyl bisulfite adducts are preferred as preservatives for the bleach-fix solutions.

Usually, the silver halide color photographic materials of the present invention are subjected to washing and/or to a stabilization stage after desilverization. The amount of rinsing water in the washing stage varies widely depending on the characteristics (e.g., depending on materials used such as couplers) of the photographic materials, the use, the temperature of the rinsing water, the number of rinsing tanks (the number of stages), the replenishing system (countercurrent, direct flow) and other conditions. The relationship between the amount of water and the number of rinsing tanks in the multi stage countercurrent system can be determined by the method described in *Journal of the Society of Motion Picture and Television Engineers*, Vol. 64, p. 248-253 (May 1955).

According to the multi-stage countercurrent system described in the above literature, the amount of rinsing water can be greatly reduced. However, there is a problem because the residence time of water in the tanks is prolonged and as a result, bacteria grows and the resulting suspended matter is deposited on the photographic material. A method for reducing calcium ion and magnesium ion described in JP-A-62-288838 can be effectively used for the color photographic materials of the present invention to solve the above-mentioned problem. Further, isothiazolone compounds, thiabendazole compounds, chlorine-containing germicides such as sodium chlorinated isocyanurate and benztriazole described in JP-A-57-8542 and germicides described in *Chemistry of Germicidal Antimold Agent*, written by Hiroshi Horiguchi, *Sterilization, Disinfection, Antimold Technique*, edited by Sanitary Technique Society and *Antibacterial and Antimold Cyclopedie*, edited by Nippon Antibacterial Antifungal Society, can be used.

The pH of the rinsing water in the treatment of the photographic materials of the present invention is in the range of preferably 4 to 9, more preferably 5 to 9. The temperature of the rinsing water and the washing time vary depending upon the characteristics of the photographic materials, the use, etc., but the temperature and the time of washing are generally 15 to 45° C. for 20 seconds to 10 minutes, preferably 25° to 40° C. for 30 seconds to 5 minutes. The photographic materials of the present invention may be processed directly with stabilizing solutions in the place of the rinsing water. Such stabilizing treatment can be carried out by conventional methods described in JP A-57-8543, JP-A-58-14834 and JP-A-60-220345.

A stabilizing treatment subsequent to rinsing may be conducted. The stabilizing treatment may be used as the final bath for the color photographic materials for photography. An example thereof include a stabilizing bath containing formalin and a surfactant. The stabilizing bath may contain various chelating agents and antimold agents.

Overflow solution from the replenishment of the rinsing water and/or the stabilizing bath can be reused in other stages such as in the desilverization stage.

The color developing agents may be incorporated in the silver halide color photographic materials of the present invention for the purpose of simplifying and expediting processing. It is preferred that precursors of the color developing agents are used for the incorporation thereof in the photographic materials. Examples of the precursors include indoaniline compounds described in U.S. Pat. No. 3,342,597; Schiff base compounds described in U.S. Pat. No. 3,342,599, *Research Disclosure* No. 14850 and *ibid.*, No. 15159; indole compounds described in *Research Disclosure* No. 13924; metal complex salts described in U.S. Pat. No. 3,719,492; and urethane compounds described in JP-A-53-135628.

If desired, 1-phenyl-3-pyrazolidones may be incorporated in the silver halide color photographic materials of the present invention for the purpose of accelerating color development. Typical examples of the development accelerating compounds include those described in JP-A-56-64339, JP-A-57-144547 and JP-A-58-115438.

In the present invention, various processing solutions are used at a temperature of 10° to 50° C. Generally, a temperature of 33° to 38° C. is used. However, it is possible that a higher temperature is used to accelerate processing and to shorten the processing time, while a lower temperature is used to improve the image quality and to improve the stability of the processing solutions.

If desired, treatments using cobalt intensification or hydrogen peroxide intensification described in West German Patent 2,226,770 and U.S. Pat. No. 3,674,499 may be carried out to save silver.

The excellent characteristics of the silver halide photographic materials of the present invention can be exhibited by carrying out processing with color developing solutions containing no more than 0.002 mol of bromine ion per liter and substantially no benzyl alcohol for a development time of not longer than 150 seconds.

The term "containing substantially no benzyl alcohol" as used herein means not more than 2 ml, preferably not more than 0.5 ml per liter of the color developing solution. It is most preferred that the developing solutions are completely free from benzyl alcohol.

The present invention is now illustrated in greater detail by reference to the following examples which, however, are not to be construed as limiting the invention in any way.

EXAMPLE 1

Both sides of a paper support were laminated with polyethylene. The resulting support was coated with the following layers to prepare a multi-layer color photographic paper having the following layer structure. Coating solutions were prepared in the following manner. *Preparation of Coating Solution for First Layer*

19.1 g of yellow coupler (ExY), 4.4 g of dye image stabilizer (Cpd-1) and 1.8 g of dye image stabilizer (Cpd-7) were dissolved in 27.2 ml of ethyl acetate, 4.1 g of solvent (Solv-3) and 4.1 g of solvent (Solv-6). The resulting solution was emulsified and dispersed in 185 ml of a 10% aqueous gelatin solution containing 8 ml of 10% sodium dodecylbenzenesulfonate. Separately, $5.0\times10^{-4}$ mol (per mol of silver) of the following blue-sensitive sensitizing dye was added to a silver chlorobromide emulsion [a 1:3 (by Ag molar ratio) mixture of emulsion (silver bromide: 80.0 mol %, cube, mean grain size: 0.85 μm, a coefficient of variation: 0.08) and emulsion (silver bromide: 80.0%, cube, mean grain size: 0.52 μm; a coefficient of variation: 0.07)] which was previously sulfur-sensitized. The above emulsified dispersion and the emulsion were mixed and dissolved. A coating solution for the first layer was prepared so as to give the following composition. In the same way as in the preparation of the coating solution for the first layer, coating solutions for the second layer through the seventh layer were prepared. Sodium salt of 1-oxy-3,5-dichloro-s-triazine was used as the hardening agent for gelatin in each layer.

The following spectral sensitizing dyes for the following layers were used:

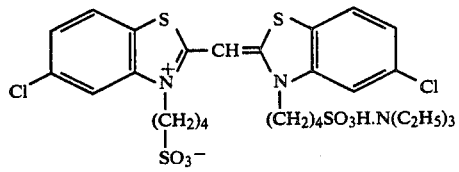

($5.0\times10^{-4}$ mol per mol of silver halide) Green-Sensitive Emulsion Layer

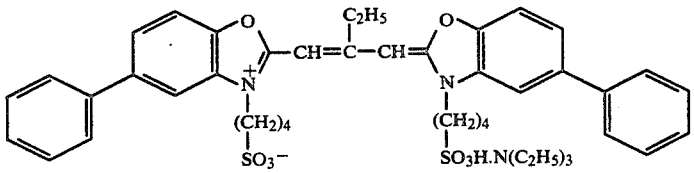

($4.0\times10^{-4}$ mol per mol of silver halide) and

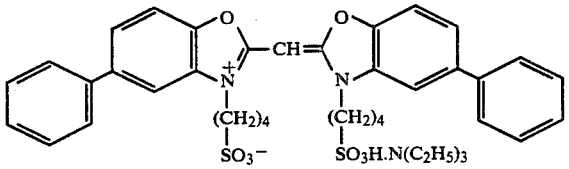

($7.0\times10^{-5}$ mol per mol of silver halide)

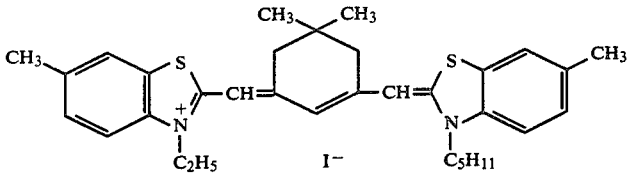

($0.9\times10^{-5}$ mol per mol of silver halide)

$2.6\times10^{-3}$ mol (per mol of silver halide) of the following compound was added to the red-sensitive emulsion layer:

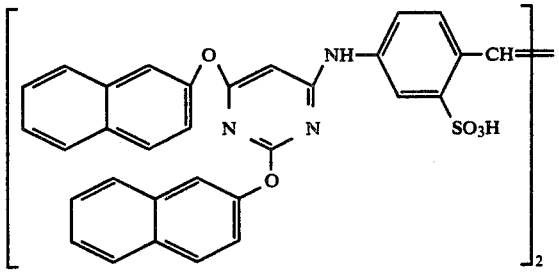

$4.0\times10^{-6}$ mol, $3.0\times10^{-5}$ mol and $1.0\times10^{-5}$ mol of 1-(5-methylureidophenyl)-5-mercaptotetrazole per mole of silver halide and $8\times10^{-3}$ mol, $2\times10^{-2}$ mol and $2\times10^{-2}$ mol of 2-methyl-5-t-octylhydroquinone per mol of silver halide were added to the blue-sensitive emulsion layer, the green-sensitive emulsion layer and the red-sensitive emulsion layer, respectively.

$1.2\times10^{-2}$ mol and $1.1\times10^{-2}$ mol of 4-hydroxy-6-methyl-1,3,3a,7-tetraazaindene per mol of silver halide were added to the blue-sensitive emulsion layer and the green-sensitive emulsion layer, respectively.

The following dyes were added to emulsion layers to prevent irradiation:

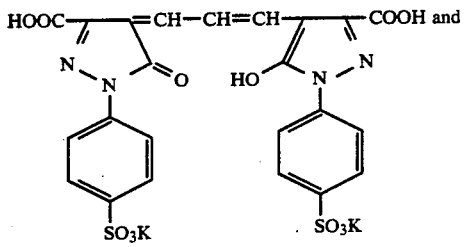

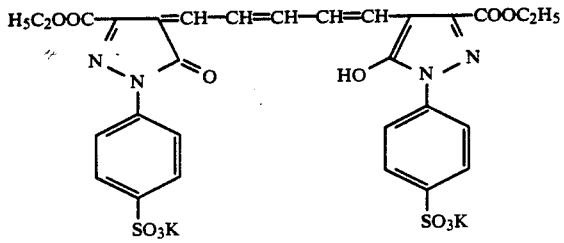

Layer Structure

Each layer had the following composition. Numerals represent coating weight ($g/m^2$). The amounts of the silver halide emulsion are represented by the coating weight in terms of silver.

Support

Polyethylene-laminated paper.

[The polyethylene on the side of the first layer contained a white pigment ($TiO_2$) and a bluish dye (ultramarine). ]

| | |
|---|---|
| First Layer: Blue-Sensitive Layer | |
| The above silver chlorobromide emulsion (AgBr: 80 mol %) | 0.26 |
| Gelatin | 1.83 |
| Yellow coupler (ExY) | 0.83 |
| Dye image stabilizer (Cpd-1) | 0.19 |
| Dye image stabilizer (Cpd-7) | 0.08 |
| Solvent (Solv-3) | 0.18 |
| Solvent (Solv-6) | 0.18 |
| Second Layer: Color Mixing Inhibiting Layer | |
| Gelatin | 0.99 |
| Color mixing inhibitor (Cpd-6) | 0.08 |
| Solvent (Solv-1) | 0.16 |
| Solvent (Solv-4) | 0.08 |
| Third Layer: Green-Sensitive Layer | |
| Silver chlorobromide emulsion [a 1:1 (by Ag molar ratio) mixture of emulsion (AgBr 90 mol %, cube, mean grain size: 0.47 μm, a coefficient of variation: 0.12) and emulsion (AgBr 90 mol %, cube, mean grain size: 0.36 μm, a coefficient of variation: 0.09)] | 0.16 |
| Gelatin | 1.79 |
| Magenta coupler (ExM-1) | 0.32 |
| Dye image stabilizer 1 | — |
| Dye image stabilizer 2 (Cpd-3) | 0.20 |
| Dye image stabilizer (Cpd-8) | 0.03 |
| Dye image stabilizer (Cpd-4) | 0.01 |
| Dye image stabilizer (Cpd-9) | 0.04 |
| Solvent (Solv-2) | 0.64 |
| Fourth Layer: Ultraviolet Light Absorbing Layer | |
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth Layer: Red-Sensitive Layer | |
| Silver chlorobromide emulsion [a 1:2 (by Ag molar ratio) mixture of emulsion (AgBr 70 mol %, cube, mean grain size: 0.49 μm, a coefficient of variation: 0.08) and emulsion (AgBr 70 mol %, cube, mean grain size: 0.34 μm, a coefficient of variation: 0.10)] | 0.23 |
| Gelatin | 1.34 |
| Cyan coupler (ExC-1) | 0.30 |
| Dye image stabilizer (Cpd-6) | 0.17 |
| Dye image stabilizer (Cpd-7) | 0.40 |
| Solvent (Solv-6) | 0.20 |
| Sixth Layer: Ultraviolet Abosrbing Layer | |
| Gelatin | 0.53 |
| Ultraviolet light absorber (UV-1) | 0.16 |
| Color mixing inhibitor (Cpd-5) | 0.02 |
| Solvent (Solv-6) | 0.08 |
| Seventh Layer: Protective Layer | |
| Gelatin | 1.33 |
| Acrylic-modified copolymer of polyvinyl alcohol (a degree of modification: 17%) | 0.17 |
| Liquid paraffin | 0.03 |

(Cpd-1) Dye Image Stabilizer

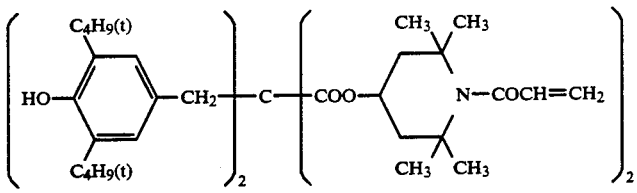

(Cpd-3) Dye Image Stabilizer

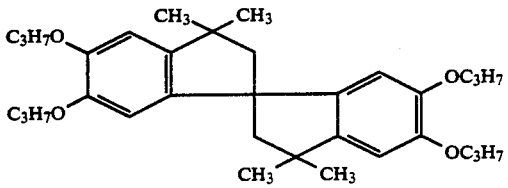

(Cpd-4) Dye Image Stabilizer
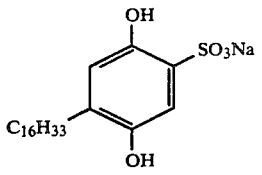
(Cpd-5) Dye Image Stabilizer
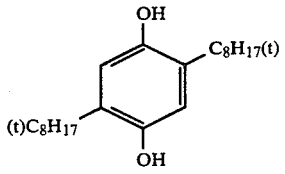
(Cpd-6) Dye Image Stabilizer
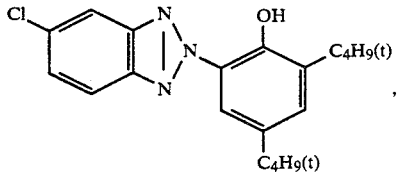
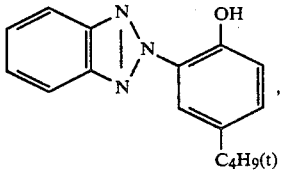
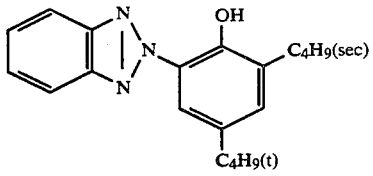
2:4:4 (by weight mixture
(Cpd-7) Dye Image Stabilizer
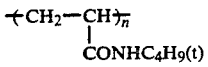
Average MW 80,000
(Cpd-8) Dye Image Stabilizer
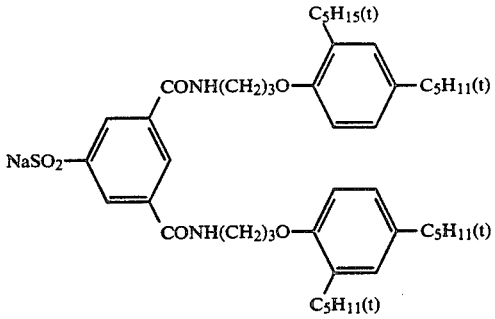
(Cpd-9) Dye Image Stabilizer
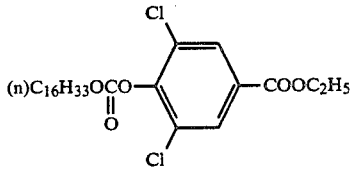
(UV-1) Ultraviolet Light Absorber
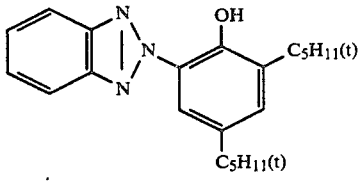
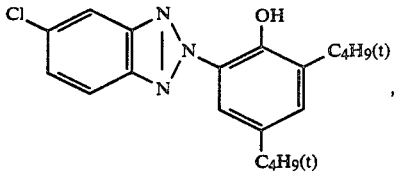
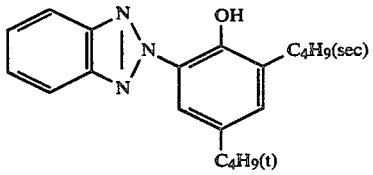
4:2:4 (by weight) mixture
(Solv-1) Solvent
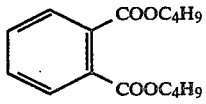

(Solv-2) Solvent
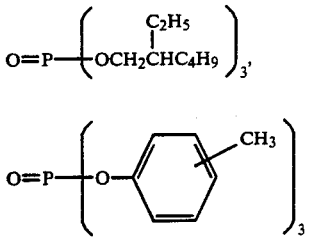
2:1 (by weight) mixture
(Solv-3) Solvent
$O{=}P{-}(O{-}C_9H_{19}\text{-(iso)})_3$
(Solv-4) Solvent
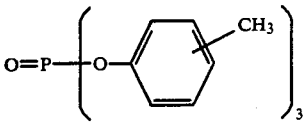
(Solv-5) Solvent
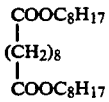
(Solv-6) Solvent
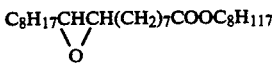
(ExY) Yellow Coupler
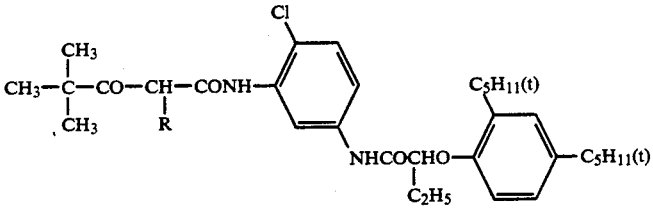
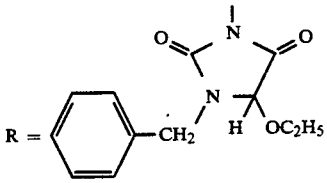
and
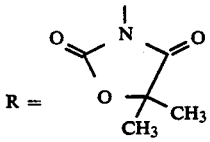
1:1 (by mol) mixture
(ExM-1) Magenta Coupler
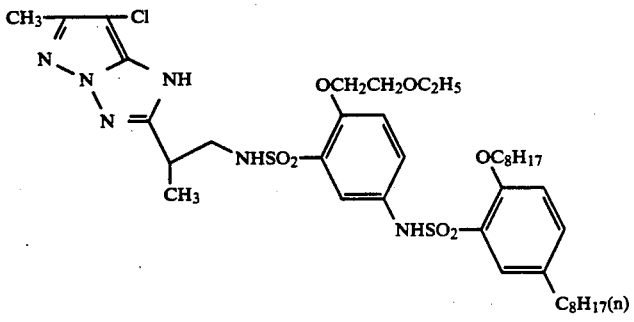

-continued and

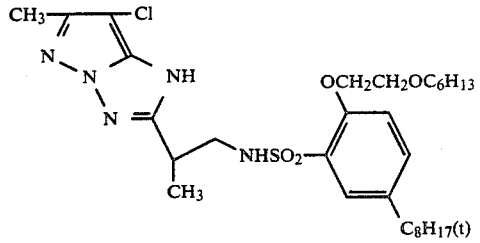

1:1 (by mol) mixture (ExC-1) Cyan Coupler

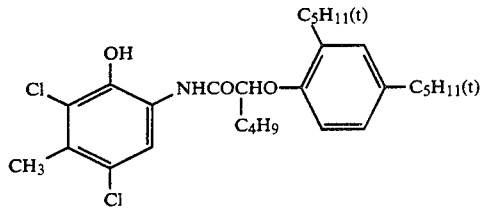

and

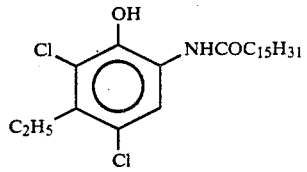

1:1 (by mol) mixture

The thus-obtained sample was referred to as sample 1A.

Other samples were prepared in the same manner as in the preparation of sample 1A except that the dye image stabilizer 1 (the compound of formula (II), 50 mol % based on the amount of the coupler), the dye image stabilizer 2 (the compound of formula (III), 100 mol % based on the amount of the coupler) and the high-boiling organic solvent (the compound of formula (IV), 200 wt % based on the amount of the coupler) in the third layer were used in combination as shown in Table 1.

These samples were exposed through an optical wedge. The exposed samples were processed with the following processing solutions in the following processing stages using an automatic processor.

| Processing Stage | Temperature | Time |
|---|---|---|
| Color development | 37° C. | 3 min 30 sec |
| Bleach-fix | 33° C. | 1 min 30 sec |
| Rinse | 24–34° C. | 3 min |
| Drying | 70–80° C. | 1 min |

Each processing solution had the following composition.

| | |
|---|---|
| Color Developing Solution | |
| Water | 800 ml |
| Diethylenetriaminepentaacetic acid | 1.0 g |
| Nitrilotriacetic acid | 2.0 g |
| Benzyl alcohol | 15 ml |
| Diethylene glycol | 10 ml |
| Sodium sulfite | 2.0 g |
| Potassium bromide | 1.0 g |
| Potassium carbonate | 30 g |
| N-Ethyl-N-(β-methanesulfonamidoethyl)-3-methyl-4-aminoaniline sulfate | 4.5 g |
| Hydroxylamine sulfate | 3.0 g |
| Fluorescent brightener (WHITEX 4B, a product of Sumitomo Chemical Co., Ltd.) | 1.0 g |
| Add water | 1000 ml |
| pH (25° C.) | 10.25 |
| Bleach-Fix Solution | |
| Water | 400 ml |
| Ammonium thiosulfate (70%) | 150 ml |
| Sodium sulfite | 18 g |
| Ethylenediaminetetraacetic acid iron(III) ammonium | 55 g |
| Disodium ethylenediaminetetraacetate | 5 g |
| Add water | 1000 ml |
| pH (25° C.) | 6.70 |

Comparative Compound (a)

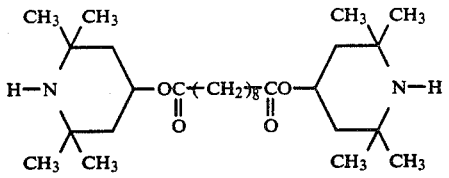

Compound described in JP-A-62-180367, JP-A-62-183459, etc.

Comparative Compound (b)

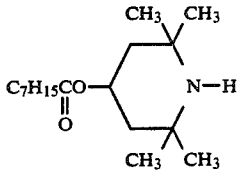

Compound described in European Patent 218,266.

Comparative Compound (c)

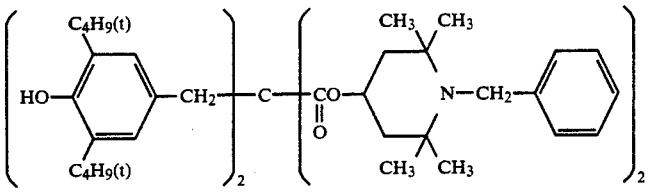

Compound described in JP-A-62-180367, JP-A-62-183459 and European Patent 242,211.

Comparative Compound (d)

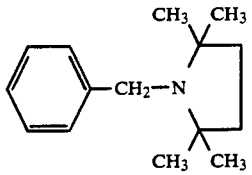

Compound described in JP-A-62-253168 and JP-A-62-246053.

Comparative Compound (e)

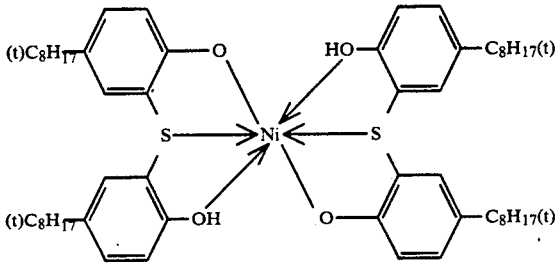

Compound described in JP-A-62-183459.

Comparative Compound (f)

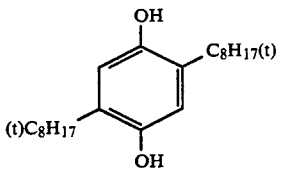

Compound described in JP-A-62-180367.

Comparative Compound (g)

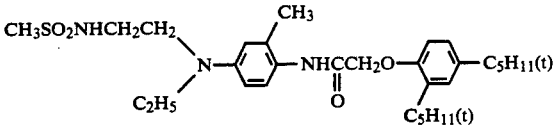

Compound described in JP-A-62-253168.

Comparative Compound (h)

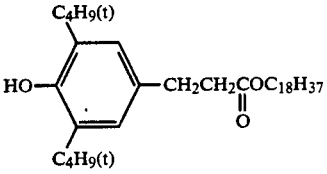

Compound described in European Patent 242,211.

Comparative Compound (i)

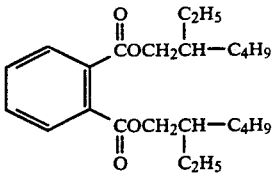

Compound described in European Patent 242,211 and JP-A-62-180367.

Each sample having a dye image formed thereon was subjected to a fading test. In the fading test, the samples were exposed for 8 days by means of a Xenon tester (illuminance: 200,0001x). The residual rates of magenta density at an initial density of 1.0 and 0.5 were measured in order to make the evaluation.

The results are shown in Table 1.

TABLE 1

| Sample | Magenta Coupler | Dye Image Stabilizer 1 (50 mol %) | Dye Image Stabilizer 2 (100 mol %) | High-Boiling Org. Solvent (200 wt %) | Residual Rate of Dye, Xe, 200,000 1×, 8 Days: Initial Density 1.0 (%) | Initial Density 0.5 (%) | Remarks |
|---|---|---|---|---|---|---|---|
| 1A | EXM-1 | — | Cpd-3(A-18) | Solv-2 | 67 | 50 | Comp. Ex. |
| 2A | " | Comparative Compound (a) | " | " | 67 | 52 | " |
| 3A | " | Comparative Compound (b) | " | " | 68 | 52 | " |
| 4A | " | Comparative Compound (c) | " | " | 63 | 48 | " |
| 5A | " | Comparative Compound (d) | " | " | 68 | 54 | " |
| 6A | " | Comparative Compound (a) | — | " | 33 | 25 | " |
| 7A | " | Comparative | — | " | 34 | 25 | " |

TABLE 1-continued

| Sample | Magenta Coupler | Dye Image Stabilizer 1 (50 mol %) | Dye Image Stabilizer 2 (100 mol %) | High-Boiling Org. Solvent (200 wt %) | Residual Rate of Dye, Xe, 200,000 1×, 8 Days Initial Density 1.0 (%) | Initial Density 0.5 (%) | Remarks |
|---|---|---|---|---|---|---|---|
| 8A | " | Compound (b) Comparative | — | " | 32 | 23 | " |
| 9A | " | Compound (c) Comparative | — | " | 32 | 25 | " |
| 10A | " | Compound (d) — | Comparative | " | 62 | 43 | " |
| 11A | " | — | Compound (e) Comparative | " | 43 | 32 | " |
| 12A | " | — | Compound (f) Comparative | " | 49 | 38 | " |
| 13A | " | Comparative | Compound (g) Comparative | " | 64 | 48 | " |
| 14A | " | Compound (a) Comparative | Compound (e) Comparative | " | 41 | 31 | " |
| 15A | " | Compound (a) Comparative | Compound (f) A-6 | " | 65 | 47 | " |
| 16A | " | Compound (b) Comparative | Comparative | " | 42 | 30 | " |
| 17A | " | Compound (c) Comparative | Compound (f) A-6 | " | 60 | 41 | " |
| 18A | " | Compound (c) Comparative | A-44 | " | 53 | 41 | " |
| 19A | " | Compound (d) Comparative | Comparative | " | 50 | 38 | " |
| 20A | " | Compound (d) — | Compound (g) A-6 | " | 65 | 45 | " |
| 21A | " | — | A-44 | " | 52 | 40 | " |
| 22A | " | Comparative | Comparative | " | 60 | 38 | *Comp. Ex. |
| 23A | " | Compound (c) Comparative | Compound (f) Comparative | Comparative | 40 | 28 | Comp. Ex. |
| 24A | " | Compound (c) Comparative | Compound (f) Comparative | Compound (i) Comparative | 58 | 35 | *Comp. Ex. |
| 25A | " | Compound (c) Comparative | Compound (f) Cpd-3(A-18) | Compound (i) Comparative | 67 | 49 | Comp. Ex. |
| 26A | " | Compound (a) Comparative | " | Compound (i) Comparative | 63 | 47 | " |
| 27A | " | Compound (c) Comparative | " | Compound (i) Comparative | 67 | 51 | " |
| 28A | " | Compound (d) — | " | Compound (i) Comparative | 66 | 48 | " |
| 29A | " | Comparative | — | Compound (i) Comparative | 31 | 22 | " |
| 30A | " | Compound (a) Comparative | — | Compound (i) Comparative | 32 | 20 | " |
| 31A | " | Compound (c) Comparative | Cpd-3(A-18) | Compound (i) Solv-5 | 60 | 45 | " |
| 32A | " | Compound (c) Comparative | " | Solv-6 | 58 | 38 | " |
| 33A | " | Compound (c) II-6 | " | Comparative | 72 | 59 | " |
| 34A | " | " | " | Compound (i) Solv-5 | 68 | 57 | " |
| 35A | " | " | " | Solv-6 | 70 | 59 | " |
| 36A | " | " | — | Solv-2 | 35 | 28 | " |
| 37A | " | " | Cpd-3(A-18) | " | 80 | 76 | Invention |
| 38A | " | II-1 | " | " | 80 | 77 | " |
| 39A | " | II-7 | " | " | 78 | 76 | " |
| 40A | " | II-14 | " | " | 78 | 77 | " |
| 41A | " | II-31 | " | " | 79 | 76 | " |
| 42A | " | II-39 | " | " | 75 | 73 | " |
| 43A | " | II-40 | " | " | 78 | 75 | " |
| 44A | " | " | Comparative | " | 42 | 30 | Comp. Ex. |
| 45A | " | " | Compound (h) Comparative | " | 41 | 33 | " |
| 46A | " | II-41 | Compound (f) Comparative | " | 42 | 32 | " |
| 47A | " | Comparative | Compound (f) A-45 | " | 53 | 34 | " |
| 48A | " | Compound (c) Comparative | A-2 | " | 60 | 39 | " |
| 49A | " | Compound (c) II-40 | " | Comparative | 70 | 58 | " |
| 50A | " | " | A-45 | Compound (i) Comparative | 68 | 55 | " |
| 51A | " | Comparative | Comparative | Compound (i) Solv-2 | 43 | 32 | " |

TABLE 1-continued

| Sample | Magenta Coupler | Dye Image Stabilizer 1 (50 mol %) | Dye Image Stabilizer 2 (100 mol %) | High-Boiling Org. Solvent (200 wt %) | Residual Rate of Dye, Xe, 200,000 1×, 8 Days: Initial Density 1.0 (%) | Initial Density 0.5 (%) | Remarks |
|---|---|---|---|---|---|---|---|
| | | Compound (c) | Compound (h) | | | | |

*Further, 100 mol % of Cpd-3(A-18) was added into Samples 22 and 24.

It is apparent from Table 1 that the samples of the present invention are very improved with respect to fastness to light in the region of low density. The result is a surprising effect which cannot be expected from conventional combinations.

EXAMPLE 2

B-G-R tricolor separation filters were attached to the samples 33A, 34A, 35A and 37A prepared in Example 1. In the same way as in Example 1, the samples were exposed and processed. The absorption spectrums of the resulting magenta dyes were measured by a spectrophotometer. The reflection density at 610 nm is shown in Table 2 when the absorption maximum is allowed to be normalized at 1.0.

TABLE 2

| Sample | Density at 610 nm | Remarks |
|---|---|---|
| 33A | 0.18 | Comp. Ex. |
| 34A | 0.16 | " |
| 35A | 0.23 | " |
| 37A | 0.10 | Invention |

It is apparent from Table 2 that the sample of the present invention exhibits good foot cutting on the long wave side of the formed dye and has good color reproducibility. It is also clear from Table 1 that the sample of the invention obtained by using the high-boiling organic solvent of the present invention is excellent with respect to fastness to light.

EXAMPLE 3

Both sides of a paper support were laminated with polyethylene. The support was coated with the following layers to prepare a multi-layer color photographic paper having the following layer structure. Coating solutions were prepared in the following manner.

Preparation of Coating Solution for First Layer 19.1 g of yellow coupler (ExY), 4.4 g of dye image stabilizer (Cpd-1) and 0.7 g of dye image stabilizer (Cpd-7) were dissolved in 27.2 ml of ethyl acetate and 8.2 g of solvent (Solv-3). The resulting solution was emulsified and dispersed in 185 ml of a 10% aqueous gelatin solution containing 8 ml of 10% sodium dodecylbenzenesulfonate. Separately, the following blue-sensitive sensitizing dye was added to a silver chlorobromide emulsion [a 3:7 (by Ag molar ratio) mixture of emulsion (cube, mean grain size: 0.88 μm), and emulsion (cube, mean grain size: 0.07 μm); a coefficient of variation in grain size distribution: 0.08 and 0.10, respectively; 0.2 mol % of silver bromide being localized on the surface of the grains in each emulsion] in such a proportion that $2.0\times10^{-4}$ mol of each of said sensitizing dyes for the larger-size emulsion and $2.5\times10^{-4}$ mol of each of said sensitizing dyes for the smaller-size emulsion were added, each amount being per mol of silver. The emulsion was then sulfur-sensitized.

The above emulsified dispersion and the emulsion were mixed and dissolved. A coating solution for the first layer was prepared so as to give the following composition. In the same way as in the preparation of the coating solution for the first layer, coating solutions for the second layer through the seventh layer were prepared. A sodium salt of 1-oxy-3,5-dichloro-s-triazine was used as the hardening agent for the gelatin in each layer.

The following spectral sensitizing dyes were used for the following layers:

Blue-Sensitive Emulsion Layer

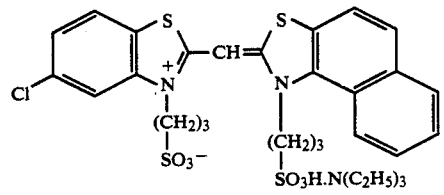

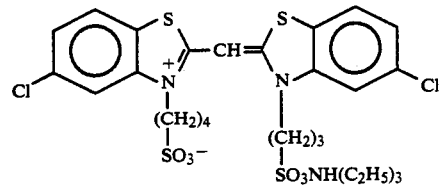

($2.0\times10^{-4}$ mol of each of the dyes was added to the larger-size emulsion, and $2.5\times10^{-4}$ mol of each of the dyes was added to the smaller-size emulsion, each amount being per mol of silver halide.)

Green-Sensitive Emulsion Layer

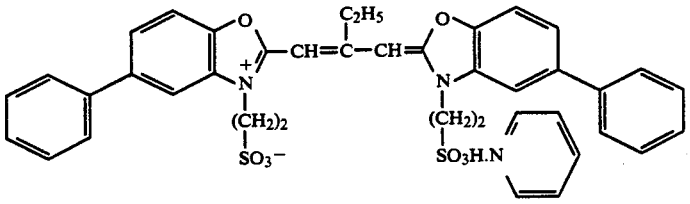

($4.0\times10^{-4}$ mol of the dye for the larger-size emulsion and $5.6\times10^{-4}$ mol of the dye for the smaller-size emulsion were used, each amount being per mol of silver halide.) and

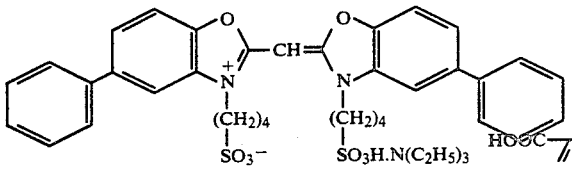

(7.0×10$^{-5}$ mol of the dye for the larger-size emulsion and 1.0×10$^{-5}$ mol of the dye for the smaller-size emulsion were used, each amount being per mol of silver halide.)

Red-Sensitive Emulsion Layer

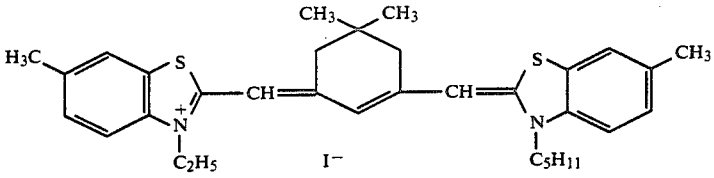

(0.9×10$^{-4}$ mol of the dye for the larger-size emulsion and 1.1×10$^{-4}$ mol of the dye for the smaller-size emulsion were used, each amount being per mol of silver halide.)

2.6×10$^{-3}$ mol of the following compound per mol of silver halide was added to the red-sensitive emulsion layer:

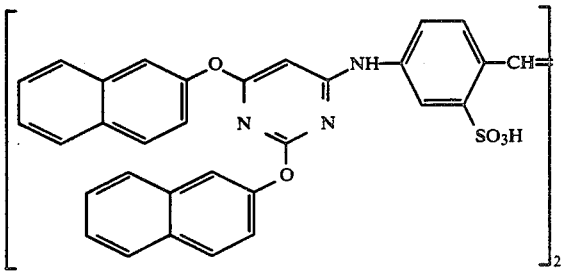

8.5×10$^{-5}$ mol, 7.7×10$^{-4}$ mol and 2.5×10$^{-4}$ mol of 1-(5-methylureidophenyl)-5-mercaptotetrazole per mol of silver halide were added to the blue-sensitive emulsion layer, the green-sensitive emulsion layer and the red-sensitive emulsion layer, respectively.

The following dyes were added to the emulsion layers to prevent irradiation:

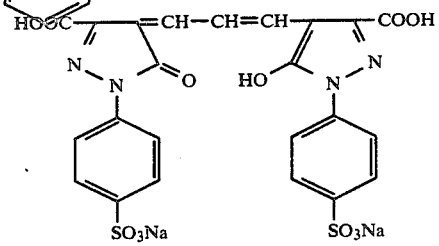

and

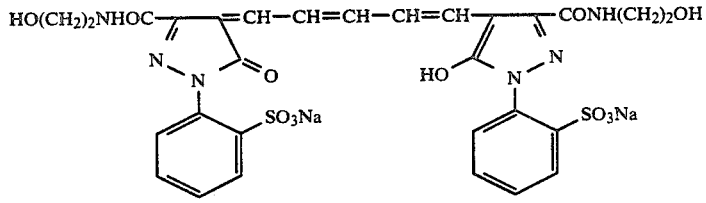

Layer Structure

Each layer had the following composition. Numerals represent coating weight (g/m$^2$). The amounts of the silver halide emulsions are represented by the coating weight in terms of silver.

Support

Polyethylene-laminated paper.

[The polyethylene on the first layer side contained a white pigment ($TiO_2$) and a bluish dye (ultramarine)].

| | |
|---|---|
| First Layer: Blue-Sensitive Layer | |
| The above silver chlorobromide emulsion | 0.30 |
| Gelatin | 1.86 |
| Yellow coupler (ExY) | 0.82 |
| Dye image stabilizer (Cpd-1) | 0.19 |
| Solvent (Solv-3) | 0.35 |
| Dye image stabilizer (Cpd-7) | 0.06 |
| Second Layer: Color Mixing Inhibiting Layer | |
| Gelatin | 0.99 |
| Color mixing inhibitor (Cpd-5) | 0.08 |
| Solvent (Solv-1) | 0.16 |
| Solvent (Solv-4) | 0.08 |
| Third Layer: Green-Sensitive Layer | |
| Silver chlorobromide emulsion [a 1:3 (by Ag molar ratio) mixture of emulsion (cube, mean grain size: 0.55 μm) and emulsion (cube, mean grain size: 0.39 μm), a coefficient of variation in grain size distribution: 0.10 and 0.08, respectively; 0.8 mol % of AgBr being localized on the surface of grain in each emulsion] | 0.12 |
| Gelatin | 1.24 |

-continued

| | |
|---|---|
| Magenta coupler (ExM-2) | 0.20 |
| Dye image stabilizer 1 | — |
| Dye image stabilizer 2 (Cpd-3) | 0.15 |
| Dye image stabilizer (Cpd-8) | 0.02 |
| Dye image stabilizer (Cpd-9) | 0.03 |
| Solvent (Solv-2) | 0.40 |
| Fourth Layer: Ultraviolet Light Absorbing Layer | |
| Gelatin | 1.58 |
| Ultraviolet light absorber (UV-1) | 0.47 |
| Color mixing inhibitor (Cpd-5) | 0.05 |
| Solvent (Solv-5) | 0.24 |
| Fifth Layer: Red-Sensitive Layer | |
| Silver chlorobromide emulsion [a 1:4 (by Ag molar ratio) mixture of emulsion (cube, mean grain size: 0.58 μm) and emulsion (cube, mean grain size: 0.45 μm); a coefficient of variation of grain size distribution: 0.09 and 0.11, respectively; 0.6 mol % of AgBr being localized on the surface of grain in each emulsion] | 0.23 |
| Gelatin | 1.34 |
| Cyan coupler (ExC-2) | 0.32 |
| Dye image stabilizer (Cpd-6) | 0.17 |
| Dye image stabilizer (Cpd-11) | 0.04 |
| Dye image stabilizer (Cpd-10) | 0.40 |
| Solvent (Solv-7) | 0.15 |
| Sixth Layer: Ultraviolet Absorbing Layer | |
| Gelatin | 0.53 |
| Ultraviolet light absorber (UV-1) | 0.16 |
| Color mixing inhibitor (Cpd-5) | 0.02 |
| Solvent (Solv-5) | 0.08 |
| Seventh Layer: Protective Layer | |
| Gelatin | 1.33 |
| Acrylic-modified copolymer of polyvinyl alcohol (a degree of modification: 17%) | 0.17 |
| Liquid paraffin | 0.03 |

(Cpd-10) Dye Image Stabilizer

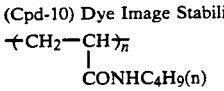

Average MW 60,000

(Cpd-11) Dye Image Stabilizer

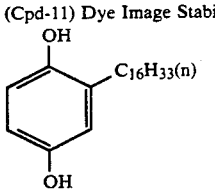

(Solv-7) Solvent

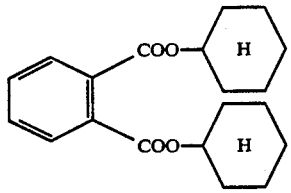

(ExM-2) Magenta Coupler

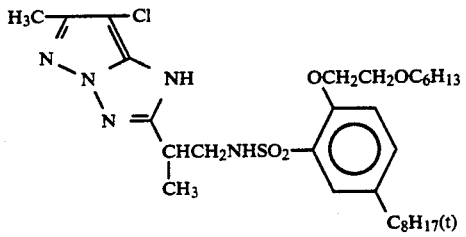

(ExC-2) Cyan Coupler

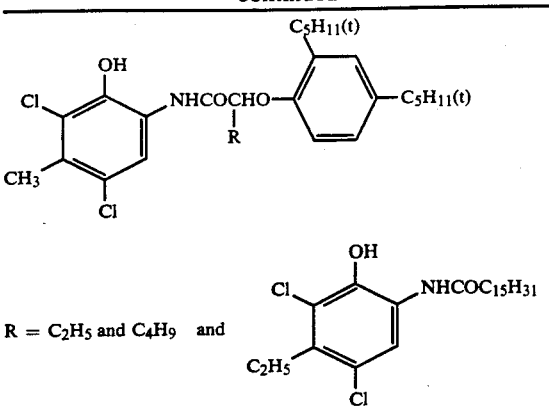

2:4:4 (by weight) mixture

The thus-obtained sample was referred to as sample 1B. Other samples were prepared in the same manner as in the preparation of sample 1B except that the magenta coupler, the dye image stabilizer 1 (the compound of formula (II), 50 mol % based on the amount of the coupler), the dye image stabilizer 2 (the compound of formula (III), 100 mol % based on the amount of the coupler) and the high-boiling organic solvent (the compound of formula (IV), 200 wt % based on the amount of the coupler) in the third layer were used in combination as shown in Table 3. The abbreviations and structures of the compounds used are the same as those of Example 1.

Each sample was exposed according to the method described in Example 1. The exposed samples were subjected to a running test in the following stages using a paper processor until the color developing solution was replenished twice as much as the tank capacity.

| Processing Stage | Temperature | Time | Replenisher | Tank Capacity |
|---|---|---|---|---|
| Color development | 35° C. | 45 sec | 161 ml | 17 l |
| Bleach-fixing | 30–35° C. | 45 sec | 215 ml | 17 l |
| Rinse (1) | 30–35° C. | 20 sec | — | 10 l |
| Rinse (2) | 30–35° C. | 20 sec | — | 10 l |
| Rinse (3) | 30–35° C. | 20 sec | 350 ml | 10 l |
| Drying | 70–80° C. | 60 sec | | |

The replenisher is measured per $m^2$ of the photographic material. A four tank countercurrent system of rinse (3) to (1) was used.

Each processing solution had the following composition.

| | Tank Solution | Replenisher |
|---|---|---|
| Color Developing Solution | | |
| Water | 800 ml | 800 ml |
| Ethylenediamine-N,N,N',N',-tetramethylenephosphonic acid | 1.5 g | 2.0 g |
| Triethanolamine | 8.0 g | 12.0 g |
| Sodium chloride | 1.4 g | — |
| Potassium carbonate | 25 g | 25 g |
| N-Ethyl-N-(β-methanesulfonamidoethyl)-3-methyl-4-aminoaniline sulfate | 5.0 g | 7.0 g |
| N,N-Bis(carboxymethyl)hydrazine | 5.0 g | 7.0 g |
| Fluorescent brightener (WHITEX 4B, a product of Simitomo Chemical Co., Ltd.) | 1.0 g | 2.0 g |
| Add water | 1000 ml | 1000 ml |

-continued

| | Tank Solution | Replenisher |
|---|---|---|
| pH (25° C.) | 10.05 | 10.45 |
| Bleach-Fix Solution | | |
| (Tank solution and replenisher are the same) | | |
| Water | 400 ml | |
| Ammonium thiosulfate (70%) | 100 ml | |
| Sodium sulfite | 17 g | |
| Ethylenediaminetetraacetic acid iron(III) ammonium | 55 g | |
| Disodium ethylenediaminetetraacetate | 5 g | |
| Ammonium bromide | 40 g | |
| Add water | 1000 ml | |
| pH (25° C.) | 6.0 | |

Rinsing Solution (Tank solution and replenisher are the same)

Ion-exchanged water (the concentration of each of calcium and magnesium is reduced to 3 ppm or lower).

Each of the thus-obtained running solution-processed samples were exposed to a fluorescent light fadeometer (illuminance: 20,000 lx) for six weeks. The residual rate of magenta density at an initial density of 1.0 and 0.5 was measured. The results by percentage are shown in Table 3.

TABLE 3

| Sample | Magenta Coupler | Dye Image Stabilizer 1 (50 mol %) | Dye Image Stabilizer 2 (100 mol %) | High-Boiling Org. Solvent (200 wt %) | Residual Rate of Dye, Fl, 20,000 1×, 6 Weeks: Initial Density 1.0 (%) | Initial Density 0.5 (%) | Remarks |
|---|---|---|---|---|---|---|---|
| 1B | EXM-2 | — | Cpd-3(A-18) | Solv-2 | 65 | 53 | Comp. Ex. |
| 2B | " | Comparative Compound (b) | " | " | 64 | 54 | " |
| 3B | " | Comparative Compound (c) | " | " | 64 | 52 | " |
| 4B | " | Comparative Compound (b) | — | " | 29 | 22 | " |
| 5B | " | Comparative Compound (c) | — | " | 29 | 18 | " |
| 6B | " | Comparative Compound (b) | Cpd-3(A-18) | Comparative Compound (i) | 63 | 50 | " |
| 7B | " | Comparative Compound (c) | " | Comparative Compound (i) | 64 | 47 | " |
| 8B | " | Comparative Compound (c) | Comparative Compound (e) | Solv-2 | 52 | 39 | " |
| 9B | " | — | Comparative Compound (e) | " | 50 | 41 | " |
| 10B | " | II-5 | Comparative Compound (e) | " | 52 | 42 | " |
| 11B | " | II-9 | Comparative Compound (e) | " | 54 | 44 | " |
| 12B | " | II-30 | Comparative Compound (e) | " | 52 | 43 | " |
| 13B | " | II-38 | Comparative Compound (e) | " | 51 | 41 | " |
| 14B | " | II-5 | — | " | 29 | 18 | " |
| 15B | " | II-9 | — | " | 32 | 23 | " |
| 16B | " | II-30 | — | " | 28 | 17 | " |
| 17B | EXM-1 | II-38 | — | " | 29 | 15 | " |
| 18B | " | II-5 | Cpd-3(A-18) | " | 78 | 77 | Invention |
| 19B | " | II-9 | " | " | 79 | 79 | " |
| 20B | " | II-30 | " | " | 75 | 73 | " |
| 21B | " | II-38 | " | " | 80 | 78 | " |
| 22B | " | " | A-3 | " | 77 | 73 | " |
| 23B | " | — | " | " | 62 | 50 | Comp. Ex. |
| 24B | " | II-38 | A-12 | " | 78 | 75 | Invention |
| 25B | " | — | " | " | 64 | 50 | Comp. Ex. |
| 26B | " | II-38 | A-29 | " | 78 | 74 | Invention |
| 27B | " | — | " | " | 64 | 51 | Comp. Ex. |
| 28B | " | II-38 | A-39 | " | 74 | 71 | Invention |
| 29B | " | " | Cpd-3(A-18) | Comparative Compound (i) | 69 | 58 | Comp. Ex. |
| 30B | " | " | A-3 | Comparative Compound (i) | 67 | 54 | " |
| 31B | " | " | A-12 | Comparative Compound (i) | 67 | 55 | " |
| 32B | M-32 | — | Cpd-3(A-18) | Solv-2 | 67 | 55 | " |
| 33B | " | II-6 | — | " | 30 | 21 | " |
| 34B | " | " | Cpd-3(A-18) | " | 80 | 76 | Invention |
| 35B | " | II-7 | — | " | 29 | 18 | Comp. Ex. |
| 36B | " | " | Cpd-3(A-18) | " | 75 | 72 | Invention |
| 37B | " | II-38 | — | " | 29 | 20 | Comp. Ex. |
| 38B | " | " | Cpd-3(A-18) | " | 79 | 77 | Invention |
| 39B | " | II-6 | A-3 | " | 75 | 73 | " |
| 40B | " | " | A-12 | " | 77 | 76 | " |
| 41B | " | " | A-29 | " | 78 | 75 | " |

TABLE 3-continued

| Sample | Magenta Coupler | Dye Image Stabilizer 1 (50 mol %) | Dye Image Stabilizer 2 (100 mol %) | High-Boiling Org. Solvent (200 wt %) | Residual Rate of Dye, Fl, 20,000 1×, 6 Weeks Initial Density 1.0 (%) | Initial Density 0.5 (%) | Remarks |
|---|---|---|---|---|---|---|---|
| 42B | " | " | A-3 | Comparative Compound (i) | 68 | 57 | Comp. Ex. |
| 43B | " | | A-12 | Comparative Compound (i) | 66 | 58 | " |
| 44B | " | " | A-29 | Comparative Compound (i) | 67 | 56 | " |
| 45B | EXM-2 | II-40 | Comparative Compound (h) | Solv-2 | 29 | 19 | " |
| 46B | " | " | Comparative Compound (f) | " | 26 | 17 | " |
| 47B | " | Comparative Compound (c) | A-45 | " | 45 | 29 | " |
| 48B | " | Comparative Compound (c) | A-2 | " | 63 | 50 | " |
| 49B | " | II-40 | " | Comparative Compound (i) | 67 | 56 | " |
| 50B | " | " | A-45 | Comparative Compound (i) | 60 | 46 | " |
| 51B | " | Comparative Compound (c) | Comparative Compound (f) | Solv-2 | 28 | 17 | " |
| 52B | " | II-40 | A-2 | " | 77 | 76 | Invention |

It is clear from Table 3 that the samples of the present invention are excellent with respect to fastness to light and have a remarkable effect of improving the fastness to light in the region of low density, and in particular, even when the developing solution is a running solution.

EXAMPLE 4

The coated samples of Example 3 were exposed according to the method described in Example 3. The samples were then subjected to a running test in the following processing stages using a paper processor until the color developing solution was replenished twice as much as the tank capacity. The samples were processed to obtain dye image.

| Processing Stage | Temperature | Time | Replenisher | Tank Capacity |
|---|---|---|---|---|
| Color development | 35° C. | 45 sec | 161 ml | 17 l |
| Bleach-fix | 30–36° C. | 45 sec | 215 ml | 17 l |
| Stabilization (1) | 30–37° C. | 20 sec | — | 10 l |
| Stabilization (2) | 30–37° C. | 20 sec | — | 10 l |
| Stabilization (3) | 30–37° C. | 20 sec | — | 10 l |
| Stabilization (4) | 30–37° C. | 30 sec | 248 ml | 10 l |
| Drying | 70–85° C. | 60 sec | | |

The amount of the replenisher was measured per $m^2$ of the photographic material.

A four tank countercurrent system of stabilization (4) to (1) was used.

Each processing solution had the following composition.

| | Tank Solution | Replenisher |
|---|---|---|
| Color Developing Solution | | |
| Water | 800 ml | 800 ml |
| Ethylenediaminetetraacetic acid | 1.5 g | 2.0 g |
| 5,6-Dihydroxybenzene-1,2,4-trisulfonic acid | 0.3 g | 0.3 g |
| Triethanolamine | 8.0 g | 8.0 g |
| Sodium chloride | 1.4 g | — |
| Potassium carbonate | 25 g | 25 g |

-continued

| | Tank Solution | Replenisher |
|---|---|---|
| N-Ethyl-N-(β-methanesulfonamidoethyl)-3-methyl-4-aminoaniline sulfate | 5.0 g | 7.0 g |
| Diethylhydroxyamine | 4.2 g | 6.0 g |
| Fluorescent brightener (4,4'-diaminostilbene type) | 2.0 g | 2.5 g |
| Add water | 1000 ml | 1000 ml |
| pH (25° C.) | 10.05 | 10.45 |
| Bleach-Fix Solution | | |
| (Tank solution and replenisher were the same) | | |
| Water | 400 ml | |
| Ammonium thiosulfate (70%) | 100 ml | |
| Sodium sulfite | 17 g | |
| Ethylenediaminetetraacetic acid iron(III) ammonium | 55 g | |
| Disodium ethylenediaminetetraacetate | 5 g | |
| Glacial acetic acid | 9 g | |
| Add water | 1000 ml | |
| pH (25° C.) | 5.40 | |
| Stabilizing Solution | | |
| (Tank solution and replenisher were the same) | | |
| Formalin (37%) | 0.1 g | |
| Formalin-sulfurous acid adduct | 0.7 g | |
| 5-Chloro-2-methyl-4-isothiazoline-3-one | 0.02 g | |
| 2-Methyl-4-isothiazoline-3-one | 0.01 g | |
| Copper sulfate | 0.005 g | |
| Add water | 1000 ml | |
| pH (25° C.) | 4.0 | |

The thus-obtained samples were subjected to a fading test in the same manner as in Example 3. The samples were excellent in fastness to light as in Example 3.

EXAMPLE 5

Samples were prepared in the same manner as in Example 3 except that the couplers of samples 32B to 44B were replaced with M-3, M-5, M-14, M-29, M-34 and M-37, respectively. In the same way as in Example 3, the samples were exposed and subjected to the fading test. The samples of the present invention were excellent in fastness to light as in Example 3.

EXAMPLE 6

Samples were prepared in the same manner as in Example 1 except that the dye image stabilizer (Cpd-8) and the dye image stabilizer (Cpd-9) used in the third layer of each of the samples 37A to 42A were omitted. In the same manenr as in Example 1, the samples were exposed, processed and subjected to a fading test at 60° C. and 70% RH for two weeks. The formation of magenta stain in the unexposed area was observed. It was found that the use of the combination of the dye image stabilizer (Cpd-8) and the dye image stabilizer (Cpd-9) has an effect on the image-preservability and is particularly effective in preventing magenta stain from being formed.

As is clear from the above examples, the present invention provides photographic materials which are excellent in color reproducibility and image preservability and have greatly improved fastness to light in the region of the low density of the magenta dye image.

While the invention has been described in detail and with reference to specific embodiments thereof, it will be apparent to one skilled in the art that various changes and modifications can be made therein without departing from the spirit and scope of the present invention.

What is claimed is:

1. A silver halide color photographic light-sensitive material having at least one silver halide color photographic light-sensitive emulsion layer on a support, which comprises:

(i) at least one coupler represented by formula (I), (ii) at least one compound represented by formula (II), (iii) at least one compound represented by formula (III), and (iv) at least one high-boiling organic solvent represented by formula (IV), wherein each of the coupler and the compounds represented by formulae (I) to (IV) are incorporated in the same light-sensitive emulsion layer, Formula (I):

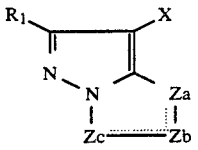

wherein:

$R_1$ represents a hydrogen atom or a substituent group;

X represents a hydrogen atom or a group which is eliminated by a coupling reaction with the oxidation product of an aromatic primary amine developing agent;

Za, Zb and Zc each represents a methine group, a substituted methine group, =N— or —NH—; one of the Za-Zb bond and the Zb-Zc bond is a double bond and the other is a single bond and when the Zb-Zc bond is a carbon-carbon double bond, said bond may constitute part of an aromatic bond; and said compounds may be in the form of a dimer or a higher polymer formed at $R_1$ or X; or when Za, Zb or Zc is a substituted methine group, said compounds may be in the form of a dimer or a higher polymer formed at a substituted methine group, Formula (II)

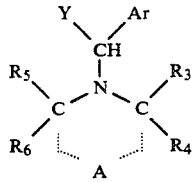

wherein:

Ar represents an aryl group or a heterocyclic group;

Y represents a hydrogen atom or a substituent group;

$R_3$, $R_4$, $R_5$ and $R_6$ may be the same or different groups and each is an alkyl group;

A is a non-metallic atomic group required for the formation of a 6-membered ring;

$R_3$ and $R_4$, $R_5$ and $R_6$, Y and Ar, Ar and $R_3$, Y and $R_3$, $R_3$ and A, or $R_3$ and Y, may be combined together to form a 5-membered or 6-membered ring, with the proviso that the compounds of formula (II) do not have a phenolic hydroxyl group in the molecular structure, said compounds may be in the form of a dimer or a higher polymer formed at any position on the compounds capable of chemically bonding, Formula (III)

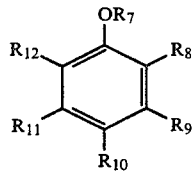

wherein:

$R_7$ represents an alkyl group, an alkenyl group, an aryl group, a heterocyclic group or a group of

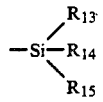

(wherein $R_{13}$, $R_{14}$ and $R_{15}$ may be the same or different groups and each represents an alkyl group, an alkenyl group, an aryl group, an alkoxy group, an alkenoxy group or an aryloxy group);

$R_8$, $R_9$, $R_{10}$, $R_{11}$ and $R_{12}$ may be the same or different groups and each represents a hydrogen atom, an alkyl group, an alkenyl group, an aryl group, an acylamino group, an alkylamino group, an alkylthio group, an arylthio group, a halogen atom, a nitrogen atom containing heterocyclic ring bonding to the benzene ring through the nitrogen atom, or a group of —O—$R_7'$ (where $R_7'$ has the same meaning as $R_7$); and $R_7$ and $R_8$ may be combined together to form a 5-membered or a 6-membered ring or a spiro ring; or $R_8$ and $R_9$, or $R_9$ and $R_{10}$, may be combined together to form a 5-membered or a 6-membered ring or a spiro ring, said compounds may be in the form of a dimer or a higher polymer formed at any position on the compounds capable of chemically bonding, Formula (IV)

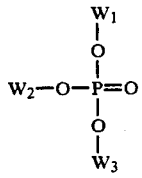

(IV)

wherein $W_1$, $W_2$ and $W_3$ each represents a substituted or an unsubstituted alkyl, cycloalkyl, alkenyl, aryl or heterocyclic group and the sum total of the carbon atoms of $W_1$, $W_2$ and $W_3$ is not less than 8.

2. The silver halide color photographic light-sensitive material of claim 1, wherein said coupler is selected from the group consisting of compounds represented by formulae (I-1)–(I-7):

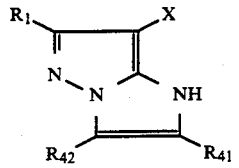

(I-1)

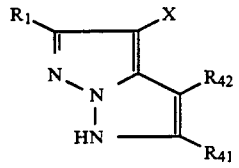

(I-2)

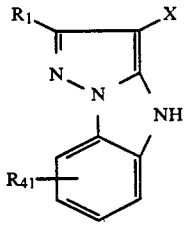

(I-3)

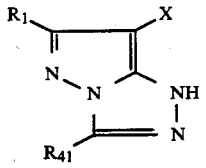

(I-4)

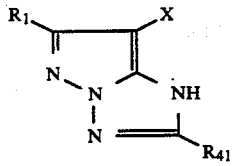

(I-5)

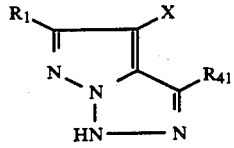

(I-6)

and

-continued

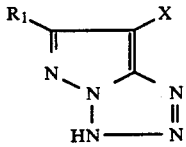

(I-7)

wherein $R_1$, $R_{41}$ and $R_{42}$ may be the same or different groups and each is a hydrogen atom, a halogen atom, an alkyl group, an aryl group, a heterocyclic group, a cyano group, an alkoxy group, an aryloxy group, a heterocyclic oxy group, an acyloxy group, a carbamoyloxy group, a silyloxy group, a sulfonyloxy group, an acylamino group, an anilino group, a ureido group, an imido group, a sulfamoylamino group, a carbamoylamino group, an alkylthio group, an arylthio group, a heterocyclic thio group, an alkoxycarbonylamino group, an aryloxycarbonylamino group, a sulfonamido group, a carbamoyl group, an acyl group, a sulfamoyl group, a sulfonyl group, a sulfinyl group, an alkoxycarbonyl group or an aryloxycarbonyl group, X is hydrogen atom, a halogen atom, a carboxyl group, or a group which is attached to carbon atom at the coupling position through oxygen atom, nitrogen atom or sulfur atom and is eliminated by coupling reaction; and biscompounds thereof formed by combining the coupler moieties of said couplers with each other through a divalent group at $R_1$, $R_{41}$, $R_{43}$ or X, and polymers thereof formed by bonding the coupler moieties of couplers represented by formulae (I-1) to (I-7) to a polymer at $R_1$, $R_{41}$, $R_{43}$ or X.

3. The silver halide color photographic light-sensitive material of claim 1, wherein the couplers of formula (I) are present in an amount of $1\times10^{-3}$ to 1 mol per mol of silver halide in the same emulsion layer.

4. The silver halide color photographic light-sensitive material of claim 1, wherein in formula (II), Y is a hydrogen atom, a halogen atom, an alkyl group, an aryl group, a heterocyclic group, a cyano group, an alkoxy group, an aryloxy group, a heterocyclic oxy group, an acyloxy group, a carbamoloxy group, a hydroxyl group, a sulfonyloxy group, an acylamino group, an anilino group, a ureido group, an imido group, a sulfamoylamino group, a carbamoylamino group, an alkylthio group, an arylthio group, a heterocyclic thio group, an alkoxy carbonylamino group, an aryloxycarbonylamino group, a sulfonamido group, a carbamoyl group, an acyl group, a sulfamoyl group, a sulfonyl group, a sulfinyl group, an alkoxycarbonyl group, an aryloxycarbonyl group and a phospholyl group.

5. The silver halide color photogrpahic light-sensitive material of claim 1, wherein A in formula (II) has at least two carbon atoms and is selected from the group consisting of:

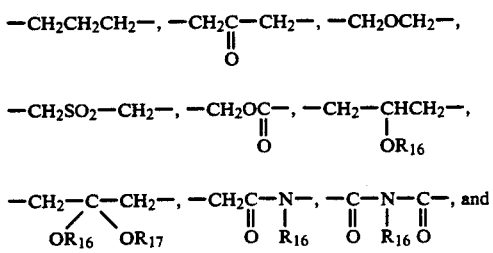

-continued

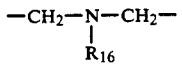

wherein $R_{16}$ and $R_{17}$ may be the same or different groups and each is a hydrogen atom, an alkyl group, an acyl group, a sulfonyl group, a sulfinyl group, a carbamoyl group, a heterocyclic group, an acylamino group, a sulfonamido group, or an alkoxycarbonyl group; $R_{16}$ and $R_{17}$ may be combined to form a 5- or 6-membered ring.

6. The silver halide color photographic light-sensitive material of claim 1, wherein the compounds of formula (II) are present in an amount of 1 to 300 mol % based on the amount of coupler.

7. The silver halide color photographic light-sensitive material of claim 1, wherein the compounds of formula (III) are selected from the group consisting of formulae (III-1)–(III-7):

(III-1)

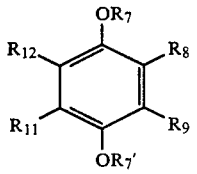

(III-2)

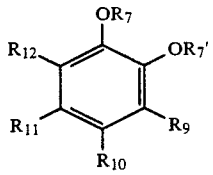

(III-3)

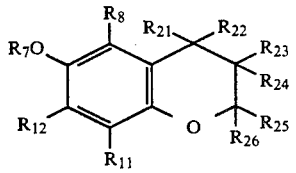

(III-4)

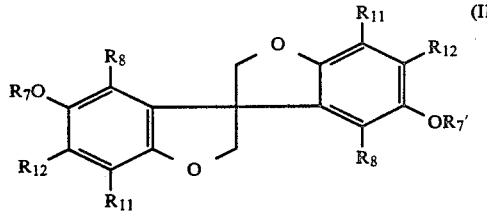

(III-5)

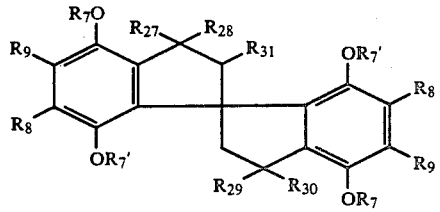

-continued (III-6)

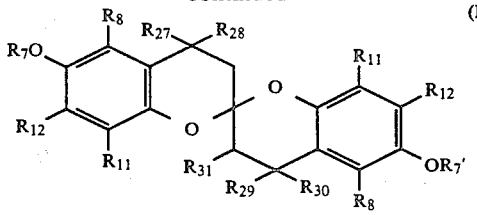

and (III-7)

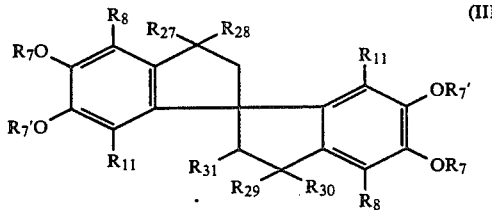

wherein in formulae (III-1) to (III-7), $R_7$, $R_7'$, $R_8$, $R_9$, $R_{10}$, $R_{11}$ and $R_{12}$ are the same as those set forth in formula (III); and $R_{21}$ to $R_{31}$ may be the same or different groups and each is a hydrogen atom, an alkyl group or an aryl group, $R_{24}$ and $R_{25}$ or $R_{25}$ and $R_{26}$ may be combined to form 5- or 6-membered hydrocarbon ring.

8. The silver halide color photographic light-sensitive material of claim 1, wherein the compounds of formula (III) are present in an amount of 10 to 400 mol % based on the amount of the coupler.

9. The silver halide color photographic light-sensitive material of claim 1, wherein the high-boiling organic solvent of formula (IV) is present in an amount such that the ratio of the high-boiling organic solvent of formula (IV)/the coupler of formula (I) is in the range from 0.05 to 20 by weight.

10. The silver halide color photographic light-sensitive material of claim 1, wherein the compounds of formulae (I), (II) and (III) are dissolved together in the high-boiling organic solvent represented by formula (IV) to allow them to exist in the same oil droplet.

11. The silver halide color photographic light sensitive material of claim 1, wherein in formula (II), Y is selected from the group consisting of a hydrogen atom, an alkyl group, an aryl group, a cyano group, an alkoxy group, an aryloxy group, an alkoxycarbonyl group, an aryloxycarbonyl group, a carbamoly group, an acyl group and an acyloxy group.

12. The silver halide color photographic light sensitive material of claim 1, wherein in formula (II), Y is selected from the group consisting of a hydrogen atom, an alkyl group and an acyl group.

13. The silver halide color photographic light sensitive material of claim 1, wherein in formula (II), Y is selected from the group consisting of a hydrogen atom and an alkyl group.

14. The silver halide color photographic light sensitive material of claim 1, wherein in formula (II), A is a non-metallic atomic group required for the formation of a piperidine ring.

15. The silver halide color photographic light sensitive material of claim 1, wherein in formula (II), $R_3$, $R_4$, $R_5$, and $R_6$ are each a methyl group.

* * * * *